US011559817B2

(12) United States Patent
Esfandiari

(10) Patent No.: US 11,559,817 B2
(45) Date of Patent: Jan. 24, 2023

(54) USING ELECTROKINETIC FORCES TO MANIPULATE SUSPENDED PARTICLES

(71) Applicant: University of Cincinnati, Cincinnati, OH (US)

(72) Inventor: Leyla Esfandiari, Cincinnati, OH (US)

(73) Assignee: University of Cincinnati, Cincinnati, OH (US)

( * ) Notice: Subject to any disclaimer, the term of this patent is extended or adjusted under 35 U.S.C. 154(b) by 275 days.

(21) Appl. No.: 16/611,386

(22) PCT Filed: May 17, 2018

(86) PCT No.: PCT/US2018/033164

§ 371 (c)(1),
(2) Date: Nov. 6, 2019

(87) PCT Pub. No.: WO2018/213562

PCT Pub. Date: Nov. 22, 2018

(65) Prior Publication Data

US 2020/0164385 A1 May 28, 2020

Related U.S. Application Data

(60) Provisional application No. 62/666,163, filed on May 3, 2018, provisional application No. 62/652,936, filed
(Continued)

(51) Int. Cl.
*B03C 5/00* (2006.01)
*B01L 3/02* (2006.01)

(52) U.S. Cl.
CPC ..... *B03C 5/005* (2013.01); *B01L 3/02* (2013.01); *B01L 2200/0652* (2013.01); *B01L 2300/0896* (2013.01); *B01L 2400/0424* (2013.01)

(58) Field of Classification Search
None
See application file for complete search history.

(56) References Cited

U.S. PATENT DOCUMENTS

2011/0083961 A1 4/2011 Muller et al.
2012/0222958 A1 9/2012 Pourmand et al.
(Continued)

OTHER PUBLICATIONS

M. Ghobadi, et al., "Quantitative Estimation of Electro-osmosis Forces on Charged Particles inside a Borosilicate Resistive-Pulse Sensor", In 2016 38th Annual International Conference of the IEEE Engineering in Medicine and Biology Society, p. 4228-4231, August (Year: 2016).*

(Continued)

*Primary Examiner* — J. Christopher Ball
(74) *Attorney, Agent, or Firm* — Wood Herron & Evans LLP

(57) ABSTRACT

Devices and methods for capturing biological materials using a potential well. An electrical signal is applied across a nanopipette having one end in a back-fill chamber and another end in a collection chamber containing a suspending medium including one or more types of particles. The collection end of the nanopipette includes a tip having an opening. The electrical signal applied across the nanopipette is configured to generate the potential well proximate to the tip in which the electrokinetic forces acting on the particles are balanced. The potential well may be configured to selectively trap one or the other types of particles suspended in the suspending medium. The particles may be transferred to a sample collection medium by immersing the tip in the sample collection medium and reversing the polarity of the electrical signal.

20 Claims, 46 Drawing Sheets

Related U.S. Application Data on Apr. 5, 2018, provisional application No. 62/507, 297, filed on May 17, 2017.

(56) References Cited

U.S. PATENT DOCUMENTS

| | | | |
|---|---|---|---|
| 2012/0225435 | A1 | 9/2012 | Seger et al. |
| 2014/0261757 | A1 | 9/2014 | Katsumoto |
| 2015/0185234 | A1 | 7/2015 | Gibbons et al. |
| 2016/0032275 | A1 | 2/2016 | Actis et al. |
| 2016/0041122 | A1 | 2/2016 | German et al. |

OTHER PUBLICATIONS

L. Esfandiari, et al., "Sequence-specific Nucleic Acid Detection form Binary Pore Conductance Measurement", Journal of the American Chemical Society, 134(38): p. 15880-15886 and supporting information, Sep. (Year: 2012).*

International Searching Authority, Search Report and Written Opinion issued in PCT/US2018/033164 dated Aug. 3, 2018, 11 pages.

* cited by examiner

USING ELECTROKINETIC FORCES TO MANIPULATE SUSPENDED PARTICLES

CROSS-REFERENCE TO RELATED APPLICATIONS

This application claims the benefit of and priority to Intl. Application No. PCT/US2018/033164, which claims the benefit of and priority to U.S. Application Nos. 62/507,297 filed May 17, 2017, 62/652,936 filed Apr. 5, 2018, and 62/666,163 filed May 3, 2018. The disclosures of the aforementioned applications are each incorporated by reference herein in their entireties.

TECHNICAL FIELD

The present invention generally relates to the manipulation of particles suspended in a medium using electric fields, and more particularly, to devices and methods for capturing biological materials using a potential well.

BACKGROUND

In the last few decades, considerable efforts have been made to develop new miniaturized technologies for particle manipulation, pre-concentration, and sorting using schemes based on optical, magnetic, acoustic, and electrical phenomena. Among these technologies, dielectrophoretic based schemes have gained significant attention because of their rapid and label-free criteria. Dielectrophoresis has been utilized for sorting, isolating, and manipulating micro- and nano-scale particles and biomolecules based on their dielectric properties using non-uniform electric fields. Conventional methods generate non-uniformity in the electric field by applying an alternating voltage to an array of electrodes, or by placing obstacles such as micro-pillars and rectangular hurdles in microfluidic channels in what is known as an insulator-based approach. Insulator-based dielectrophoresis (iDEP) has proven popular because it allows device functionality to be preserved despite fouling effects at the surfaces of the electrodes. Although this approach has shown promising attributes, the majority of iDEP devices require high operational voltages to produce electric fields in the range of 100 V/cm. These high fields can generate excessive heat in the system and cause biological samples to become denatured.

An alternative iDEP approach applies an alternating voltage across a glass nanopipette. Using this approach, the small conical geometry of the nanopore generates a relatively strong non-uniform electric field that creates a dielectrophoretic trapping zone inside of the nanopipette near to the tip. This method has been used to trap DNA molecules and proteins by backfilling the nanopipette with a solution containing the target analytes and concentrating the molecules inside the nanopipette. Although this technique may address the need to lower the operational voltage, because the solution must be introduced into the nanopipette, it unable trap analytes directly from a bulk suspending medium.

Different approaches have been attempted to address the inability of the above method to trap analytics from a bulk suspending medium. In one approach, the inner diameter of the nanopipette was enlarged to 800 μm. Other approaches attempted include utilizing a metal coated glass nanopipette to collect and manipulate molecules from the solution, and initially applying a pressure gradient to the suspending medium to drive the molecules close to the tip of a glass nanopipette. In the latter approach, the electro-osmotic flow, pressure-driven flow, and electrophoresis were balanced to trap DNA molecules. However, each of the above approaches use an alternating electric field.

Exosomes are small membrane vesicles, typically 30 to 150 nanometers (nm) in diameter and having a density of about 1.1-1.2 g/cm$^3$, released by cells into the extracellular space via the exocytosis pathway. Exosomes are thus commonly found in body fluids such as plasma, urine, and saliva at levels of about $10^6$ particles per 10 ml. Exosomes typically include specific surface markers on a plasma membrane, and carry gene regulatory content including proteins, microRNAs, and messenger RNAs. Exosomes act as vehicles for molecular cargo in cell-to-cell communication. Given these attributes, exosomes have potential as biomarkers for diagnosis and as new semi-synthetic drug delivery vehicles for personalized therapy. One challenge associated with exosomal research is the lack of a high throughput and quantitative isolation technology. Conventional methods for separating exosomes from biofluids typically rely on differential ultracentrifugation. However, differential ultracentrifugation is time-consuming and labor-intensive.

Dielectrophoresis has been used to separate target cells suspended in a solution based on the electrical properties of the cell, the suspending medium, and the electric field. For example, insulator-based dielectrophoretic devices have been developed to manipulate and separate biomolecules. While these devices have proven useful for this purpose, they also have certain disadvantages. For example, insulator-based dielectrophoretic devices require complicated fabrication procedures and high operational voltages that can damage the cells being collected. Insulator-based dielectrophoretic devices also normally operate using time-varying voltages, which prevents the devices from trapping particles in a large area.

Glass nanopipettes have been also been developed for DNA and protein molecules trapping. However, conventional methods employing nanopipettes require backfilling of the nanopipette with the suspending medium including the nanoparticles and/or biomolecules to be collected, which increases the likelihood of sample loss during the handling and filling process. Furthermore, these devices cannot be used for real time monitoring of cell secreted analytes in a culture medium.

The lack of good analytical tools for detection and quantification of metabolite and gene harboring membrane vesicles near living cells continues to be an obstacle to biomedical research. Thus, there exists a need for improved methods and devices for extracting microvesicles and/or other particles from suspending mediums.

SUMMARY

In an embodiment of the invention, a method of manipulating particles in a suspending medium is provided. The method includes immersing a first end of a nanopipette including an inlet in a back-fill medium and immersing a second end of the nanopipette including a tip in the suspending medium. A method further includes applying a reference signal to the suspending medium and applying a bias signal to the back-fill medium, the reference signal and the bias signal defining an electrical signal having a characteristic that generates a potential well which traps particles proximate to the tip of the nanopipette.

In another aspect of the method, the method further includes moving the tip to a collection medium in response to the particles accumulating at the tip of the nanopipette and changing the characteristic of the electrical signal to release the particles from the potential well and into the collection medium.

In another aspect of the method, changing the characteristic of the electrical signal includes reversing a polarity of the electrical signal.

In another aspect of the method, the suspending medium comprises an aqueous solution.

In another aspect of the method, the suspending medium includes a salt at a concentration of between 0.010 and 0.500 moles per liter.

In another aspect of the method, the characteristic of the electrical signal is determined based at least in part on a molar concentration of the salt in the suspending medium.

In another aspect of the method, the suspending medium is one of deionized water, a phosphate-buffered saline solution, or a potassium chloride solution.

In another aspect of the method, the particles include first particles and second particles different from the first particles, and the characteristic of the electrical signal is selected so that the potential well selectively traps the first particles.

In another aspect of the method, the particles include at least one of liposomes, exosomes, or carboxylate polystyrene beads.

In another aspect of the method, the tip of the nanopipette has a characteristic, and the characteristic of the electrical signal depends at least in part on the characteristic of the nanopipette.

In another aspect of the method, the characteristic of the nanopipette is a diameter of an opening in the tip, and the diameter is between 500 and 2000 nanometers.

In another aspect of the method, the characteristic of the nanopipette is a taper, and the taper is between 0 and 20 degrees.

In another aspect of the method, the characteristic of the nanopipette is a permittivity of a material from which the nanopipette is formed.

In another aspect of the method, the particles have a characteristic, and the characteristic of the electrical signal depends at least in part on the characteristic of the particles In another aspect of the method, the characteristic of the particles is one of a size, a charge, or a conductivity of the particles.

In another aspect of the method, the size of the particles is between 20 and 500 nanometers.

In another aspect of the method, the suspending medium has a characteristic, and the characteristic of the electrical signal depends at least in part on the characteristic of the suspending medium.

In another aspect of the method, the characteristic of the suspending medium is one of a viscosity, a permittivity, or a conductivity.

In another aspect of the method, the characteristic of the electrical signal is one or more of a voltage, a current, or a polarity of the electrical signal.

In another aspect of the method, the voltage is sufficient to generate an electric field of between 0.6 and 10 volts per centimeter proximate to the tip of the nanopipette.

In another aspect of the method, the method further includes measuring a current of the electrical signal and determining a number of particles that have been trapped in the potential well based on the current.

In another aspect of the method, the method further includes capturing one or more images of a region proximate to the tip of the nanopipette and determining a number of particles that have been trapped in the potential well based on the one or more images.

In another embodiment of the invention, a device for manipulating the particles in the suspending medium is provided. The device includes a first chamber, a second chamber, the nanopipette, a first electrode, a second electrode, and a signal source. The first chamber is configured to receive the back-fill medium and the second chamber is configured to receive the suspending medium. The nanopipette includes the first end having the inlet located in the first chamber and the second end having the tip located in the second chamber. The first electrode is located in the first chamber and the second electrode is located in the second chamber. The signal source includes a first terminal electrically coupled to the first electrode and a second terminal electrically coupled to the second electrode. The signal source is configured to output the bias signal on the first terminal and the reference signal on the second terminal, the reference signal and the bias signal defining the electrical signal having the characteristic that generates the potential well which traps the particles proximate to the tip of the nanopipette.

In another aspect of the device, the device includes one or more processors and a memory coupled to the one or more processors that includes program code which, when executed by the one or more processors, causes the apparatus to move the tip to a collection medium in response to the particles accumulating at the tip of the nanopipette and change the characteristic of the electrical signal to release the particles from the potential well and into the collection medium.

In another aspect of the device, changing the characteristic of the electrical signal includes reversing the polarity of the electrical signal.

In another aspect of the device, the particles include the first particles and the second particles different from the first particles, and the characteristic of the electrical signal is selected so that the potential well selectively traps the first particles.

In another aspect of the device, the tip of the nanopipette has a characteristic, and the characteristic of the electrical signal depends at least in part on the characteristic of the nanopipette.

In another aspect of the device, the particles have a characteristic, and the characteristic of the electrical signal depends at least in part on the characteristic of the particles.

In another aspect of the device, the suspending medium has a characteristic, and the characteristic of the electrical signal depends at least in part on the characteristic of the suspending medium.

The above summary presents a simplified overview of some embodiments of the invention to provide a basic understanding of certain aspects of the invention discussed herein. The summary is not intended to provide an extensive overview of the invention, nor is it intended to identify any key or critical elements or delineate the scope of the invention. The sole purpose of the summary is merely to present some concepts in a simplified form as an introduction to the detailed description presented below.

BRIEF DESCRIPTION OF THE DRAWINGS

The accompanying drawings, which are incorporated in and constitute a part of this specification, illustrate various embodiments of the invention and, together with the general description of the invention given above, and the detailed description of the embodiments given below, serve to explain the embodiments of the invention.

DETAILED DESCRIPTION

Figure 1:
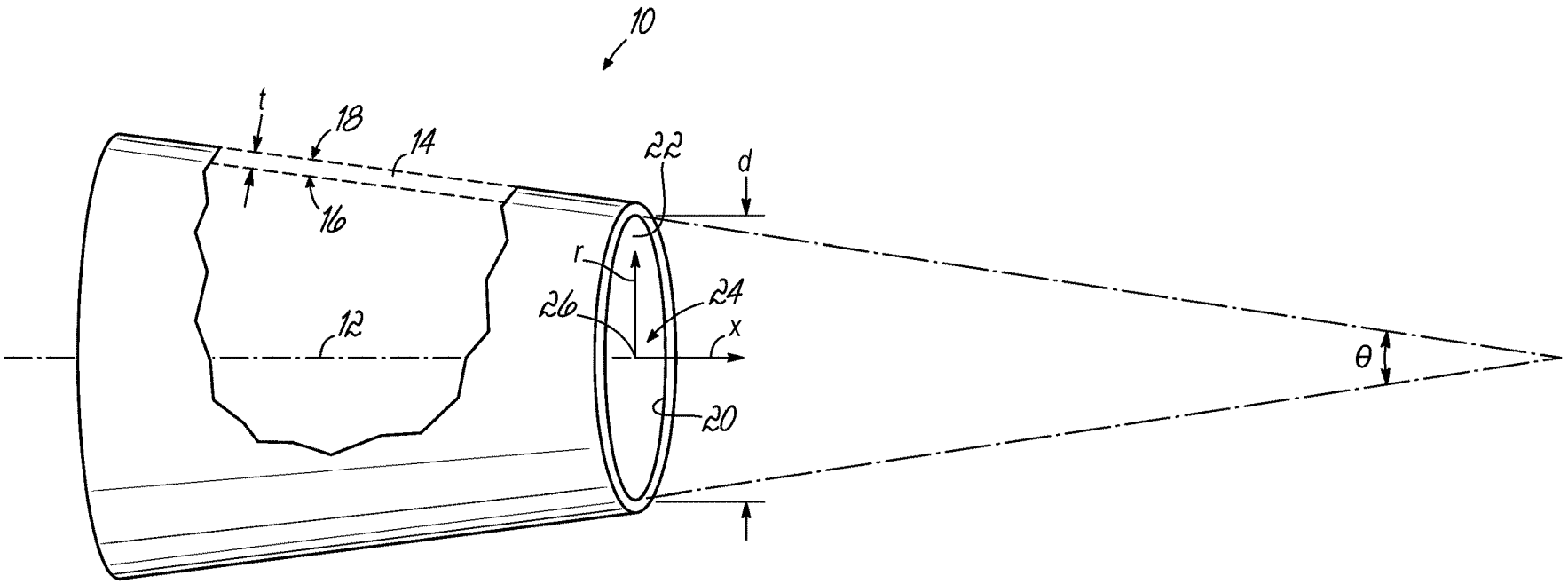
FIG. 1 is a perspective view of a tip of a nanopipette including an opening.

Embodiments of the invention include a nanopipette device configured to rapidly trap particles using an electric field generated by a direct current electrical signal. Advantageously, the particles in a bulk suspending medium are trapped in a trapping zone or region proximate to the tip of the nanopipette, thus facilitating the collection of particles from bulk suspending mediums. Particles may be trapped in suspending mediums having various ionic strengths. Experimental results have been obtained using 510 nm carboxylic acid polystyrene (COOH-PS) beads to demonstrate the electrokinetic forces involved. These forces include electrophoretic, dielectrophoretic, and electro-osmotic forces. These results demonstrate a correlation between the induced electrokinetic forces and the number of trapped particles. Numerical modeling and empirical observations been used to determine physical characteristics, such as the applied voltage, the ionic strength of the suspending medium, and the opening diameters necessary to generate potential wells that selectively trap particles within a desired trapping region.

To demonstrate the capability of embodiments of the invention to selectively capture nano-vesicles based on their dielectric properties and size, fluorescently tagged artificial liposomes with 100 nm diameters were selectively sorted and pre-concentrated from a phosphate-buffered saline solution containing 500 nm COOH-PS beads. Also, to further show the biomedical application of embodiments of the invention, small extracellular vesicles (exosomes) were extracted from plasma of healthy donors. These exosomes were then re-suspended in a phosphate-buffered saline solution. Experimental data shows that these re-suspended exosomes were trapped and pre-concentrated in under two minutes.

Embodiments of the invention may use a low amplitude Direct Current (DC) electrical signal (e.g., DC voltage or current) to generate a potential well in a collection chamber containing a bulk suspension medium. The potential well may rapidly and selectively capture and quantify biological materials, such as microvesicles, near living cells with low concentration sensitivity and spatiotemporal resolution. These particles may be captured using significantly lower voltages as compared to conventional insulator-based dielectrophoresis devices. Utilizing a nanopipette formed from glass provides a simple and cost-effective fabrication procedure as compared to conventional insulator-based dielectrophoresis devices made using microfabrication techniques. Use of nanopipettes also allows the applied voltage to be reduced significantly due to the small conical geometry of the tip.

According to an embodiment of the invention, a device is presented that isolates biological materials, such as biomolecules, microvesicles, cells, and/or other particles, based on their surface charge and size in a buffer solution with a high ionic concentration. The device can operate with electric field strengths as low as 0.6 V/cm. This electric field strength is significantly lower than conventional DC dielectrophoresis methods, which typically require electric field strengths of at least 350 V/cm. Because a lower voltage may be used, the isolated biological particles may maintain their integrity and functionality for further analysis. Particles may be trapped in as little as 100 seconds and the sample volume may be as low as 50 μl. Furthermore, the dielectrophoresis nanopipette device has a high spatial resolution allowing it to trap secreted particles near living cells.

The device may include a glass nanopipette having a conical tip and may be formed from a suitable material, such as borosilicate glass. The surface of the nanopipette may induce electro-osmotic flow in response to application of a DC voltage. Borosilicate nanopipettes may include deprotonated Si—OH to induce the electro-osmotic flow. The diameter of the opening or pore of the nanopipette tip may be, for example, 500 nm, 1000 nm, or 2000 nm. Accordingly, the diameter of the opening may be in the range of 500 nm to 2000 nm, although embodiments of the invention are not limited to any particular range of opening sizes.

Trapping of certain particles may be charge selective, in which case the trapping can be controlled by the polarity of the applied voltage. For example, charge selectivity may result from particles with high surface charge being urged toward the tip of the nanopipette by a dominant electrophoretic force. In contrast, particles with a low surface charge may be urged toward the tip by a dominant electro-osmotic force, e.g., in response to the polarity of the voltage being reversed. The non-uniform electric field at the tip tends to induce a negative dielectrophoresis force on particles, which in some cases may prevent the particles from entering the nanopipette, causing the particles to accumulate on or proximate to the tip. The applied electric field strength may be, for example, less than 10 V/cm, less than 6 V/cm, less than 4 V/cm, and as low as 0.6 V/cm. Accordingly, the applied voltage may be sufficient to generate an electric field strength in the range of 0.6 V/cm to 10 V/cm, although embodiments of the invention are not limited to this range of field strengths.

Trapping of the particles can be qualitatively and qualitatively measured by microscopic observation and conductance measurements across the nanopipette respectively. As particles cluster by the tip, the conductance across the opening may change based on the size of the particle. This conductance change across the nanopipette may be indicative of the size and the rigidity of the particles. For further quantitative analysis, the trapped particles may be released into another chamber containing a solution having a relatively low ionic concentration by applying a reverse voltage polarity. Solutions having low ionic concentrations may produce a relatively high velocity outward fluid stream that pushes the particles away from the opening and into the chamber containing the low ionic concentration solution.

When a voltage is applied across the glass nanopipette, the resulting electric field may act on particles in the suspending medium by way of three forces: an electrophoretic force, a dielectrophoretic force; and an electro-osmotic force that is due to an electro-osmotic flow of the suspending medium.

The electrophoretic, dielectrophoretic, and electro-osmotic forces may act on a charged particle with different potential polarities. Balancing these forces can lead to trapping of particles having certain characteristics, such as size, charge, or conductance. The forces can be calculated using a series of electrokinetic equations and modeled on a computer. The same analysis can be expanded for particles with different surface charge and/or size to evaluate the trapping efficiency and selectivity in various experimental conditions such as different electric field strengths and polarities, various ionic concentrations in the suspending medium, and geometric characteristics of the tip such as the size of the opening.

Embodiments of the present invention trap particles by generating a zero-net force region, or "potential well", that selectively traps particles by balancing the electrokinetic forces acting on the particles. These electrokinetic forces may include the dielectrophoretic force, the electrophoretic force, and drag between the particles and the flow of fluid caused by electro-osmosis (i.e., the electro-osmotic force) or pressure differentials. Particles trapped in the potential well may include liposomes and exosomes, which may be extracted directly from a bulk sample solution.

FIG. 1 depicts the tip 10 of a micropipette in accordance with an embodiment of the invention. The tip 10 may have a generally conical shape that is symmetrical about a central axis 12. The tip 10 includes a wall 14 having an inner surface 16 that defines an interior portion of the tip 10, an outer surface 18, and a thickness t. An edge 20 of inner surface 16 may define an opening 22 having a diameter d at the distal end of the tip 10. Opening 22 may include an interior side that faces toward the interior of tip 10, and an exterior side that faces away from the tip 10.

The central axis 12 of tip 10 may define a longitudinal axis x of a coordinate system 24. The coordinate system 24 may also include an origin 26 located at a point where the central axis 12 intersects a plane defined by opening 22, and a radial axis r that is orthogonal to and intersects the longitudinal axis x at the origin 26. The longitudinal and radial axes x, r of coordinate system 24 may be referred to herein to describe relative positions and/or orientations of forces acting on particles and/or locations of regions with respect to the opening 22. The inner and outer surfaces 16, 18 of tip 10 may be tapered at an angle θ such that the diameter of the opening 22 is less than the diameter of the inner surface 16 at other points along the central axis 12 of tip 10.

Figure 2:
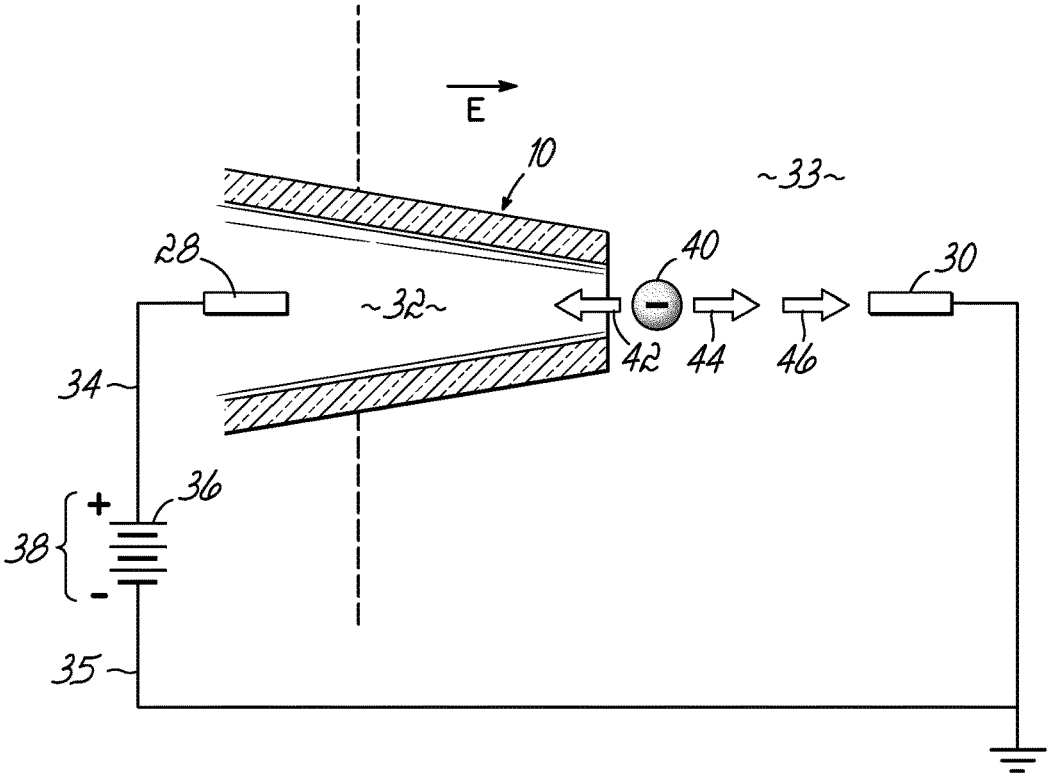
FIG. 2 is a diagrammatic view of the tip of FIG. 1 showing the effects of electrokinetic forces on a particle proximate to the opening when a positive voltage is applied across bias and reference electrodes.
Figure 3:
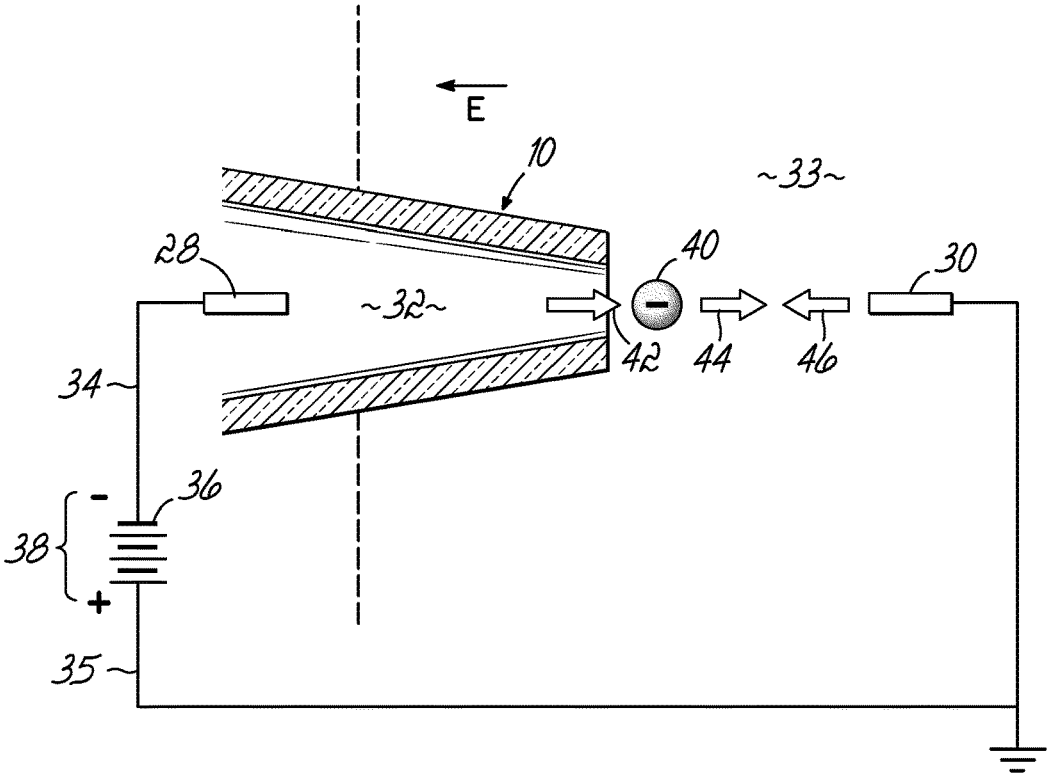
FIG. 3 is a diagrammatic view of the tip of FIG. 1 showing the effects of electrokinetic forces on a particle proximate to the opening when a negative voltage is applied across bias and reference electrodes.

Referring now to FIGS. 2 and 3, an electric field may be generated in the region proximate to the tip 10 by applying an electric signal across a bias electrode 28 and a reference electrode 30. The bias electrode 28 may contact a back-fill medium 32 fluidically coupled to the opening 22 of tip 10 from the interior side of the opening 22, and the reference electrode 30 may contact a suspending medium 33 fluidically coupled to the opening 22 of tip 10 from the exterior side of opening 22. The bias electrode 28 and reference electrode 30 may be electrically coupled to a respective bias terminal 34 a respective reference terminal 35 of a signal source 36. The signal source 36 may be configured to generate an electrical signal 38 across the terminals 34, 35 so that a bias signal is applied to the bias electrode 28 and a reference signal is applied to the reference electrode 30. The electrical signal 38 may be a voltage (depicted) or a current having a constant or time-varying amplitude. Each of the electrodes 28, 30 may be electrically coupled to the opening 22 by their respective medium 32, 33.

The electrical signal 38 may produce electric fields proximate to the tip 10 that cause one or more forces to act on particles suspended in the suspending medium 33. By way of example, a particle 40 may be located proximate to the opening 22 (e.g., between 0 and 2000 nm from the opening 22) along the longitudinal axis x on the exterior side of the opening 22. Forces acting on the particle 40 due to the electric fields proximate to the tip 10 may include an electrophoretic force 42, a dielectrophoretic force 44, and an electro-osmotic force 46.

The electrophoretic force 42 may result from an electrostatic phenomenon that causes electrically charged particles to be attracted toward an opposite charge and away from a like charge. The motion of particles relative to a liquid due to the influence of an electrophoretic force is known as "electrophoresis".

The dielectrophoretic force 44 may result from the effects of a nonuniform electric field on a particle. When a dielectric particle is exposed to a nonuniform electric field, the field may induce a dipole in the particle. Because the field is nonuniform, one end of the dipole may be in a region of the field having a higher strength than the other end of the dipole. This may cause the dipole to align with the field and to be urged in the direction of increasing field strength. The movement of particles in a liquid due to nonuniform electric fields is known as "dielectrophoresis".

The electro-osmotic force 46 may result from a flow of the media 32, 33 known as electro-osmosis. Electro-osmosis can be induced in a region of a liquid containing ions, such as a buffer solution, by introducing a voltage differential across the region, and is believed to be due to the movement of the ions in the liquid induced by the resulting electric field. Thus, the level of electro-osmosis in a liquid may depend in part on the number of ions present in the liquid.

As shown by FIG. 2, if the particle 40 is a negatively charged particle, and the electrical signal 38 causes the bias electrode 28 to have a positive voltage relative to the reference electrode 30, the electrophoretic force 42 may urge the particle 40 in a negative direction along the longitudinal axis x, i.e., toward the region of higher electric potential. In contrast, the dielectrophoretic force 44 and electro-osmotic force 46 caused by the positive electric field E generated by the positive voltage across electrodes 28, 30 may urge the particle 40 in a positive direction along the longitudinal axis x, i.e., toward the region of lower electric potential.

As shown by FIG. 3, if the particle 40 is a negatively charged particle, and the electrical signal 38 causes the bias electrode 28 to have a negative voltage relative to the reference electrode 30, the electrophoretic force 42 and dielectrophoretic force 44 may urge the charged particle 40 in a positive direction along the longitudinal axis x, i.e., toward the region of higher electric potential. In contrast, the electro-osmotic force 46 caused by the negative electric field E may urge the charged particle in a negative direction along the longitudinal axis x, i.e., toward the region of lower electric potential. Thus, reversing the electric field E reverses the directions of the electrophoretic force 42 and electro-osmotic force 46, but the direction of the dielectrophoretic force 44 remains positive. The electrophoretic, dielectrophoretic, and electro-osmotic forces can be controlled in several ways, including by adjusting the dimensions of the tip 10, the electrical signal applied to the electrodes 28, 30, and the ionic content of the medium in which the charged particle 40 is suspended.

Figure 4:
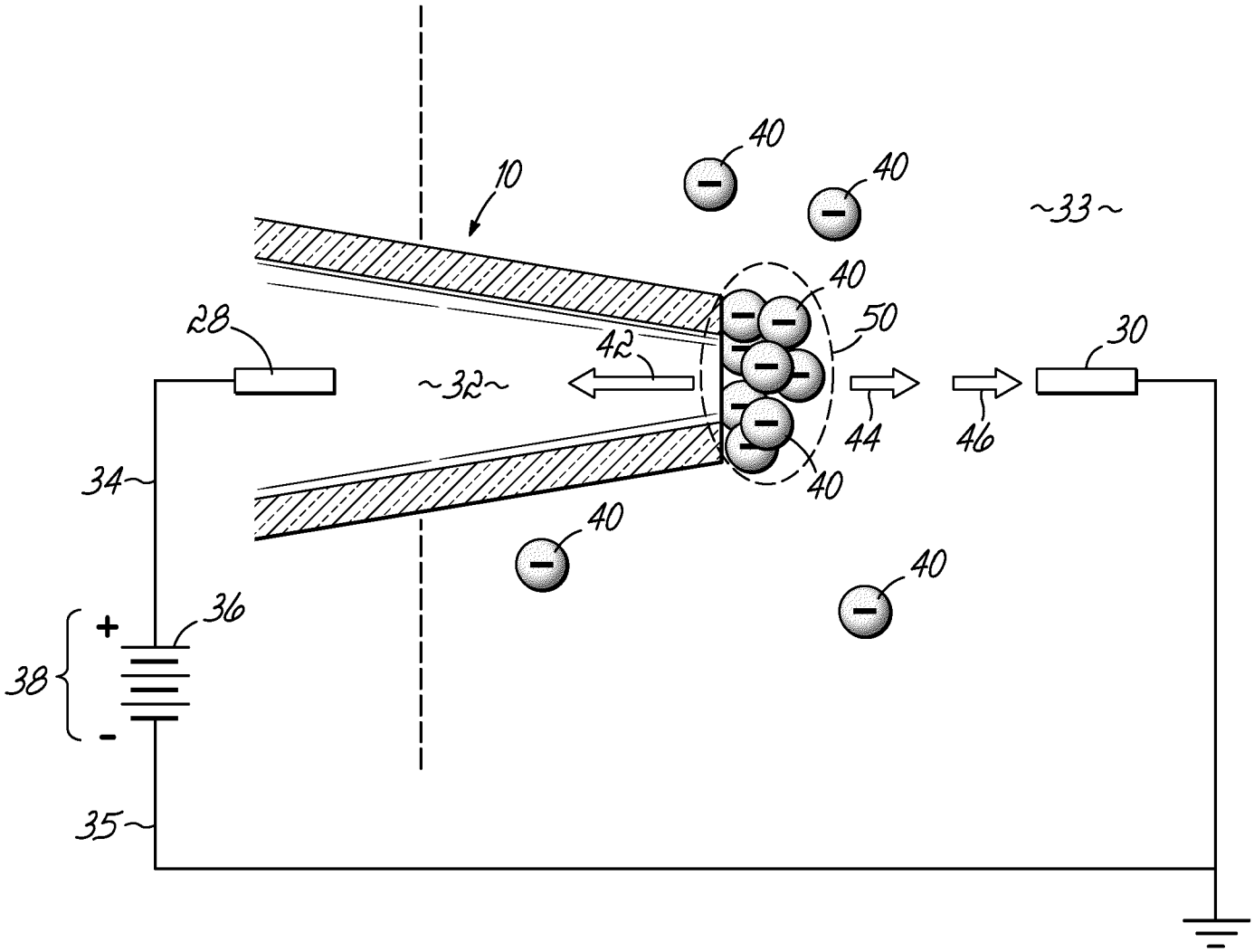
FIG. 4 is a diagrammatic view of the tip of FIG. 2 showing a plurality of particles being trapped by a potential well under the influence of a positive electric field generated by the positive voltage.

FIG. 4 depicts a potential well 50 comprising a region of zero or near-zero net force in which electrophoretic force 42, dielectrophoretic force 44, and electro-osmotic force 46 acting on the particles 40 essentially cancel each other out. Outside of the potential well 50, the net effect of the electrophoretic, dielectrophoretic, and electro-osmotic forces acting on the particles 40 may urge the particles 40 toward the potential well 50, thereby forming a trapping region. The potential well 50 may be produced proximate to the opening 22 of tip 10 in response to the application of an electric signal to the electrodes 28, 30. The characteristics of the potential well 50 (e.g., shape, size, volume, and location) may depend at least in part on the characteristics of the electric signal (e.g., the amplitude and polarity), the characteristics of the tip 10 (e.g., the taper angle θ and diameter d of opening 22), the characteristics of the medium 32 in the nanopipette and/or the medium 33 in which the particles are suspended (e.g., the ionic concentration and/or the viscosity of each medium), and the characteristics of the particles 40 (e.g., size and charge).

Figure 5:
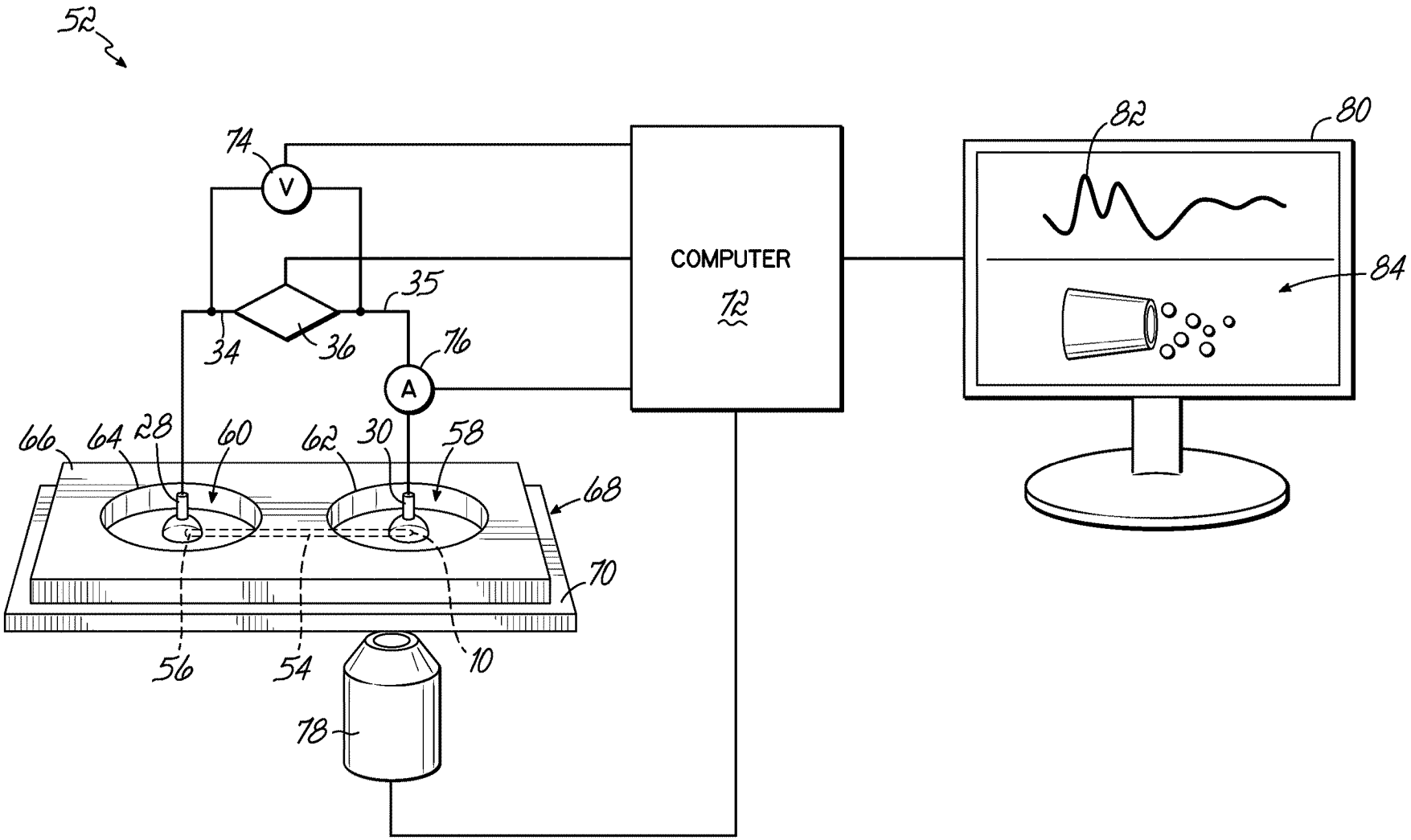
FIG. 5 is a diagrammatic view of a device for selectively trapping particles using the electrokinetic forces of FIGS. 3 and 4.

FIG. 5 depicts a device 52 configured to selectively capture particles 40 using a potential well 50 in accordance with an embodiment of the invention. The device 52 includes a nanopipette 54 comprising the tip 10 at a distal end thereof and an inlet 56 at a proximal end thereof. The tip 10 of nanopipette 54 may be positioned in a collection chamber 58 configured to receive a suspending medium, and the inlet 56 of nanopipette 54 may be located in a back-fill chamber 60 or another reservoir configured to receive a back-fill medium. Each chamber 58, 60 may be defined, for example, by a respective aperture 62, 64 in a top sheet 66 that forms a side-wall of the respective chamber 58, 60 and a bottom sheet 68 having a top surface 70 that forms a bottom of the respective chamber 58, 60.

In an embodiment of the invention, the nanopipette 54 may be made from borosilicate, aluminosilicate, quartz, or another suitable material. The top sheet 66 may comprise a viscoelastic material, such as polydimethylsiloxane (PDMS), and the bottom sheet 68 may comprise a rigid optically transparent material, such as glass. The use of a viscoelastic material may allow the top sheet 66 to flow over and mold to the outer surface 18 of nanopipette 54 and/or a top surface 70 of bottom sheet 68. The top sheet 66 may thereby provide a liquid-tight seal against the nanopipette 54 and/or bottom sheet 68.

The device 52 may further include a computer 72 in communication with the signal source 36 and one or more sensors. The sensors may include a voltage meter 74 configured to measure the voltage provided to the electrodes 28, 30, a current meter 76 configured to measure the current flowing through the electrodes 28, 30 (and hence through the opening 22), and a camera 78 configured to capture one or more images (e.g., a series of images comprising a video stream) of the region proximate to the tip 10 of nanopipette 54, e.g., through bottom sheet 68. The computer 72 may be configured to control the amplitude of the electrical signal 38 output by the signal source 36, as well as capture data from each of the voltage meter 74, current meter 76, and camera 78. The computer 72 may present the voltage, current, and image data captured by the respective sensors on a display 80 in the form of one or more signal traces 82 and/or images 84 showing the movement of particles 40 in the collection chamber 58.

The electrophoretic force $F_{EP}$ acting on a spherical particle may be determined using the following equation:

$$F_{EP}=6\pi\eta r\mu_{EP}E \quad \text{Eqn. 1}$$

where η is the viscosity of the suspending medium, r is the radius of the particle, $\mu_{EP}$ is the electrophoresis mobility, and E is the applied electric field. The electrophoresis mobility $\mu_{EP}$ may be determined using the following equation:

$$\mu_{EP} = \frac{2\xi_p\varepsilon_m}{3\eta} \quad \text{Eqn. 2}$$

where $\xi_p$ is the zeta potential of the particle, and $\varepsilon_m$ is the permittivity of the suspending medium. The electrophoretic velocity $u_{EP}$ can be calculated from the electrophoretic mobility $\mu_{EP}$ using the following equation:

$$u_{EP}=\mu_{EP}E \quad \text{Eqn. 3}$$

The dielectrophoretic force $F_{DEP}$ acting on a spherical particle can be determined as:

$$F_{DEP}=2\pi r^3\varepsilon_m Re(f_{CM})\nabla E^2 \quad \text{Eqn. 4}$$

where $\nabla E^2$ is the electric field gradient, and $Re(f_{CM})$ is the Clausius-Mossotti factor, which is provided by:

$$\mathrm{Re}(f_{CM}) = \frac{\varepsilon_p^* - \varepsilon_m^*}{\varepsilon_p^* + 2\varepsilon_m^*} \quad \text{Eqn. 5}$$

where $\varepsilon_p^*$ and $\varepsilon_m^*$ are the complex permittivity's of the particle and the medium, respectively. The complex permittivity may be expressed by $\varepsilon^*=\varepsilon-(j\sigma/\omega)$, where ε is the real permittivity, σ is the conductivity, and ω is the angular frequency of the applied electric field. The Clausius-Mossotti factor under DC field can also be represented as:

$$\mathrm{Re}(f_{CM}) = \frac{\sigma_p - \sigma_m}{\sigma_p + 2\sigma_m} \quad \text{Eqn. 6}$$

where $\sigma_p$ is the conductivity of the particle and $\sigma_m$ is the conductivity of the suspending medium. Exemplary conductivities include $\sigma_p$=15.6 μS/cm for 510 nm COOH-PS beads, $\sigma_m$=1.13 μS/cm for deionized water, and $\sigma_m$=3000 μS/cm for 10 mM potassium chloride solution. The dielectrophoretic velocity $u_{DEP}$ may be determined using equation 7:

$$u_{DEP}=-\mu_{DEP}\nabla E^2 \quad \text{Eqn. 7}$$

where $\mu_{DEP}$ is the dielectrophoretic mobility. The dielectrophoretic mobility can be determined using equation 8:

$$\mu_{DEP} = \frac{r^2\mathrm{Re}(f_{cm})\varepsilon_m}{3\eta} \quad \text{Eqn. 8}$$

The electro-osmotic force $F_{EOF}$ is may be determined using Equation 9, and (absent any flow other than electro-osmotic flow) is equal to the drag force $F_{drag}$:

$$F_{EOF}=F_{drag}=\tfrac{1}{2}C_d\rho v^2A \quad \text{Eqn. 9}$$

where $C_d$ is the coefficient of drag for the particle, ρ is the density of suspending medium, v is the velocity of fluidic flow relative to the particle, and A is the cross-sectional area of particle. The electro-osmotic flow velocity $\mu_{EOF}$ may be determined as:

$$u_{EOF} = \mu_{EOF} E = \frac{\varepsilon E \zeta}{4\pi\eta} \quad \text{Eqn. 10}$$

where $\mu_{EOF}$ is the electro-osmotic flow mobility, ε is the permittivity of the suspending medium, and ζ is the zeta potential of the wall 14 of the nanopipette 54. The zeta potential for the glass nanopipette can be estimated using Graham's equation, which relates the zeta potential to the estimated surface charge density of the micropipette.

The velocity of a negatively charged particle may be determined by the superposition of the flow of the surrounding bulk medium caused by electro-osmotic flow, the electrophoretic velocity of a particle $v_{EP}$, and the dielectrophoretic velocity of a particle $v_{DEP}$. Adding each of these effects may allow the particle velocity to be determined using Eq. 11:

$$v = u + \mu_{EP} E - \mu_{DEP} \nabla E^2 \quad \text{Eqn.11}$$

To quantify the magnitude and direction of the velocity of the particles, a series of equations is solved below. The bulk fluid flow and the electric field E can be evaluated by solving the coupled system of electrokinetic equations—Poisson's equation, Nernst-Planck equation, and Stoke's equation. The electric field E through the electrostatic potential (ϕ) can be described by Poisson's equation:

$$\nabla \phi(r) = -\frac{\rho_e(r)}{\varepsilon_0 \varepsilon_r} \quad \text{Eqn. 12}$$

where $\varepsilon_0$ is the permittivity of free space (about $8.85\times10^{-12}$ F/m) and $\varepsilon_r$ is the relative permittivity of the material.

The flux of two ionic species (e.g., K+ and Cl−) may be is defined using the Nerst-Planck equation:

$$J = -\left\{D\nabla c - uc + \frac{Dze}{k_B T} c\left(\nabla \phi + \frac{\partial_A}{\partial_t}\right)\right\} \quad \text{Eqn. 13}$$

where D is the diffusivity, c is the ionic concentration, z is the valence of the ionic species, e is the elementary charge, $k_B$ is the Boltzmann constant, T is the temperature and u is the velocity of fluid.

The relation between fluid velocity body force ($\rho_e(r)\nabla\phi(r)$) and the pressure gradient (∇p) is defined by Stoke's equation:

$$\eta\nabla^2 u = \rho_e(r)\nabla\phi(r) + \nabla p \quad \text{Eqn. 14}$$

For the simulations used to produce the below experimental results, $\eta=1\times10^{-3}$ Pa·s, and ∇p is 0.

SIMULATION METHODOLOGY

Simulation results were obtained using COMSOL® Multiphysics version 5.2a finite element analysis software, which can be obtained from COMSOL Inc. of Stockholm, Sweden, and are based on equations 1-14 above. The software was used to determine the distribution of electrophoretic, dielectrophoretic, and electro-osmotic forces acting on the particles based on factors including one or more of the characteristics of the electric signal, the suspending medium, the particles, and the tip.

The system being modeled comprised a 1-D model where Poisson's and Nernst-Planck Equations were solved for variations in the electric fields and concentration distribution of ionic species along the boundary of the system. The 1-D model served as the Dirichlet boundary conditions for the 2-D model, thereby emulating the nanopipette setup. A 2-D axisymmetric design comprising the borosilicate nanopipette suspended in a circular reservoir filled with monovalent buffered salt was constructed, and boundary conditions applied corresponding to the solution obtained from the Poisson-Boltzmann equation for electric potential. The conditions established that the electric potential did not diverge and the gradient of this potential on the nanopipette surface varied with the change in surface charge density.

The model computed a combination of multiple physical phenomena pertaining to different aspects of the system. Electrostatics catered to the surface charge and voltage related analysis, creeping flow was solved for the study of incompressible and non-isothermal flow along the glass walls of the nanopipette, and transport of diluted species was incorporated for the migration of ionic species with the applied fields. The solution of the system provided the electric field and gradient of the square of electric field along the entire nanopipette length.

Figure 6:
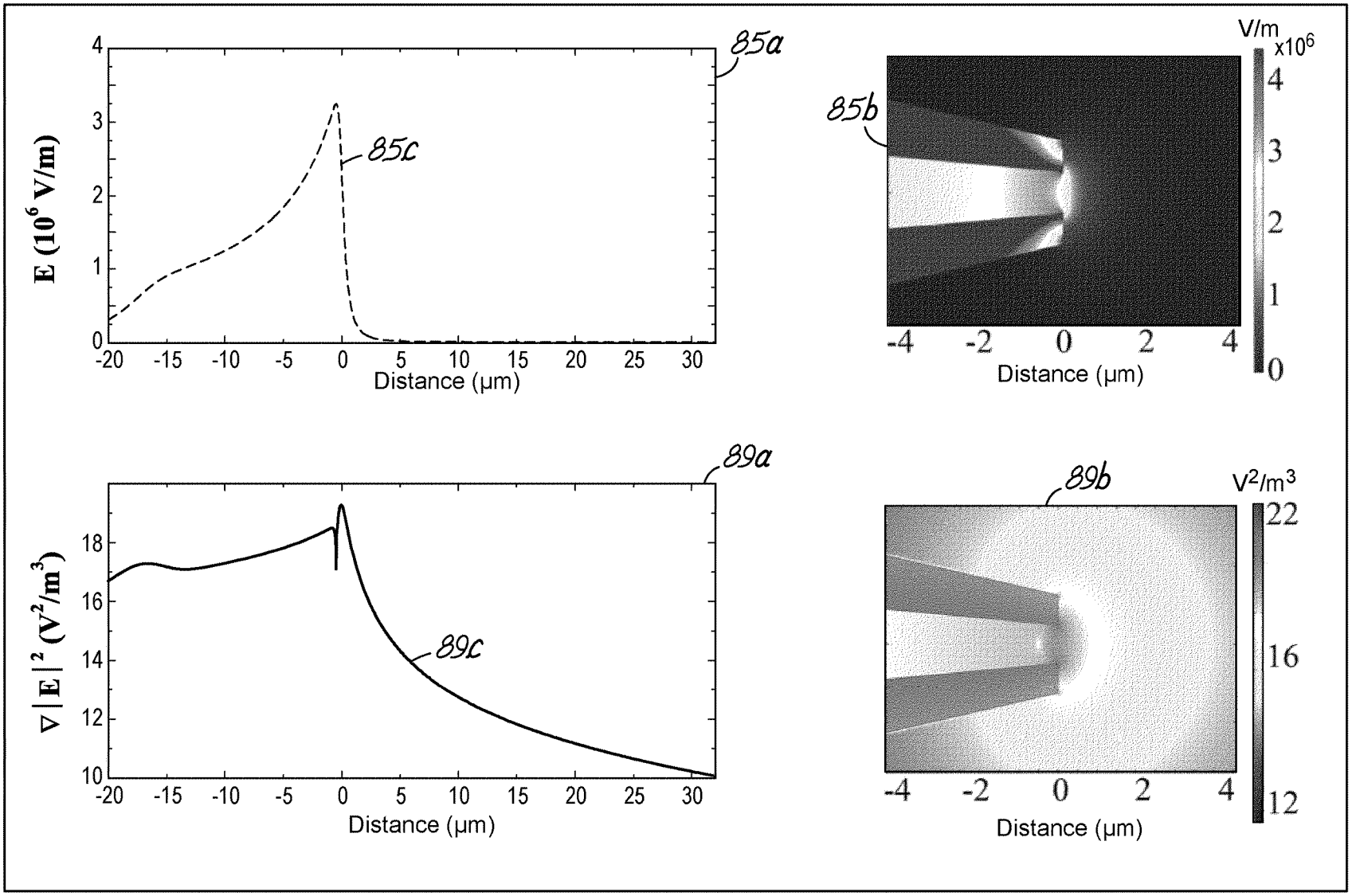
FIG. 6 includes graphical views of simulated distributions of the electric field and the electric field gradient proximate to the tip with respect to distance from the opening in the device of FIG. 5.

FIG. 6 depicts graphs 85*a*, 89*a* and images 85*b*, 89*b* showing exemplary simulated electric fields and electric field gradients proximate to the tip 10 of nanopipette 54. Graph 85*a* includes a plot 85*c* of the simulated electric field distribution with respect to distance from the opening 22 along the central axis of the nanopipette, and image 85*b* shows a 2-D surface plot of the electric field distribution proximate to the tip 10 of nanopipette 54. Graph 89*a* includes a plot 89*c* of the simulated electric field gradient distribution with respect to distance from the opening 22 along the central axis of the nanopipette 54, and image 89*b* shows a 2-D surface plot of the electric field gradient distribution proximate to the tip 10 of nanopipette 54.

A comprehensive qualitative analysis of different force distributions along the entire nanopipette's length and in the region on the exterior side of the opening was conducted using line graphs. Each force was mathematically represented by an equation in the process and was plotted along the nanopipette's length in the axisymmetric model. Different physical conditions in the experimental setup gave rise to a set of phenomena and eventually introduced the forces in the system. The negatively charged microspheres used in the simulation interacted with the applied electric field and experience the electrophoretic force under the applied bias.

The surface charge density of a borosilicate nanopipette has been determined to be −0.02 C/m$^2$. Zeta values of the nanopipette were estimated to be −123 mV, −66.8 mV, −26.3 mV and −12.2 mV for 1 mM, 10 mM, 100 mM and 500 mM buffered potassium chloride solutions having a pH=7.0, respectively. The zeta potential of the glass wall was assumed to be constant over the entire surface of the nanopipette in the model. Table I shows the zeta-potential of 510 nm COOH-PS beads for the suspending mediums used to obtain the simulated and empirical experimental results disclosed below.

TABLE I

| Zeta Potential of 510 nm COOH-PS Beads | |
|---|---|
| Suspending Medium | Zeta Potential (Mv) |
| 1 mM KCl | −48.25 ± 1.48 |
| 10 mM KCl | −39.13 ± 4.12 |
| 100 mM KCl | −21.05 ± 3.79 |
| 500 mM KCl | −13.06 ± 2.26 |
| 1X phosphate buffered saline | −5.71 ± 0.27 |

COOH-PS beads with 510 nm diameters were re-suspended in different electrolyte solutions to provide a final concentration of $1.37\times10^7$ particles/ml. The conductivity of COOH-PS beads was determined to be 15.6 μS/cm. Fluorescently labeled liposomes with 100 nm diameters were re-suspended into a 1× phosphate-buffered saline solution at a final concentration of $1\times10^{11}$ particles/ml. Lyophilized exosomes were reconstructed in a 1× phosphate-buffered saline solution at the final concentration of $1\times10^8$ particles/ml.

Empirical results were obtained using potassium chloride solutions having a pH of 7.0 and concentrations of 500 mM, 100 mM, 10 mM, and 1 mM. Phosphate-buffered saline solutions were diluted 10 times at pH 7.4. The conductivities of the above solutions were determined to be 58.8 mS/cm for 500 mM, 13.94 mS/cm for 100 mM, 3.00 mS/cm for 10 mM, and 1.10 mS/cm for 1 mM potassium chloride solutions and 16.22 mS/cm for a 1× phosphate-buffered saline solution. The conductivities were measured using a conductivity meter.

Borosilicate nanopipettes 54 with different diameters (500 nm, 1000 nm and 2000 nm) were fabricated using a Sutter P2000 laser-based micropipette puller available from Sutter Instrument of Novato, Calif., United States. Table II shows an exemplary program used by the puller.

TABLE II

| Fabrication Parameters for Nanopipettes | | | | | |
|---|---|---|---|---|---|
| Diameter of Opening | FILAMENT | HEAT | PULL | VEL | DELAY |
| 500 nm | $1^{st}$ line: 4 | $1^{st}$ line: 350 | $1^{st}$ line: 0 | $1^{st}$ line: 40 | $1^{st}$ line: 200 |
| | $2^{nd}$ line: 4 | $2^{nd}$ line: 350 | $2^{nd}$ line: 0 | $2^{nd}$ line: 40 | $2^{nd}$ line: 200 |
| | $3^{rd}$ line: 4 | $3^{rd}$ line: 450 | $3^{rd}$ line: 0 | $3^{rd}$ line: 60 | $3^{rd}$ line: 200 |
| 1000 nm | $1^{st}$ line: 4 | $1^{st}$ line: 350 | $1^{st}$ line: 0 | $1^{st}$ line: 30 | $1^{st}$ line: 200 |
| 2000 nm | $1^{st}$ line: 4 | $1^{st}$ line: 350 | $1^{st}$ line: 0 | $1^{st}$ line: 24 | $1^{st}$ line: 0 |

The diameters of nanopipettes were approximated by comparing their conductance with the conductance of the same sized nanopipettes purchased from World Precision Instruments, Inc. of Sarasota, Fla., United States.

The fluorescent intensity of the trapped particles was quantified using an NIS-Elements Advanced Research software, which is available from Nikon Instruments of Tokyo Japan. The number of trapped particles was estimated by dividing the total fluorescent intensity of the trapped particles by the fluorescent intensity of an individual particle.

To track the trajectories of particles, real-time recorded video during the experiment was run frame by frame. A frame of reference axis was established with its origin at the tip 10 of nanopipette 54 and a calibration length was marked to provide a reference length scale for the moving particles. At each frame, a chosen particle of interest was manually marked for its coordinate locations until it was trapped proximate to the tip 10. Three beads were tracked for each experimental condition, and the process was repeated at least three times for each bead. Once the coordinate data corresponding to the motion of beads was obtained, instantaneous velocities were computed at each frame.

Unless indicated otherwise, the effect of electro-thermal flow was neglected since the electro-thermal flow is typically significant only when using high-frequency alternating current electrical signals.

EXPERIMENTAL RESULTS

In order to facilitate a more complete understanding of the embodiments of the invention, some non-limiting examples of simulated and empirical results are provided below.

FIGS. 7-12 depict results of simulations that illustrate selective trapping of negatively charged particles in the potential well 50 that forms proximate to the tip 10 of nanopipette 54 when the bias electrode 28 is provided with a positive voltage relative to the reference electrode 30. Particles suspended in the suspending medium 33 may be carried into the potential well 50 by fluid flow.

Figure 7:
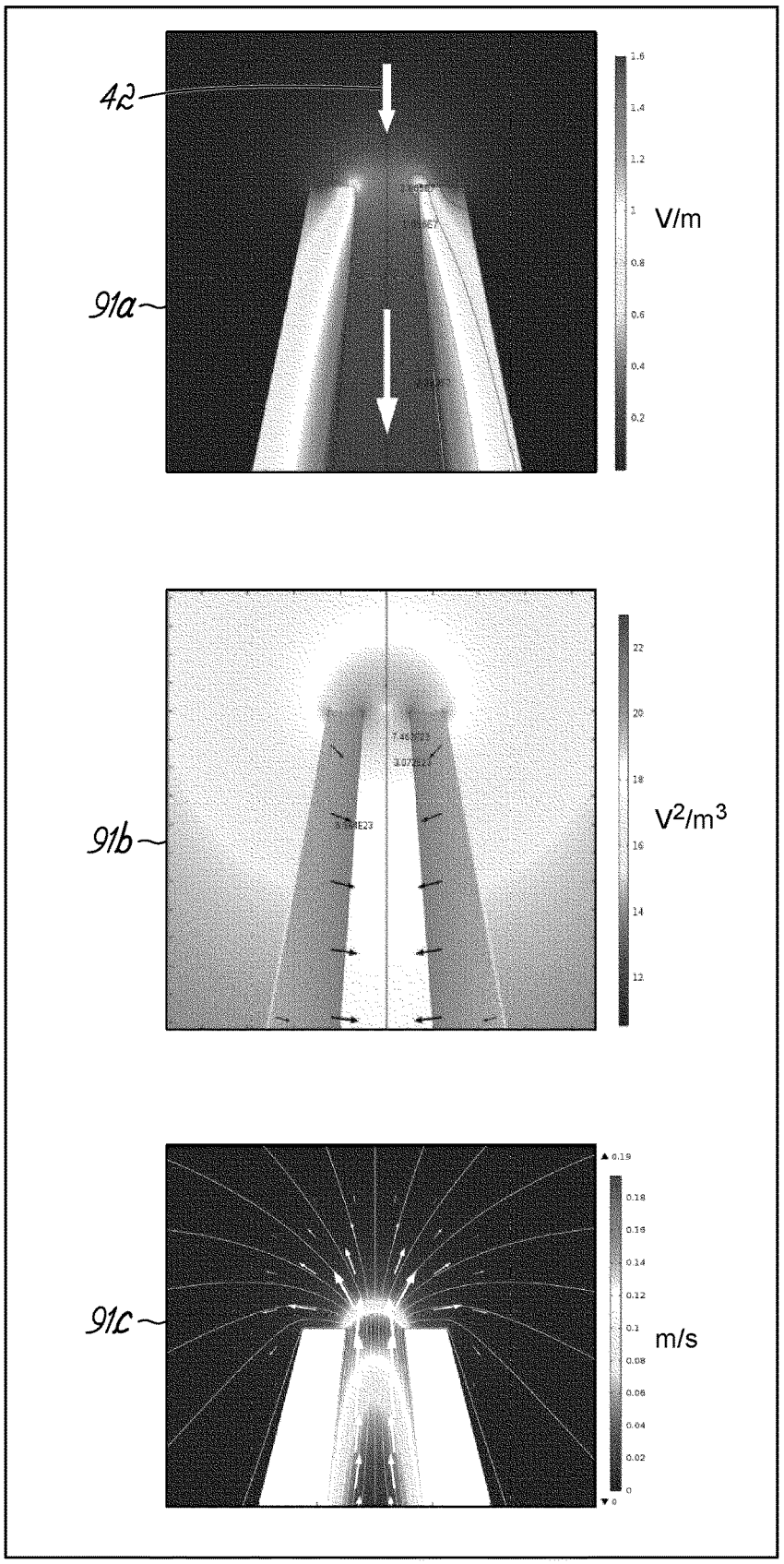
FIG. 7 includes graphical views of the electric field distribution E, electric field gradient $\nabla E^2$, and surface fluid flow velocity u proximate to the tip in the device of FIG. 5.

FIG. 7 includes images 91*a*-91*c* depicting the electric field distribution E, (image 91*a*) electric field gradient $\nabla E^2$ (image 91*b*), and surface fluid flow velocity u (image 91*c*). The images 91*a*-91*c* were generated using Equations 1-14 governing the movement of particles in a suspending medium and the results modeled in the region proximate to the tip 10 of nanopipette 54. The results shown are for an opening 22 having a diameter of 1000 nm, an applied DC voltage of 28 V, and 10 mM potassium chloride solution as the back-fill and suspending media 32, 33 with a positive electric field polarity at the tip 10. A fixed surface charge density of −0.02 $C/m^2$ was used over the inner surface 16 of nanopipette 54. A relative permittivity of 4.2 (a typical permittivity for glass) was used for the wall 14 of nanopipette 54 and a relative permittivity of 80 (the standard permittivity of water) was used for the back-fill medium 32 and suspending medium 33. Diffusion constants of $2\times10^{-9}$ $m^2/s$ were assumed for both ionic species (i.e., K+ and Cl−) in both mediums 32, 33.

Image 91*a* illustrates that the electric field E is stronger proximate to the tip 10 than in other regions of the back-fill medium 32 and bulk suspension medium 33. The resulting electrophoretic force 42 may drive negatively charged particles in the bulk suspending medium 40 towards the tip 10. Image 91*b* depicts the electric field gradient $\nabla E^2$ of the electric field E of image 91*a*. As can be seen, the electric field gradient $\nabla E^2$ generally increases with decreasing distance from the tip 10 due to the non-uniform distribution of the electric field E proximate to the tip 10. Image 91*c* depicts a simulated electro-osmotic flow proximate to the tip 10, and illustrates that the electro-osmotic flow velocity is predicted to be outward (i.e., positive along the x-axis of coordinate system 24) and increases with reduced distance from the opening 22 of tip 10. This result may be due to the effect of the negatively charged surface of the glass nanopipette 54 on the ion concentration of the solution.

Figure 8:
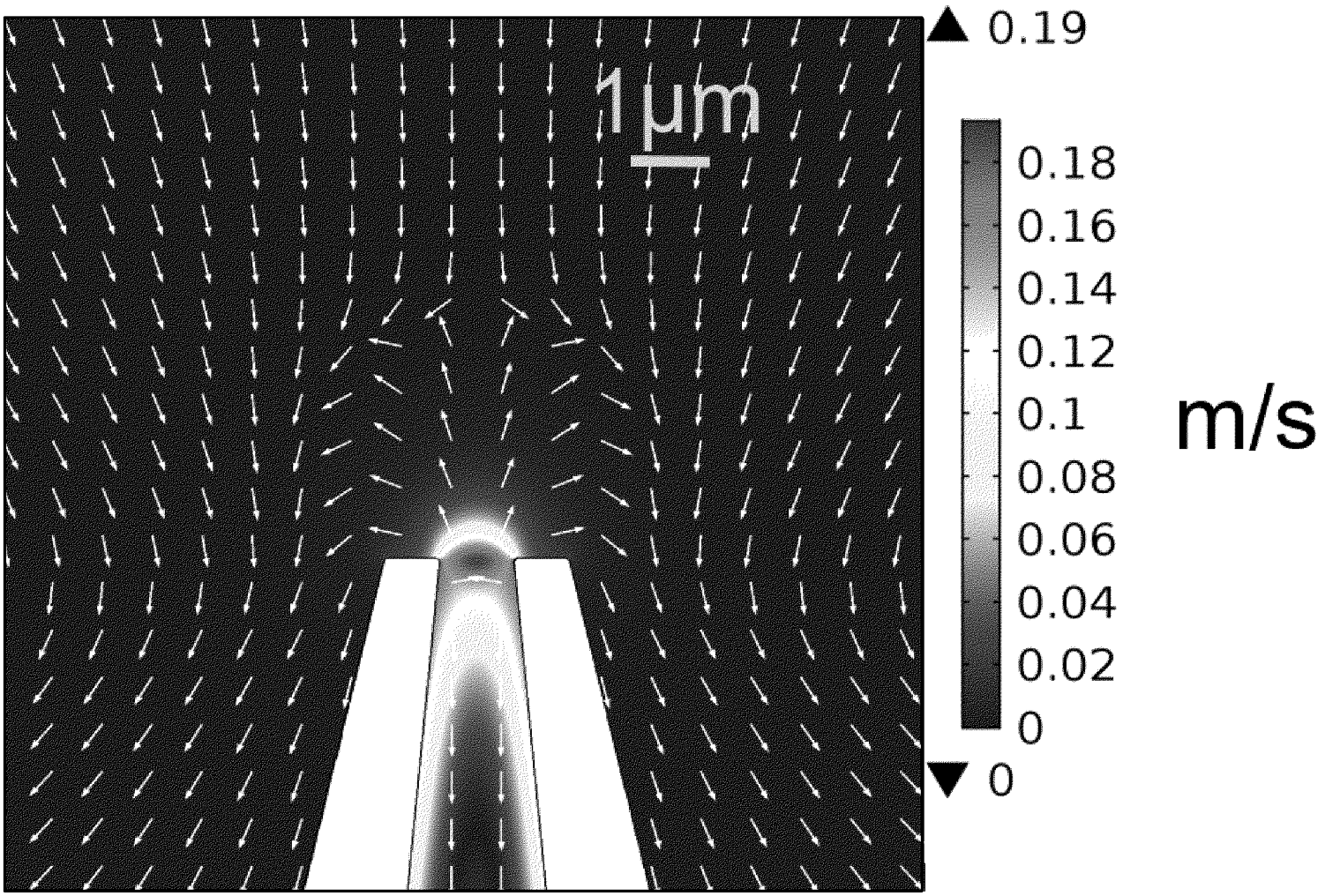
FIG. 8 is a graphical view of the simulated surface velocity and force distribution proximate to the tip for a positive electric field in the device of FIG. 5
Figure 9:
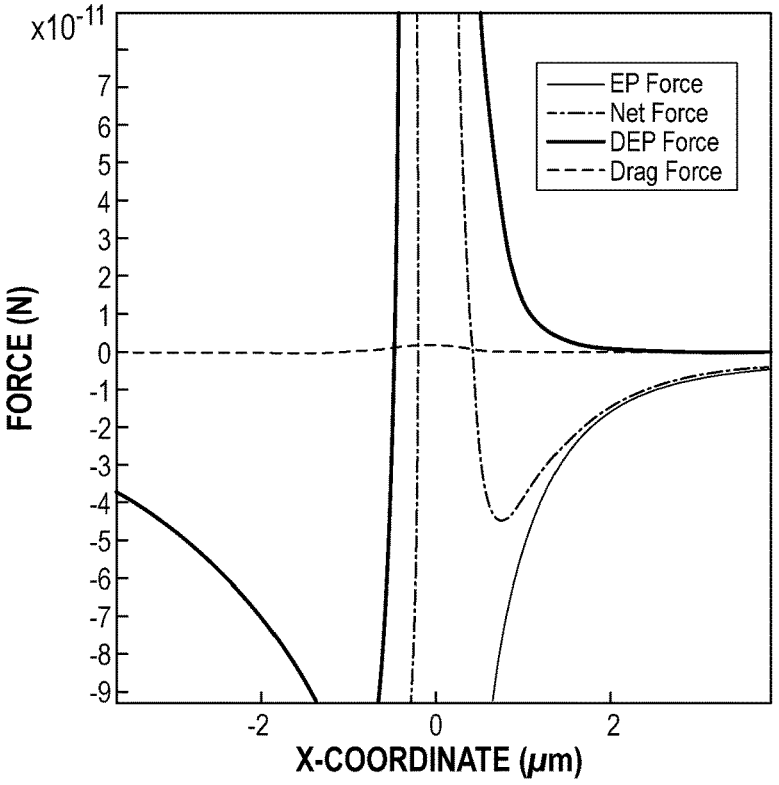
FIG. 9 is a graphical view of the simulated electrophoretic, dielectrophoretic, electro-osmotic, and net forces on a particle along a central axis of the tip for a positive electrode bias voltage in the device of FIG. 5.
Figure 10:
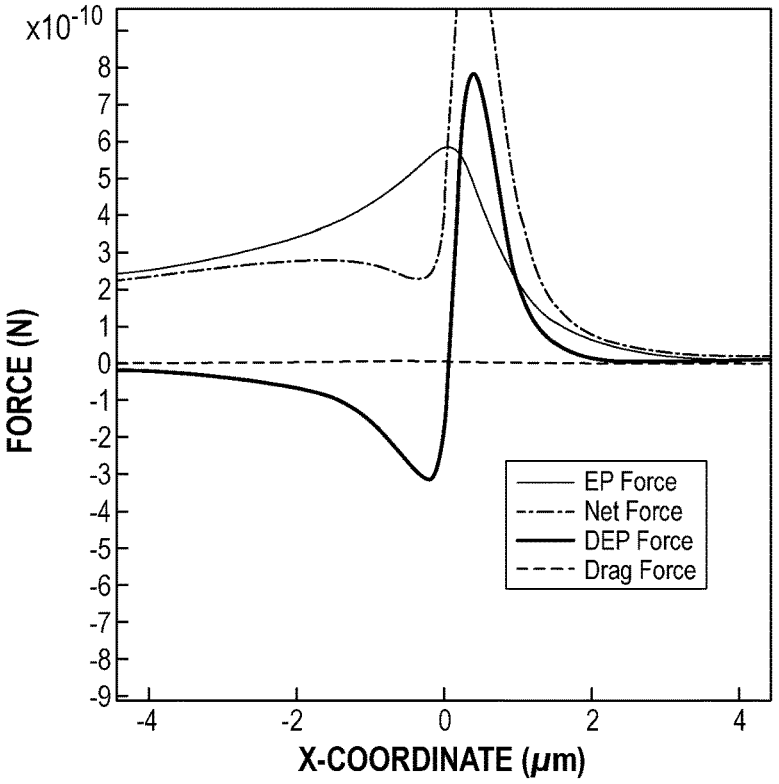
FIG. 10 is a graphical view of the simulated electrophoretic, dielectrophoretic, electro-osmotic, and net forces on a particle along a central axis of the tip for a negative electrode bias voltage in the device of FIG. 5.

FIG. 8 depicts the simulated composite surface velocity and force distribution when a positive voltage is applied to the bias electrode 28 relative to the reference electrode 30, i.e. a positive voltage polarity. FIGS. 9 and 10 each depict a graph of the force distribution along the x-axis of coordinate system 24 when a positive voltage (FIG. 9) and a negative voltage (FIG. 10) is applied to bias electrode 28 relative to reference electrode 30.

Figure 11:
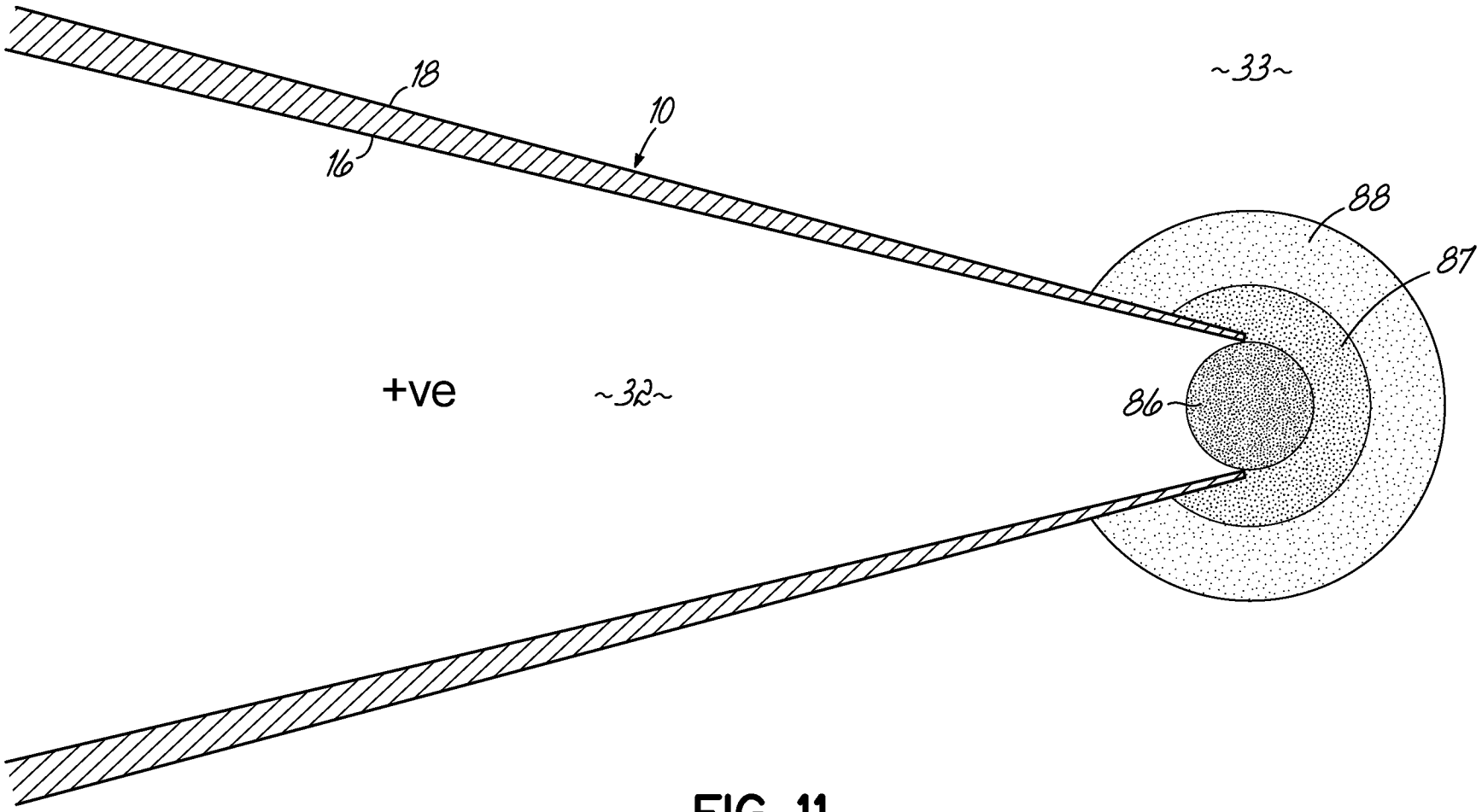
FIG. 11 is a diagrammatic view of the tip of a nanopipette depicting regions proximate to the tip in which different forces acting on the particles dominate.

FIG. 11 depicts a dielectrophoresis dominant region 86 in which the dielectrophoretic force 42 dominates movement of the particles 40, a neutral region 87 in which none of the electrokinetic forces dominate movement of the particles 40, and an electrophoretic dominant region 88 in which the electrophoretic force 44 dominates movement of the particles 40. The dielectrophoresis dominant region 86 may be closest to the opening 22 of the tip 10. In this region, the combined action of the outward acting dielectrophoretic and electro-osmotic forces may be greater than the opposing electrophoretic force. As a result, particles 40 may be pushed out of the dielectrophoresis dominant region 86. The electrophoretic, dielectrophoretic, and electro-osmotic forces may be balanced in the neutral region 87 between the dielectrophoresis dominant region 86 and an electrophoresis dominant region 88. Thus, the neutral region 87 may comprise a potential well that traps particles 40. Selective trapping of desired particles may be achieved by adjusting the voltage applied across the electrodes 28, 30, through selection of the diameter of the opening 22 of tip 10, and/or by selection of other characteristics that affect the forces acting on the particles.

In use, the tip 10 of nanopipette 54 may be placed in a sample containing the particles to be trapped, such as a bulk suspending medium in which the particles have been introduced. A voltage may be applied 10 across the nanopipette 54 using the electrodes 28, 30. The voltage may be selected so that a potential well that selectively traps the desired particles is generated proximate to the tip 10. The spatial resolution of the nanopipette 54 may allow the desired particles to be isolated from other components in the sample. To release the trapped particles, a voltage with the reverse polarity may applied across the electrodes 28, 30. The resulting change in the electrokinetic forces may release the trapped particles into a sample collection medium.

To provide empirical data, nanopipettes 54 of device 52 were backfilled with electrolyte solutions having different ionic strengths at pH 7.0, and 50 μl of an electrolyte solution containing approximately $5.48\times10^8$ fluorescent COOH-PS beads with 510 nm diameters were added to the suspending medium in the collection chamber 58 to serve as the particles 40. A DC voltage was then applied across the nanopipette 54 by providing a voltage to the bias electrode 28 relative to the reference electrode 30. The current measurements and the trajectory of the particles 40 were electrically and microscopically recorded for 100 seconds. The conductivities of different electrolyte solutions and beads were measured and calculated. The fluidic velocity profiles due to the underlying trapping forces were simulated using the methods described above.

Figure 12:
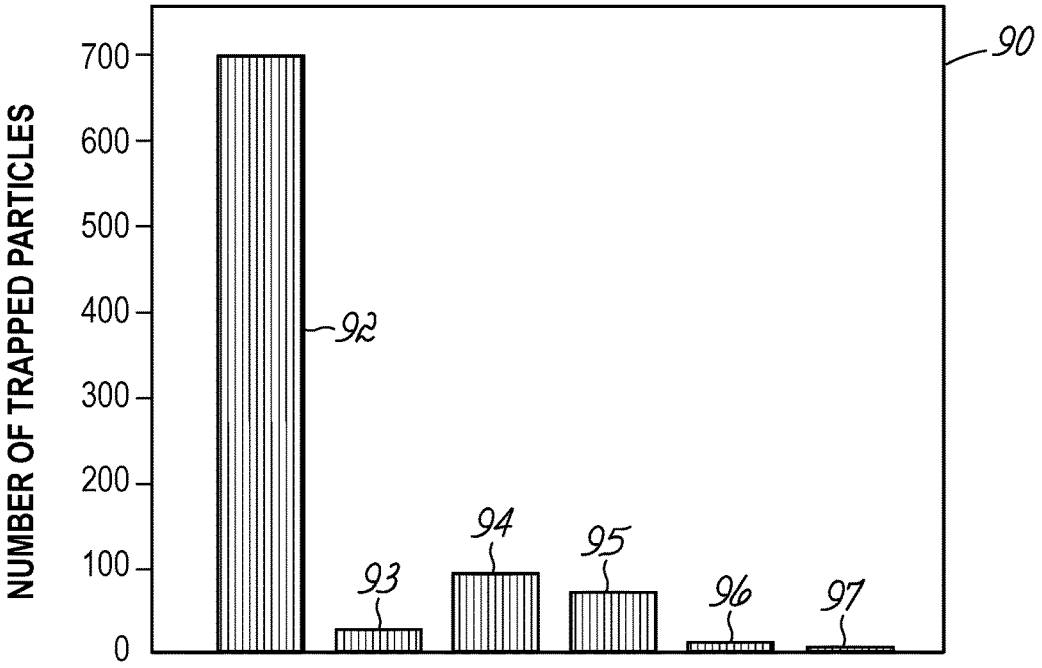
FIG. 12 is a graphical view of the number of particles trapped proximate to the tip for various suspending mediums in the device of FIG. 5.
Figure 13:
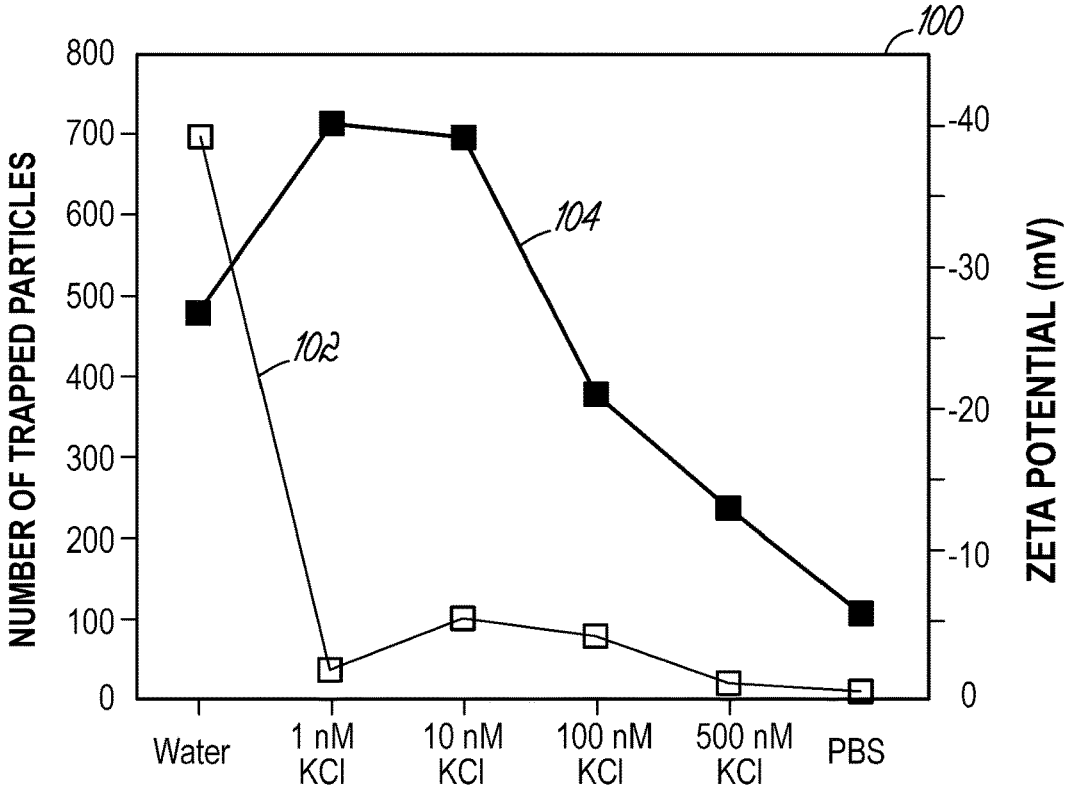
FIG. 13 is a graphical view of the number of particles trapped proximate to the tip for the various suspending mediums of FIG. 12 and their zeta potentials.

FIG. 12 depicts a graph 90 including bars 92-97 showing the number of particles 40 trapped in various solutions. FIG. 13 depicts a graph 100 including scatter plots 102, 104 showing the number of particles 40 trapped in various solutions (plot 102) and the corresponding zeta potentials (plot 104). The solutions tested include deionized water (bar 92), a 1 mM potassium chloride solution (bar 93), a 10 mM potassium chloride solution (bar 94), a 100 mM potassium chloride solution (bar 95), a 500 mM potassium chloride solution (bar 96), and a 1× phosphate-buffered saline solution (bar 97).

The maximum trapping occurred using deionized water. This is believed to be due to the electro-osmotic flow, dielectrophoresis, and electrophoresis all being directed towards the opening 22 of tip 10 when deionized water was used. Although beads in 1 mM and 10 mM potassium chloride solutions had similar zeta potentials, more trapping was observed in the 10 mM solution owing to a reduced electro-osmotic flow in solutions having a higher ionic concentration. As shown by plots 102 and 104 of graph 100, in the case of solutions with a salt concentration greater than 10 mM, the number of trapped particles was positively correlated with the zeta potential due to the weak electro-osmotic flow force and the dominant electrophoretic force.

Figure 14:
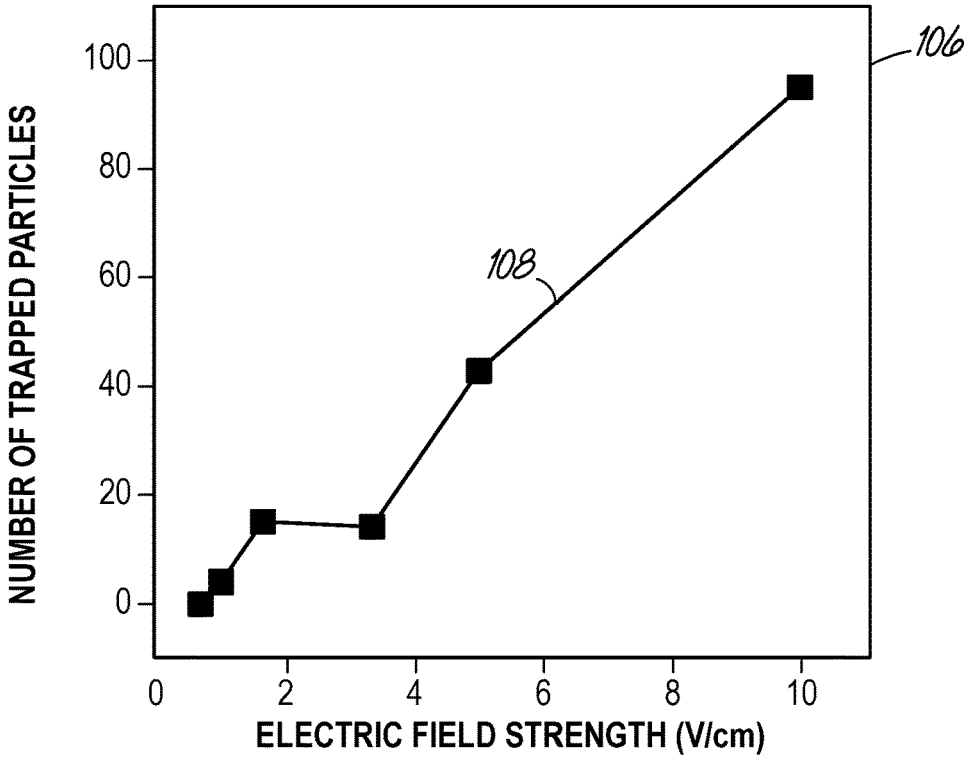
FIG. 14 is a graphical view of the number of particles trapped proximate to the tip for various electrical field strengths in the device of FIG. 5.
Figure 15:
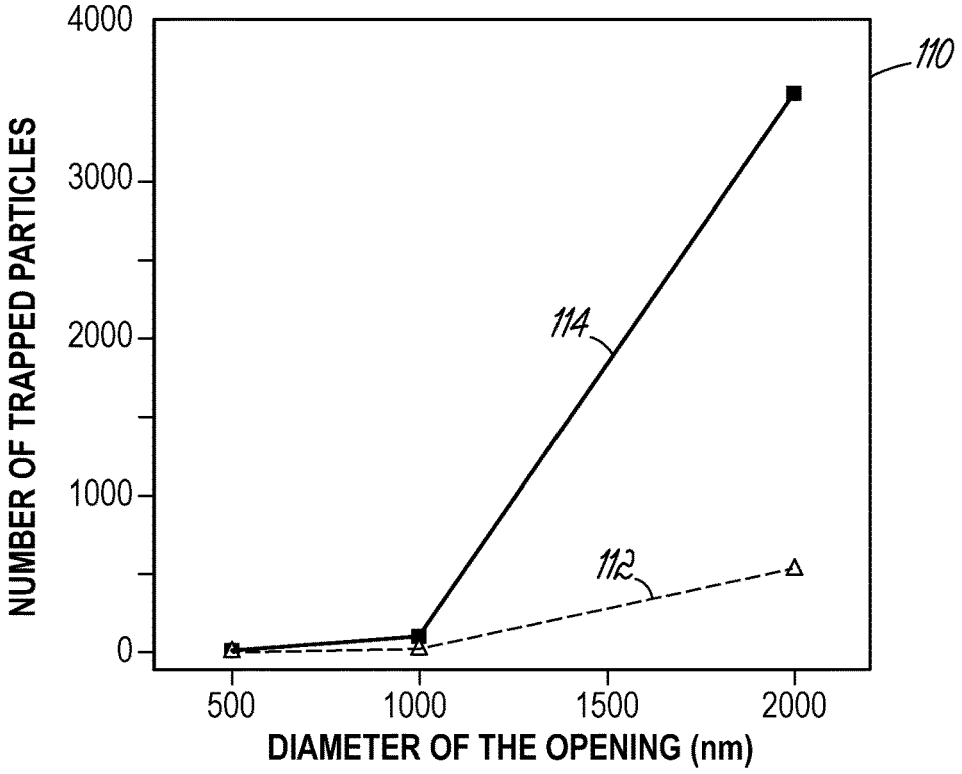
FIG. 15 is a graphical view of the number of particles trapped proximate to the tip for various sizes of opening in the device of FIG. 5.

FIG. 14 depicts a graph 106 including a plot 108 of the number of trapped particles with respect to the electric field strength. FIG. 15 depicts a graph 110 including a plot 112 of the number of particles trapped with respect to the diameter of the opening 22 using a 1 mM potassium chloride solution, and a plot 114 of the number of particles trapped with respect to the diameter of the opening 22 using a 10 mM potassium chloride solution. As can be seen from plots 108, 112, 114, increases in the field strength and the size of the opening each result an increase in the number of trapped particles. This effect is believed to be due to an increase in electrophoresis and a reduction in electro-osmotic flow.

Figure 16:
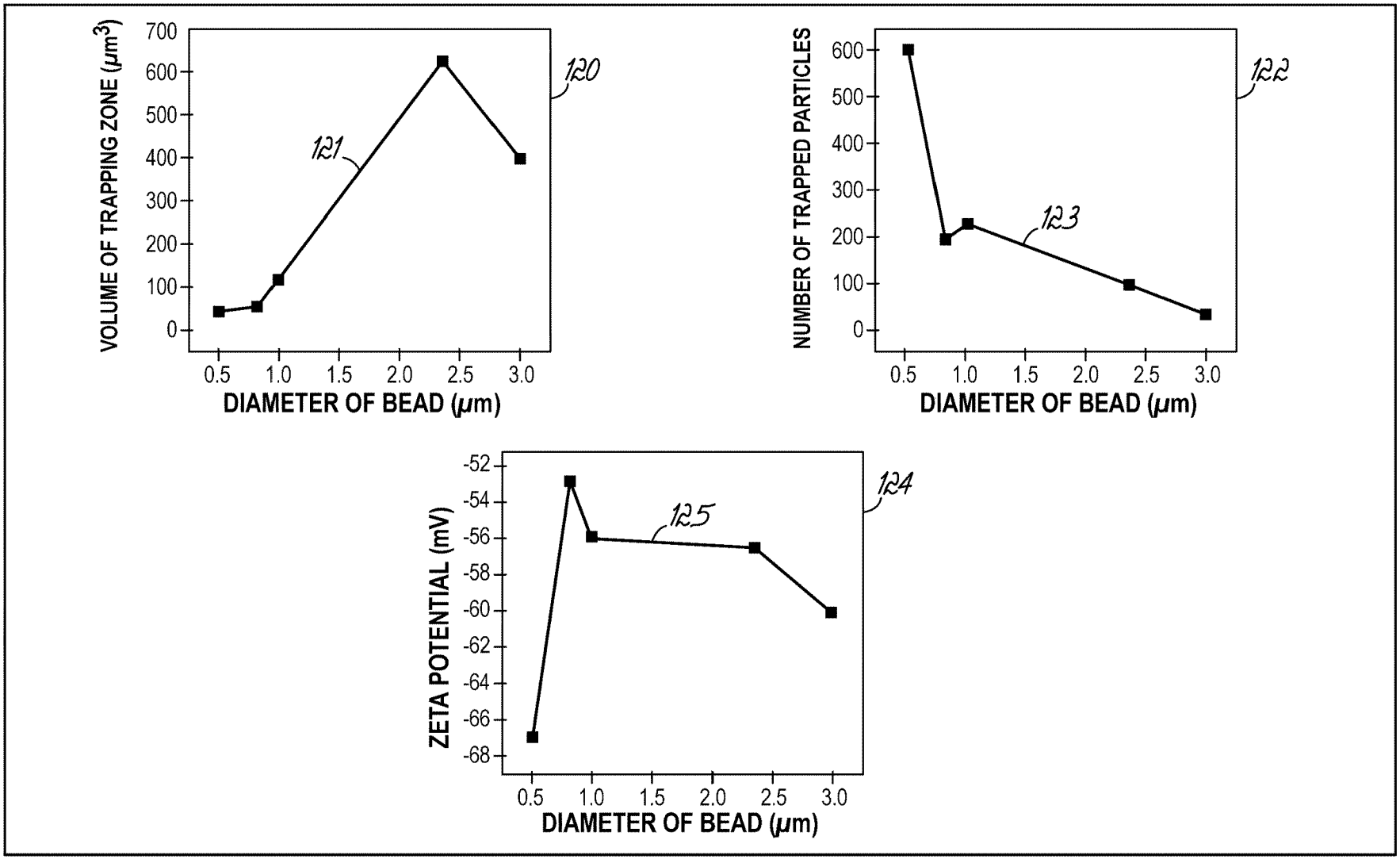
FIG. 16 is a graphical view of the volume of the trapping region, the number of particles trapped, and the zeta potential for various sizes of particles.

FIG. 16 depicts a graph 120 including a plot 121 of the volume of the trapping region with respect to the diameter of the beads used for the particles 40, graph 122 including a plot 123 of the number of particles trapped with respect to the size of the beads used for the particles 40, and a graph 124 including a plot 125 of the zeta potential with respect to the diameter of the beads used for the particles 40.

Figure 17:
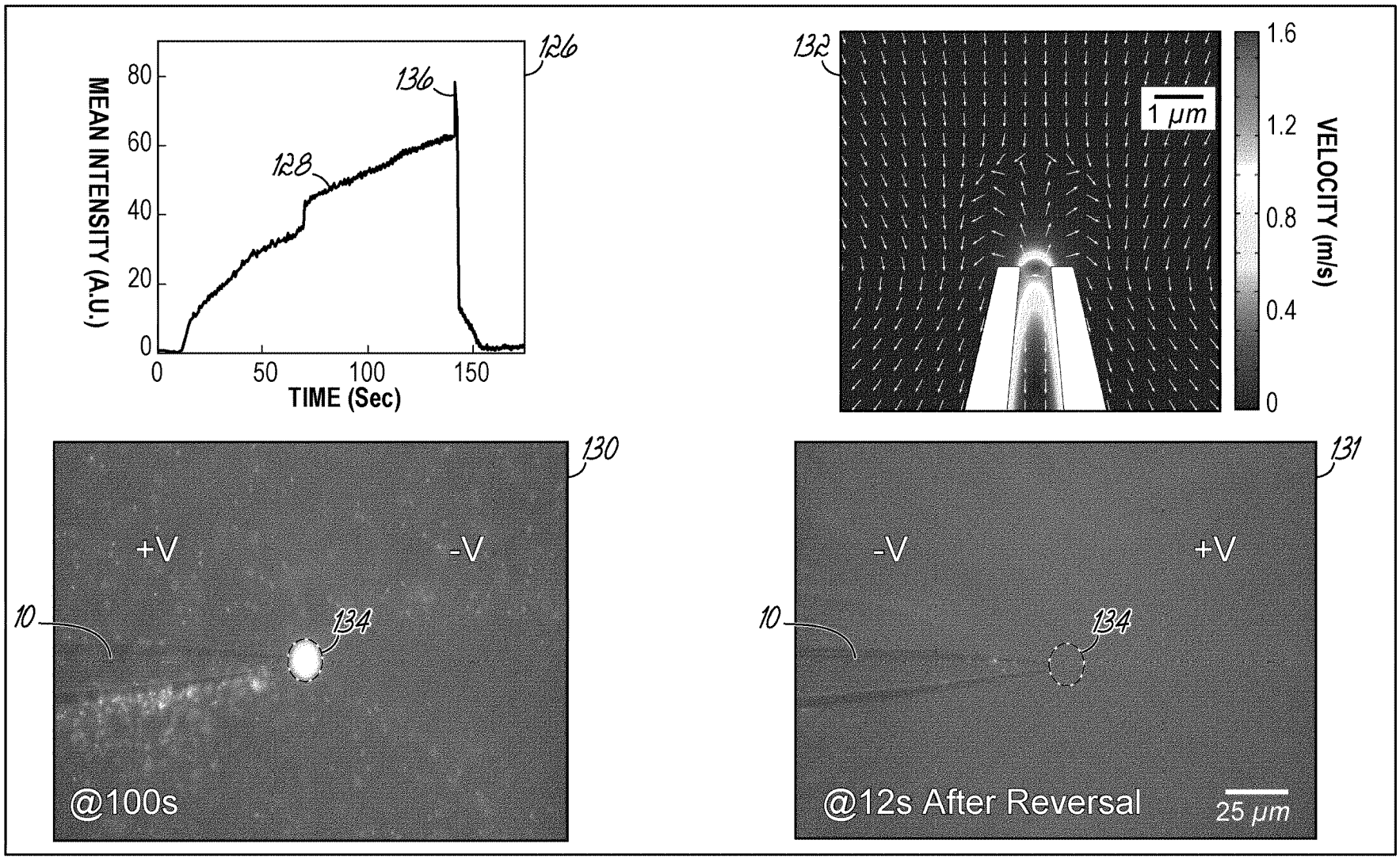
FIG. 17 is a graphical view depicting the results of an experiment to determine a number beads suspended in deionized water that were trapped proximate to the tip using an electric field having a positive polarity in the device of FIG. 5.

FIG. 17 depicts a graph 126 including a plot 128 and images 130-132 documenting the results of an experiment involving beads having a diameter of 500 nm. The beads were first trapped in deionized water by applying a positive biasing voltage across the electrodes 28, 30 and then released by reversing the polarity of the voltage. Image 130 is a microscopic photograph of the tip 10 showing a region 134 proximate to the opening 22 approximately 100 seconds after application of the positive bias voltage. Image 132 is a microscopic photograph of the tip 10 approximately 12 seconds after reversal of the bias voltage showing that the region 134 is no longer fluorescent. Image 132 depicts a heat map showing the simulated velocity of the particles 40 proximate to the tip 10 after the bias voltage is reversed.

As can be seen by the increase in the fluorescent intensity of region 134 depicted by plot 128, trapping of particles in the potential well proximate to the tip 10 begins immediately after application of a positive bias voltage. At approximately 135 seconds, the polarity of the bias voltage is reversed, after which the plot 128 shows a drop in the intensity indicative of a rapid release of the particles. Reversing the bias voltage causes an initial spike 136 in fluorescent intensity as the particles 40 initially expand into a larger region of the video frame, followed by a sharp drop in the fluorescent intensity as the particles 40 disperse. The rapid release of particles in response to reversing the voltage applied to the electrodes 28, 30 is believed to be caused by the reversal of directions of the electrophoretic and electro-osmotic forces, which is reflected in the particle velocities shown in image 132.

Figure 18:
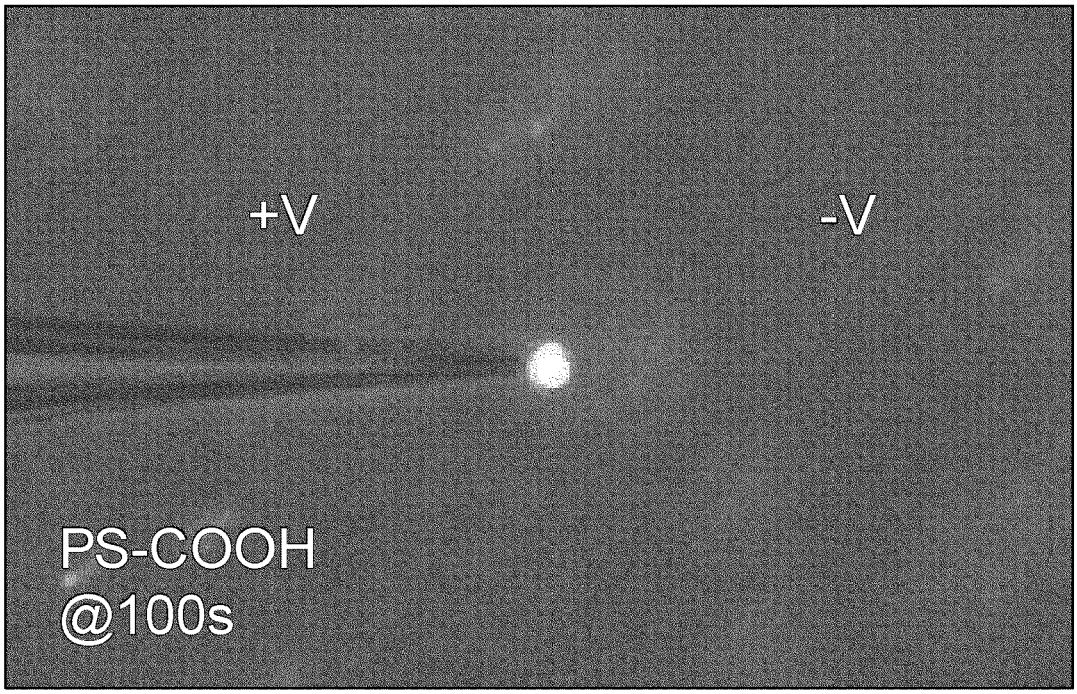
FIG. 18 is a photographic view of the beads of FIG. 17 collecting proximate to the tip of the nanopipette in the device of FIG. 5.
Figure 19:
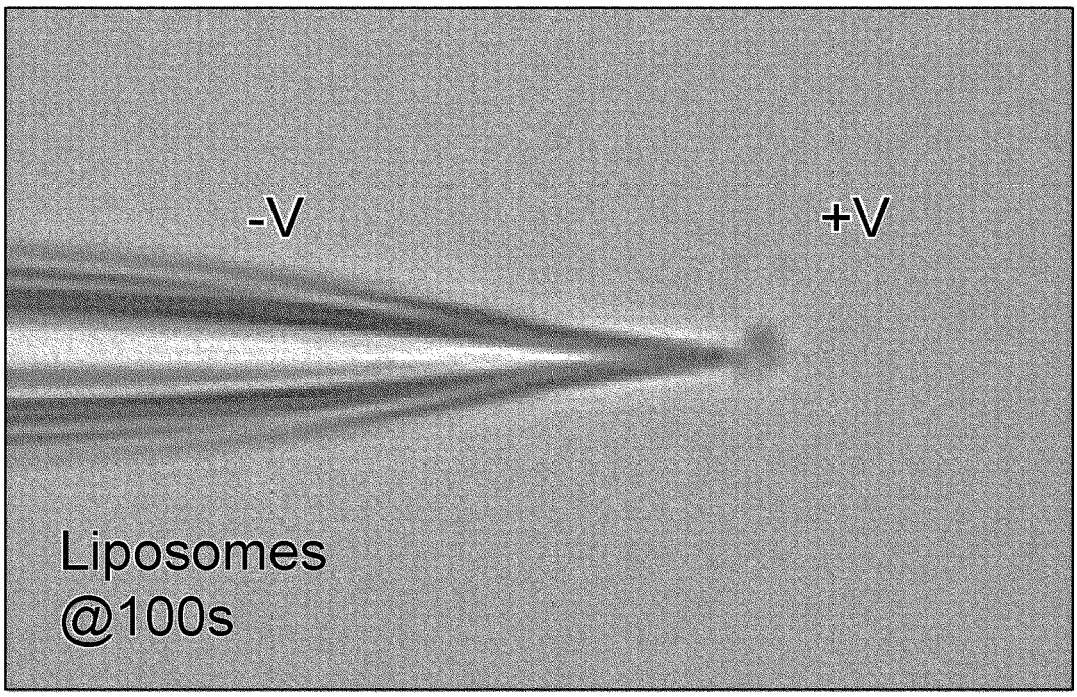
FIG. 19 is a photographic view of liposomes collecting proximate to the tip under the influence of an electric field having a negative polarity in the device of FIG. 5.

In another experiment, two nanopipettes 54 each having an opening 22 with a diameter of 500 nm were used to demonstrate trapping of COOH-PS beads and liposomes, individually, with different voltage polarities and the corresponding changes in conductance across the opening 22 as the beads accumulated in the trapping region. FIG. 18 depicts an image showing a fluorescent region indicative of COOH-PS beads being trapped proximate to the tip of one of the nanopipettes 100 seconds after applying an electrical signal 38 having a positive voltage. FIG. 19 depicts an image showing liposomes trapped proximate to the tip of the other nanopipette 100 seconds after application of an electrical signal 38 having a negative voltage. FIGS. 18 and 19 demonstrate the ability of embodiments of the invention to selectively trap particles by changing the voltage applied to the bias and reference electrodes 28, 30.

Figure 20:
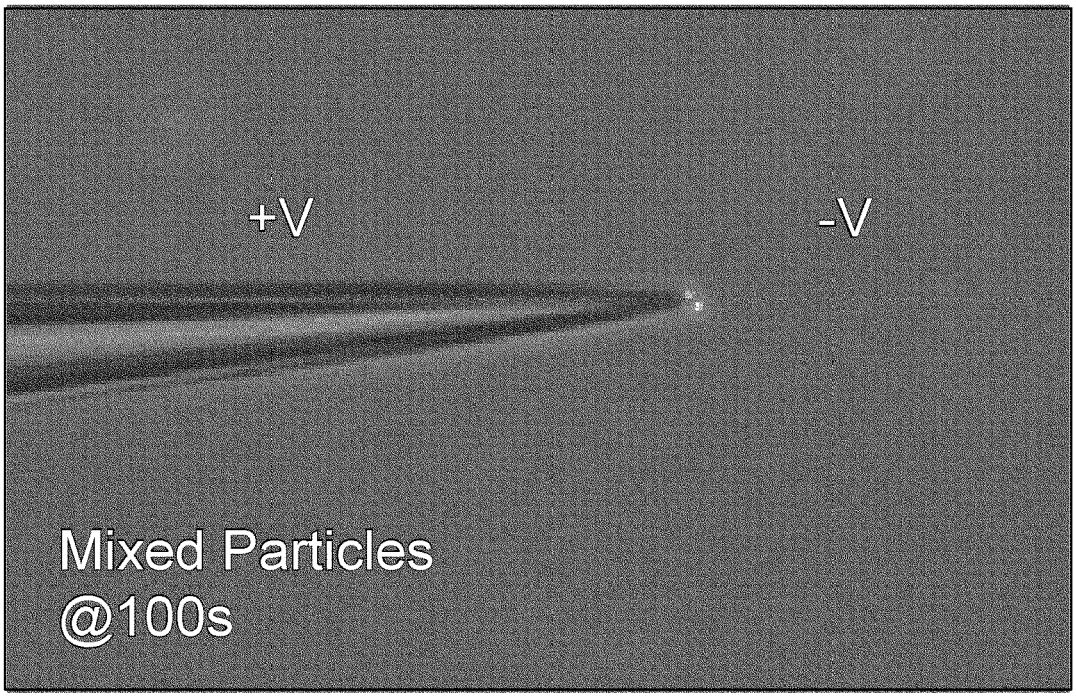
FIG. 20 is a photographic view depicting selective trapping of beads proximate to the tip under the influence of an electric field having a positive polarity in the device of FIG. 5.
Figure 21:
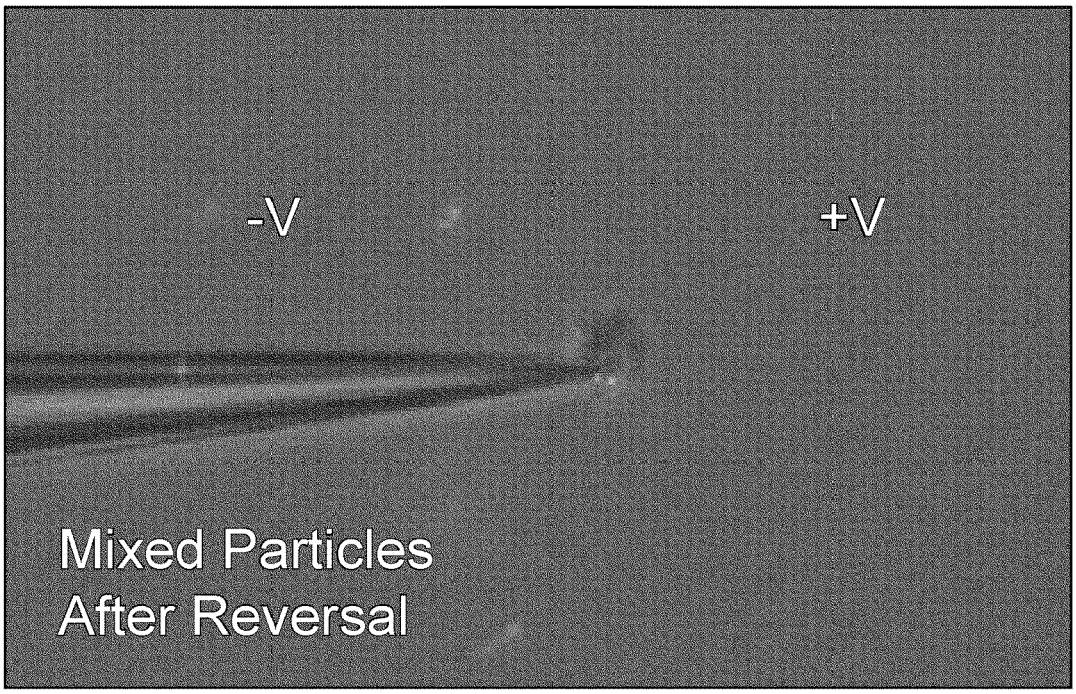
FIG. 21 is a photographic view depicting selective trapping of liposomes proximate to the tip under the influence of an electric field having a negative polarity in the device of FIG. 5.
Figure 22:
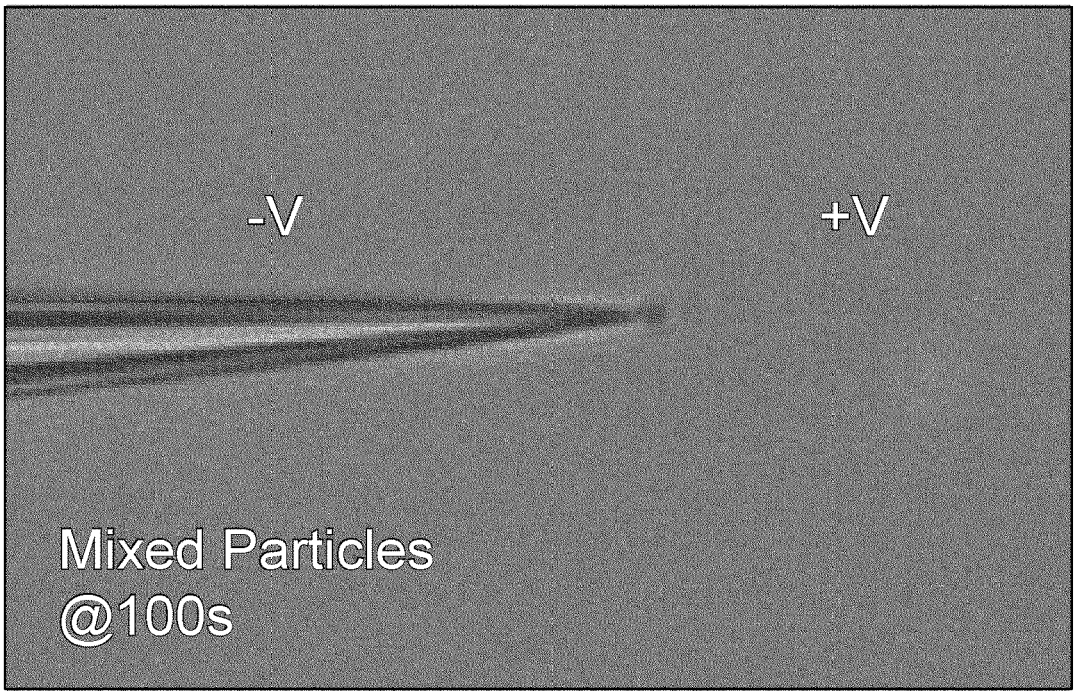
FIG. 22 is a photographic view of the tip of FIG. 20 after reversing the polarity of the bias voltage applied to the electrodes.
Figure 23:
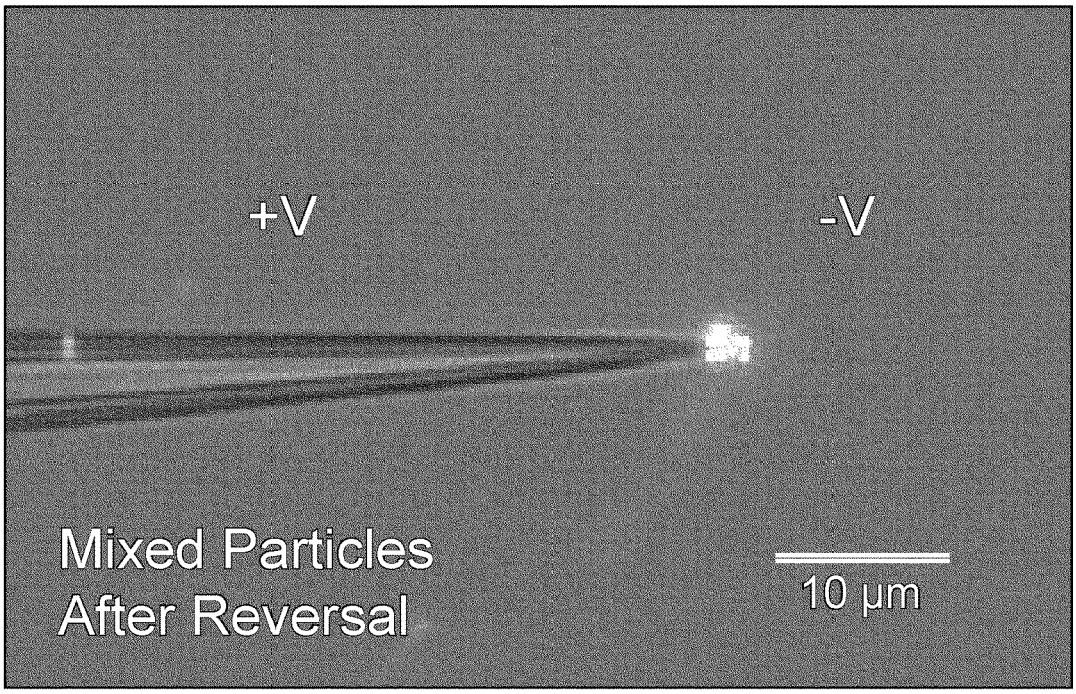
FIG. 23 is a photographic view of the tip of FIG. 21 after reversing the polarity of the bias voltage applied to the electrodes.

In another experiment, a nanopipette 54 having an opening 22 with a diameter of 500 nm was used to demonstrate selective trapping of COOH-PS beads and liposomes with different voltage polarities and the corresponding changes in conductance across the opening 22 in mixed particle scenarios. To this end, the tip 10 of nanopipette 54 was placed in a mixture of the polystyrene beads and liposomes. FIG. 20 shows selective trapping of COOH-PS beads in the mixed particle medium 100 seconds after applying an electrical signal 38 having a positive voltage. FIG. 21 shows selective trapping of the liposomes in the mixed particle medium 100 seconds after applying an electrical signal 38 having a negative voltage. FIG. 22 shows the tip depicted in FIG. 20 after reversing the polarity of the electrical signal 38 so that the electrical signal 38 has a negative voltage. FIG. 23 shows the tip depicted in FIG. 21 after reversing the polarity of the electrical signal 38 so that the electrical signal 38 has a positive voltage.

Figure 24:
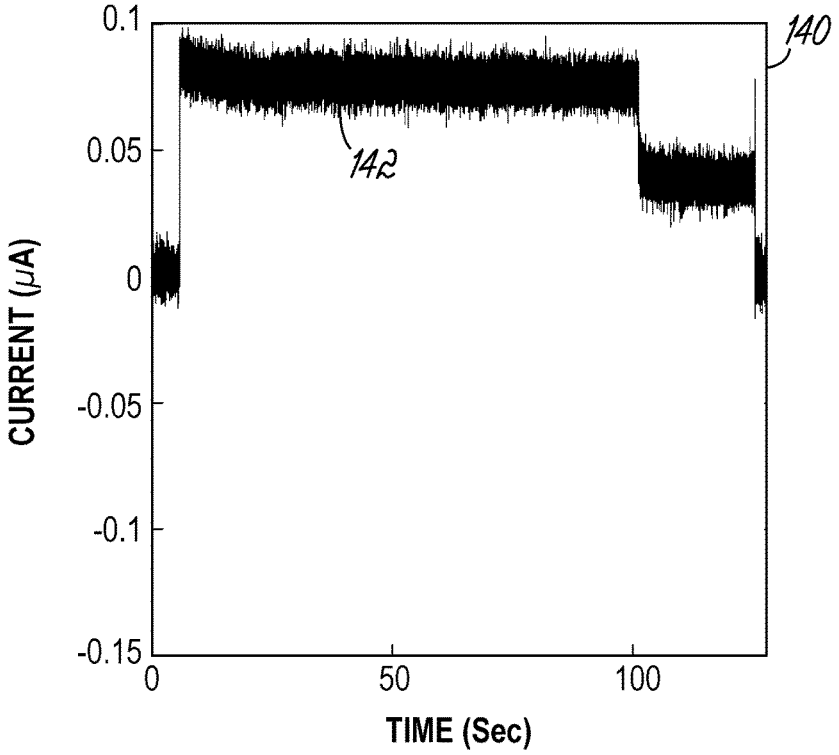
FIGS. 24-27 are graphical views of the current passing through the opening of the nanopipette with respect to time for the experimental results of FIGS. 18-23.
Figure 25:
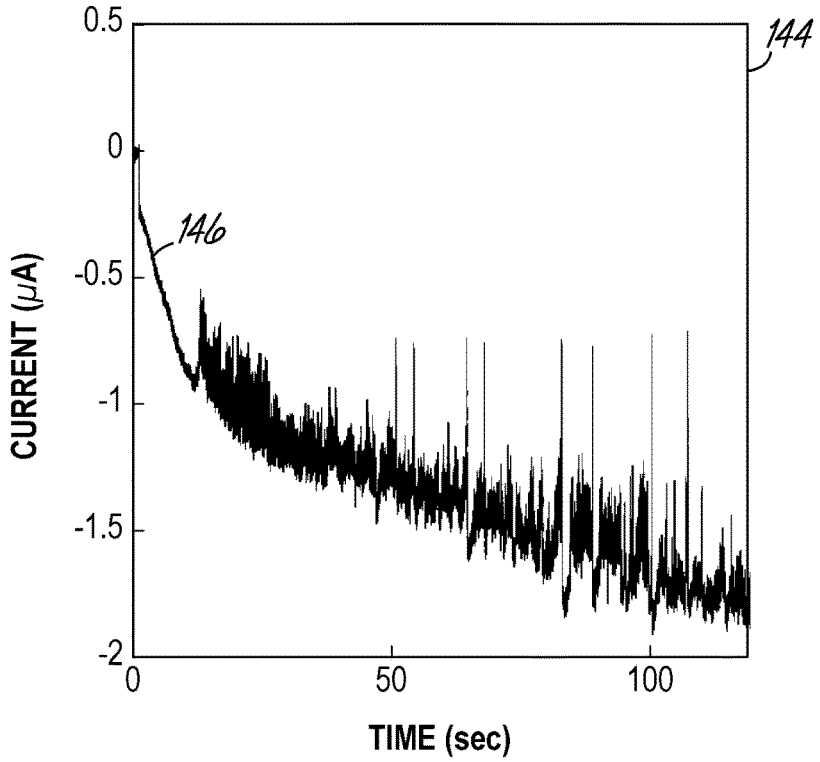
Figure 26:
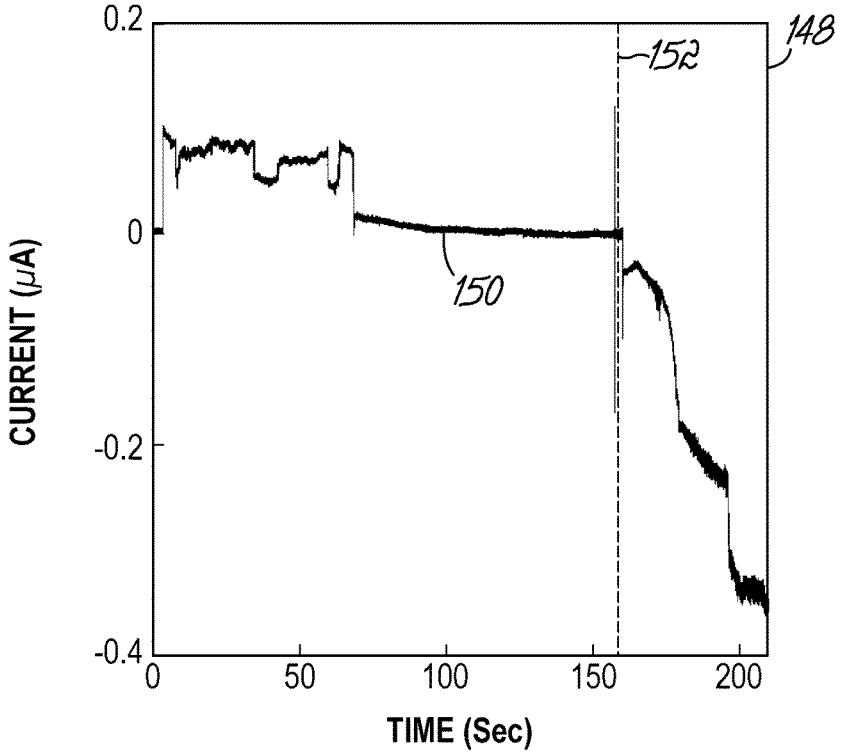
Figure 27:
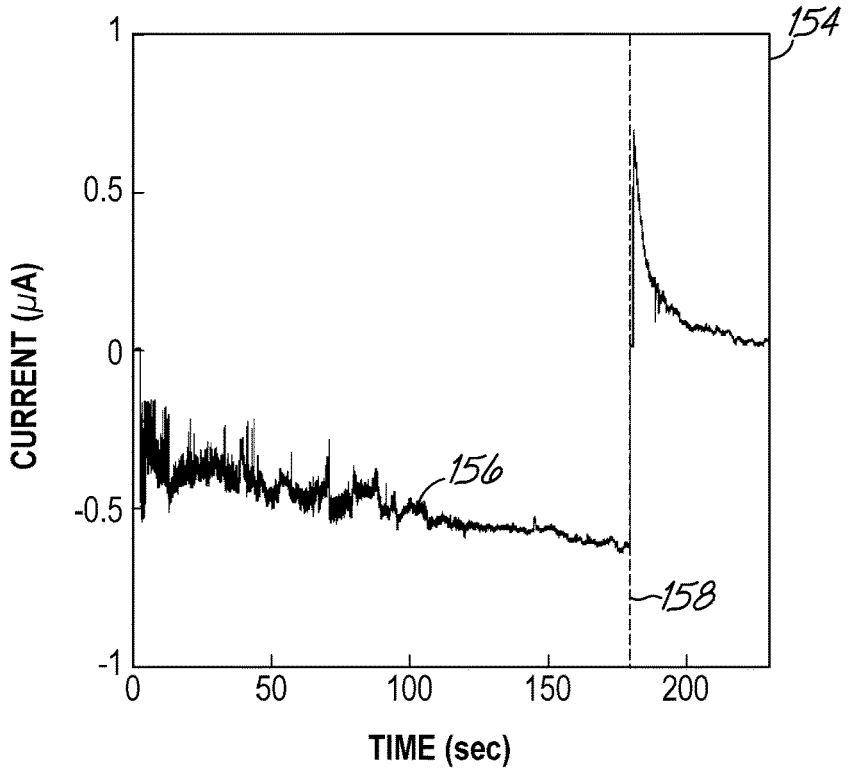

FIG. 24 depicts a graph 140 including a plot 142 of current with respect to time for the collection of the COOH-PS as described with respect to FIG. 18 above. FIG. 25 depicts a graph 144 including a plot 146 of current with respect to time for the collection of liposomes as described with respect to FIG. 19 above. FIG. 26 depicts a graph 148 including a plot 150 of current with respect to time for the collection of COOH-PS beads in the mixed particle medium followed by the voltage reversal described with respect to FIGS. 20 and 22. Dashed line 152 provides an indication of the time at which the polarity of the electrical signal 38 was reversed. FIG. 27 depicts a graph 154 including a plot 156 of current with respect to time for the collection of liposomes in the mixed particle medium followed by the voltage reversal described with respect to FIGS. 21 and 23. Dashed line 158 provides an indication of the time at which the polarity of the electrical signal 38 was reversed.

To realize the physical principles of the system, a finite element simulation was carried out to study the electrokinetic forces induced on COOH-PS beads. The simulation model included beads with a diameter of 510 nm, a nanopipette with an opening 22 having a diameter of 1000 nm, and a monovalent suspending medium with a 10 mM ionic concentration. FIGS. 28-33 depict graphs 160*a*-160*f* each including plots of the simulated electrokinetic forces acting on the particles proximate to the tip of the nanopipette. These include the electrophoretic force (plots 162*a*-162*f*), the electro-osmotic force (plots 163*a*-163*f*), the dielectrophoretic force (plots 164*a*-164*f*), and the net force (165*a*-165*f*) acting on the particles. All values are for the force projected onto the x-axis of coordinate system 24, (i.e., the central axis of the nanopipette 54), and are shown for different electric field strengths and polarities.

Figure 28:
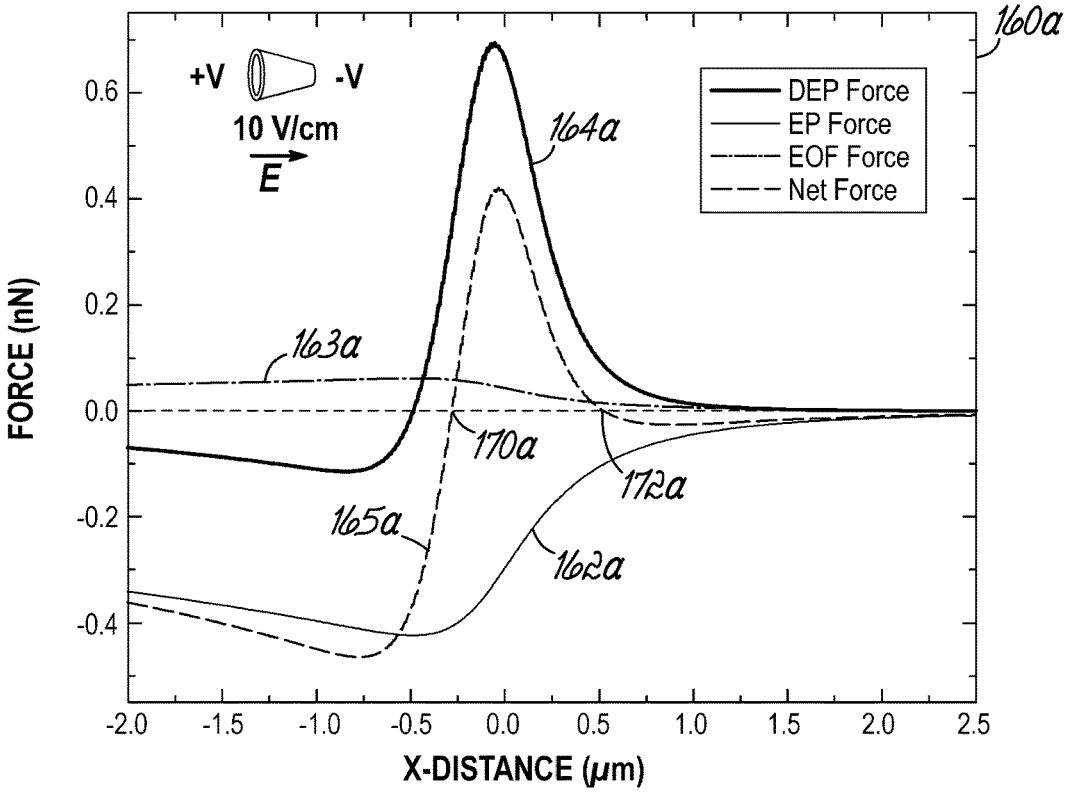
FIGS. 28-33 are graphical views of simulated electrokinetic forces acting on particles proximate to the tip of the nanopipette of the device in FIG. 5.
Figure 29:
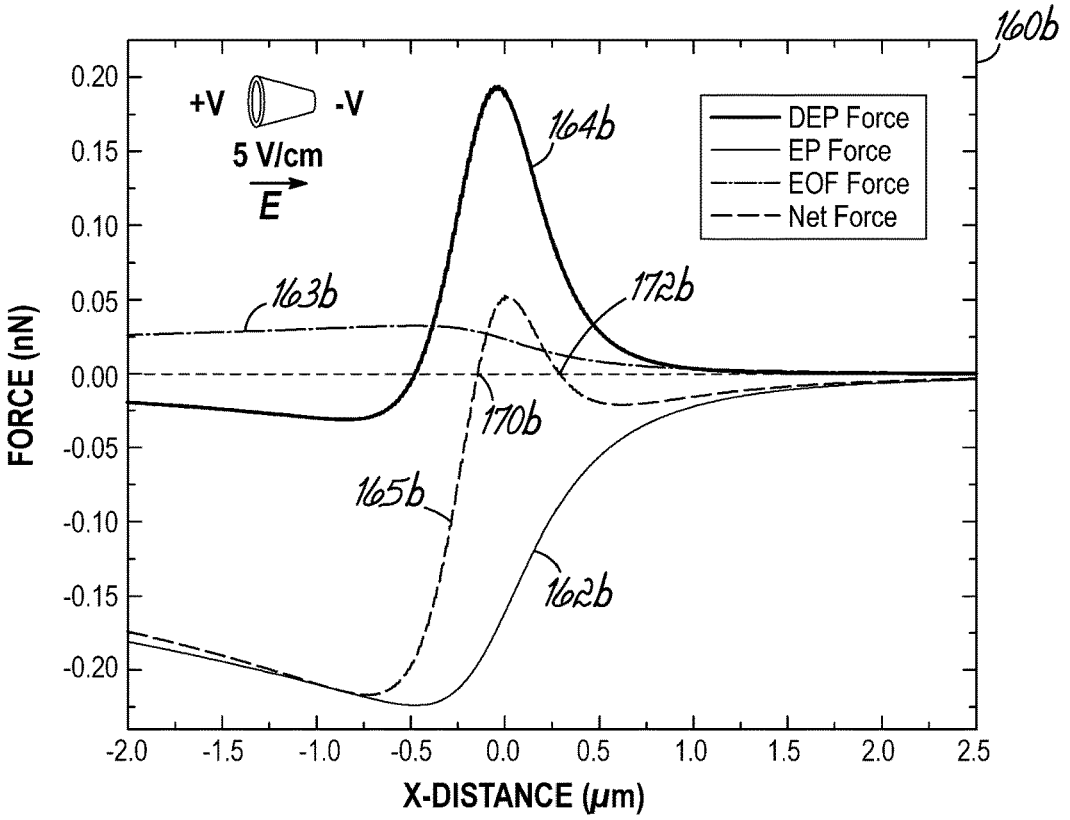
Figure 30:
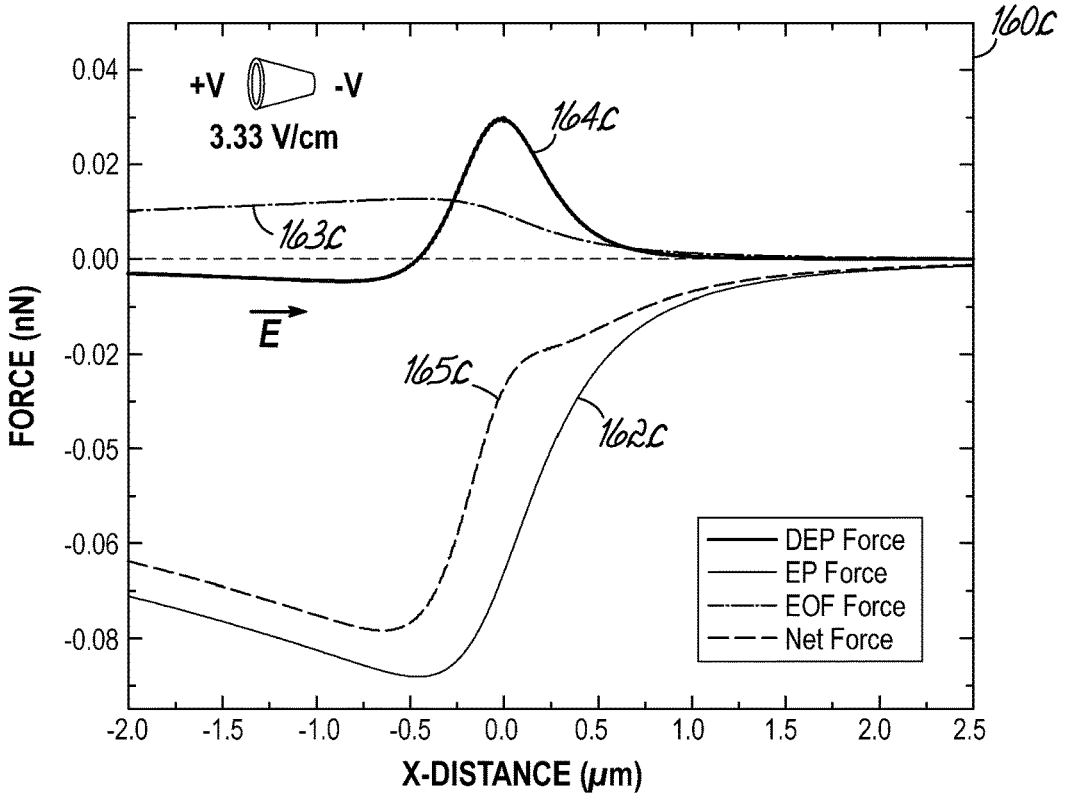
Figure 31:
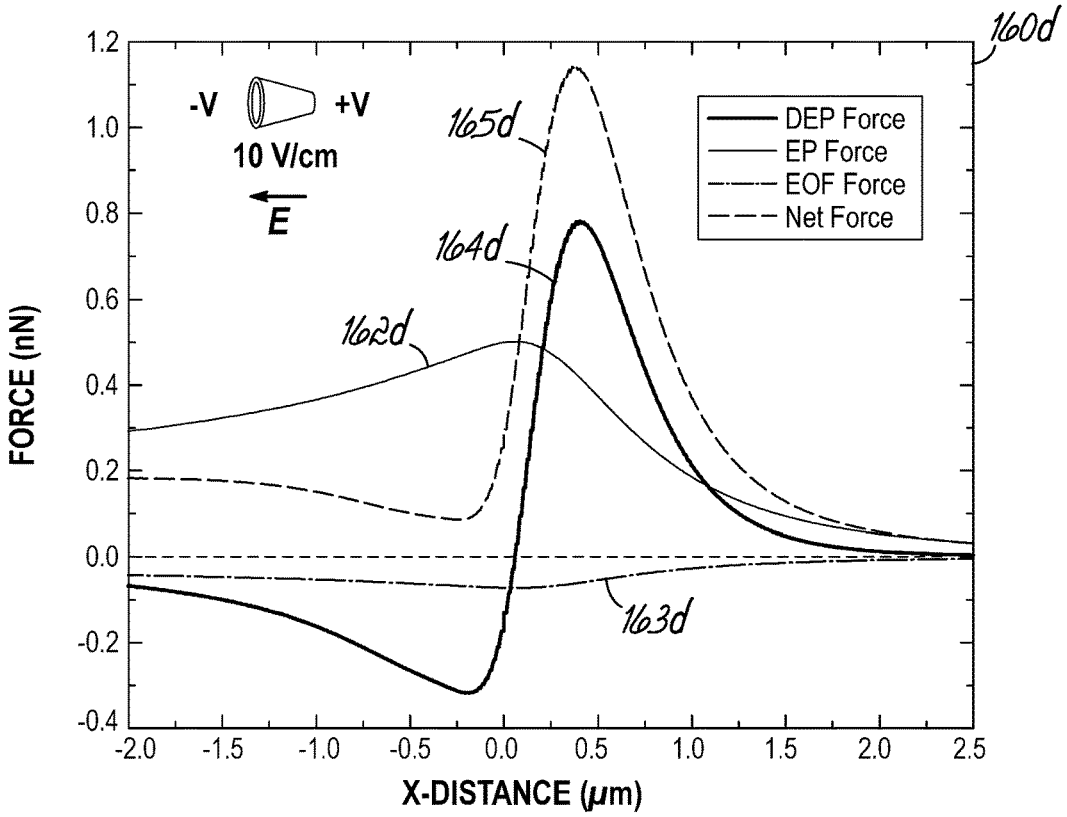
Figure 32:
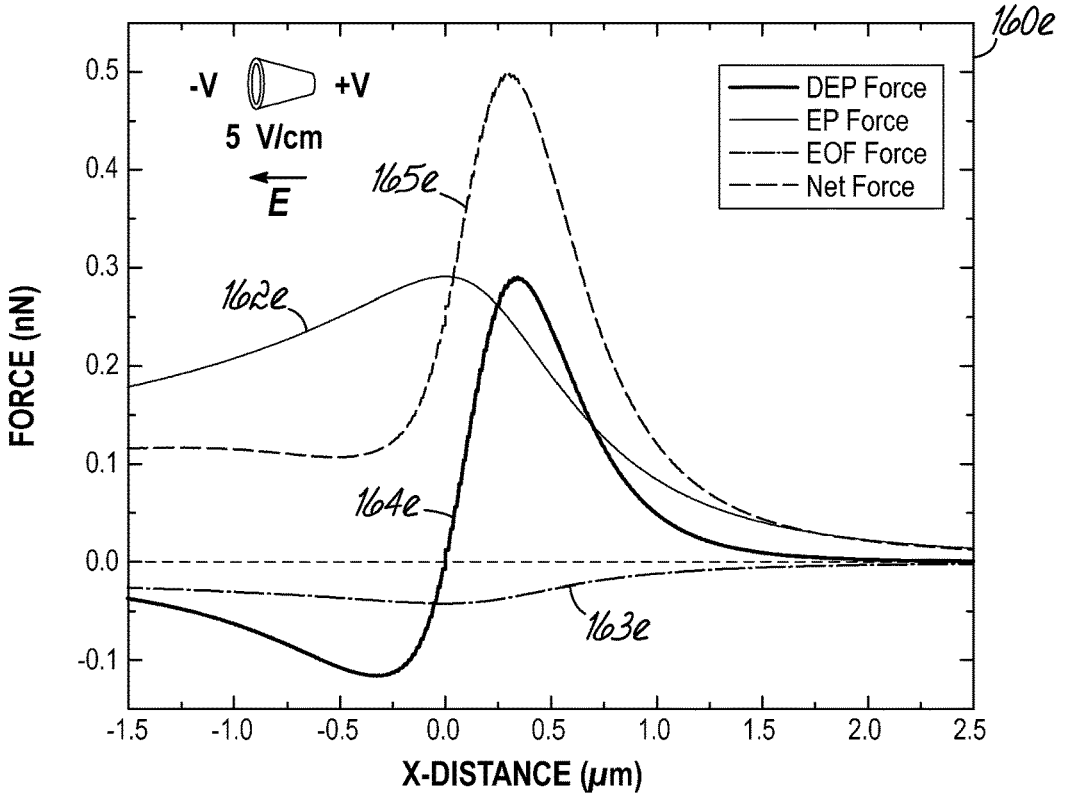
Figure 33:
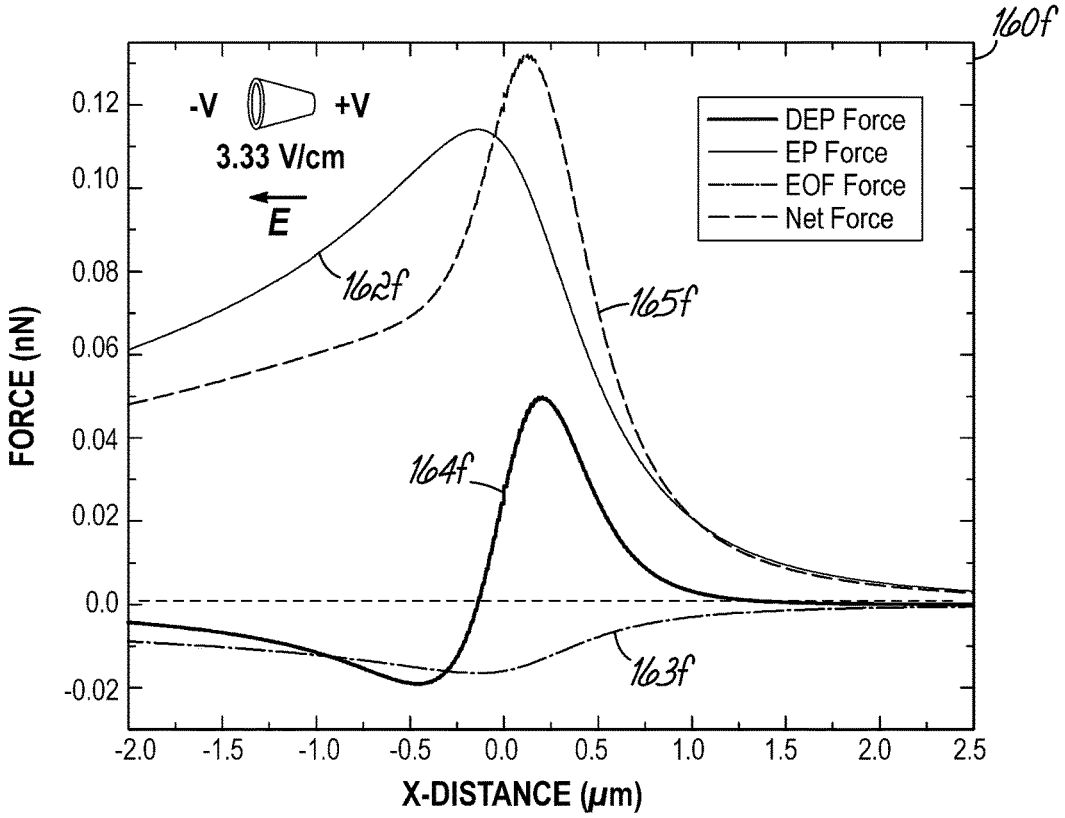

FIGS. 28-30 show the effects of applying a positive voltage to the bias electrode 28 relative to the reference electrode 30, which causes an electric field E that is generally directed in a positive direction along the x-axis of coordinate system 24, i.e., away from the tip 10 of nanopipette 54. FIGS. 31-33 show the effects of applying a negative voltage to the bias electrode 28 relative to the reference electrode 30, which causes an electric field E that is generally directed in a negative direction along the x-axis of coordinate system 24, i.e., toward the tip of the nanopipette. In accordance with the coordinate system 24 of FIG. 1, areas of the graphs 160*a*-160*f* to the left of the origin represent the interior region inside of the nanopipette, and areas of the graphs 160*a*-160*f* to the right of the origin represent the exterior region outside the nanopipette where the particles are suspended in the bulk suspending medium.

Simulations were run for electric fields having a strength of 10 V/cm (FIGS. 28 and 31), 5 V/cm (FIGS. 29 and 32), and 3.33 V/cm (FIGS. 30 and 33). The electrophoretic force plots 162*a*-162*c* for the positive bias voltages show a negative peak in the force-axis, which indicates the force urges particles suspended in the bulk suspending medium in the negative direction along the x-axis of coordinate system 24, i.e., towards the tip 10 of the nanopipette 54. In contrast, the electro-osmotic force plots 163*a*-163*c* and dielectrophoretic force plots 164*a*-164*c* for positive bias voltages have peaks in the positive force-axis. This indicates that these forces urge the particles in the positive direction along the x-axis of coordinate system 24, i.e., away from the tip 10 of the nanopipette 54.

As can be seen on graphs 160*a* and 160*b*, net force plots 165*a* and 165*b* each cross the zero-force line at two locations for positive polarity field strengths of 10 V/cm and 5 V/cm. One location 170*a*,170*b* is located to the left of the x=0 coordinate, and is thus inside the nanopipette. The other location 172*a*, 172*b* is located to the right of the x=0 coordinate, and thus outside the nanopipette 54. These zero net force locations 170*a*, 170*b*, 172*a*, 172*b* indicate locations where the forces acting on the particles are balanced. Thus, under these conditions, potential wells are expected form inside the nanopipette proximate to locations 170*a* and 170*b* and outside of the nanopipette proximate to locations 172*a* and 172*b*.

As can be seen on graph 160*c*, when the applied voltage decreases to a level that only produces a 3.33 V/cm electric field E, the net force plot 165*c* no longer crosses the zero-force line. This indicates that the electro-osmotic force 163*c* and dielectrophoretic force 164*c* for this electric field are insufficient to balance the electrophoretic force 162*c*. Thus, under the conditions of graph 160*c*, particles can be expected to translocate into the nanopipette.

Graphs 160*d*-160*f* show the simulated forces acting on the particles when the polarity of the voltage is reversed from that shown by graphs 160*a*-160*c*. Because the gradient of the E-field is not dependent on its direction, the dielectrophoretic force, as indicated by plots 164*d*-164*f*, continues to operate in the same direction as with the positive bias voltage. This is shown by the dielectrophoretic force plots 164*d*-164*f* for negative bias voltages, which continue to have positive peaks in the force-axis. Thus, this force continues to urge particles in the positive direction along the x-axis of coordinate system 24, i.e., away from the tip 10 of the nanopipette 54.

In contrast, changing the polarity of the bias voltage reverses the electrophoretic and electro-osmotic forces. This is reflected in the plots of electrophoretic force 162*d*-162*f* for negative bias voltages, which show a positive peak in the force-axis. This indicates the force urges the particles in the positive direction along the x-axis of coordinate system 24, i.e., away the tip 10 of the nanopipette 54. The plots of electro-osmotic flow force 163*d*-163*f* for negative bias voltages show a negative peak in the force axis, which indicates the force urges particles in the negative direction along the x-axis of coordinate system 24, i.e., towards the tip 10 of the nanopipette.

Reversing the polarity of the bias voltage causes the direction of the net force, as indicated by plots 165*d*-165*f*, to be in the positive direction along the x-axis of coordinate system 24, i.e., away from the tip of the nanopipette. Thus, the particles are pushed away from the tip, and trapping is not expected.

The above simulations were followed by experiments using the device 52 in which 510 nm fluorescently-tagged COOH-PS beads were suspended in an aqueous solution having a 10 mM concentration of potassium chloride and a pH=7.0. The beads were injected into the collection chamber 58 facing a nanopipette 54 having an opening 22 with a diameter of 1000 nm. A bias voltage sufficient to generate a 10 V/cm positive polarity electric field E was applied across the nanopipette 54. The resulting motion of the particles was microscopically recorded and the ionic current across the opening 22 measured.

Figure 34:
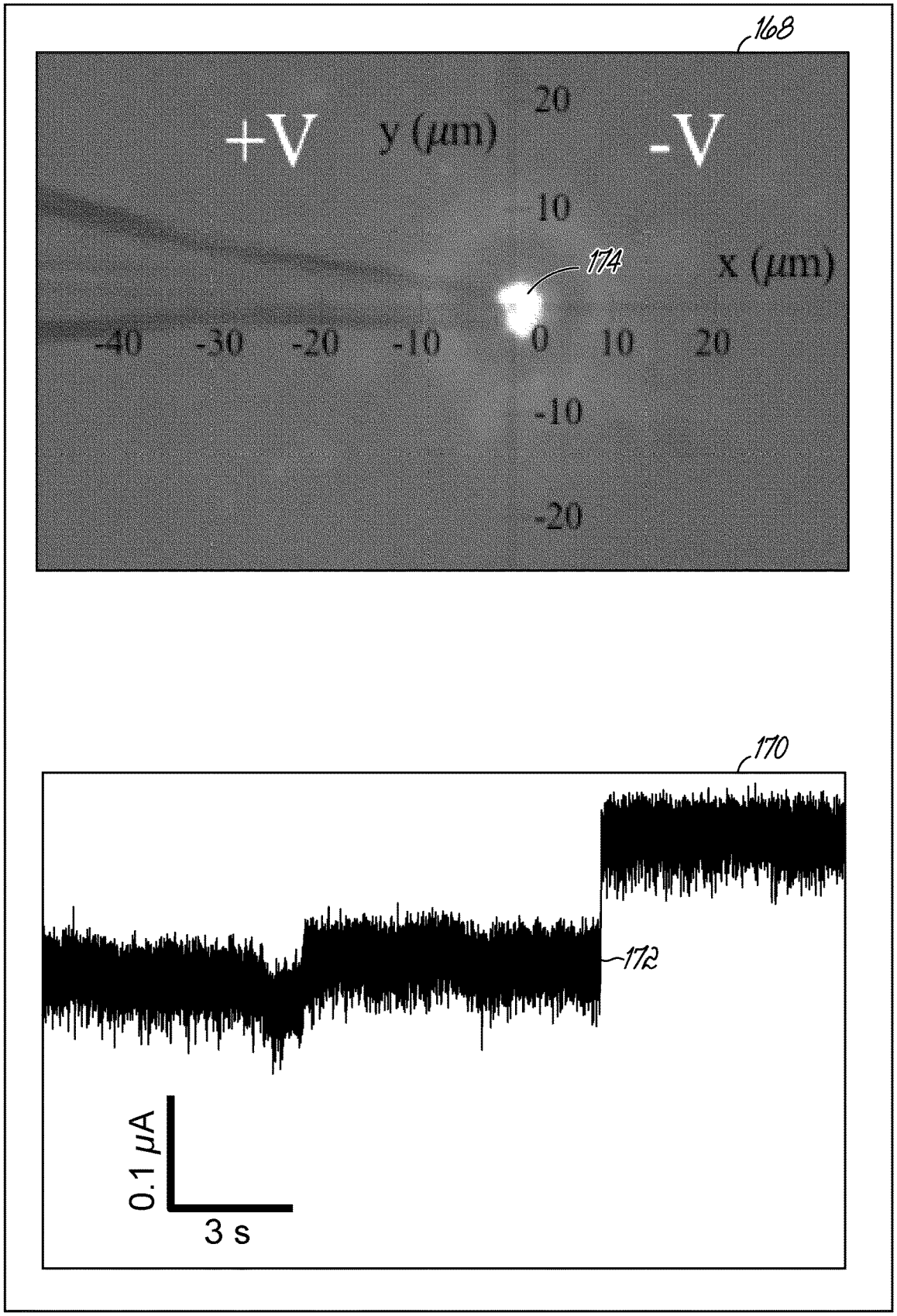
FIG. 34 includes a photographic view of the fluorescent intensity of the region proximate to the tip and a graphical view of the current passing through the opening of the tip for an electric field having a positive polarity of the device in FIG. 5.

FIG. 34 includes an image 168 that illustrates trapping of the particles 100 seconds after applying a positive potential to the bias electrode 28 relative to the reference electrode 30, and a graph 170 that includes a plot 172 of the corresponding ionic current. The plot 172 shows step changes in the ionic current as particles accumulate in the potential well proximate to the tip 10 of nanopipette 54. The trapping region where particles have accumulated indicated by a fluorescent region 174 proximate to the tip 10 of nanopipette 54. The measurement data for current flowing through the pipette 54 provided by plot 172 may be used as a qualitative indicator of particles being trapped in the cases where the optical resolution is limited.

Figure 35:
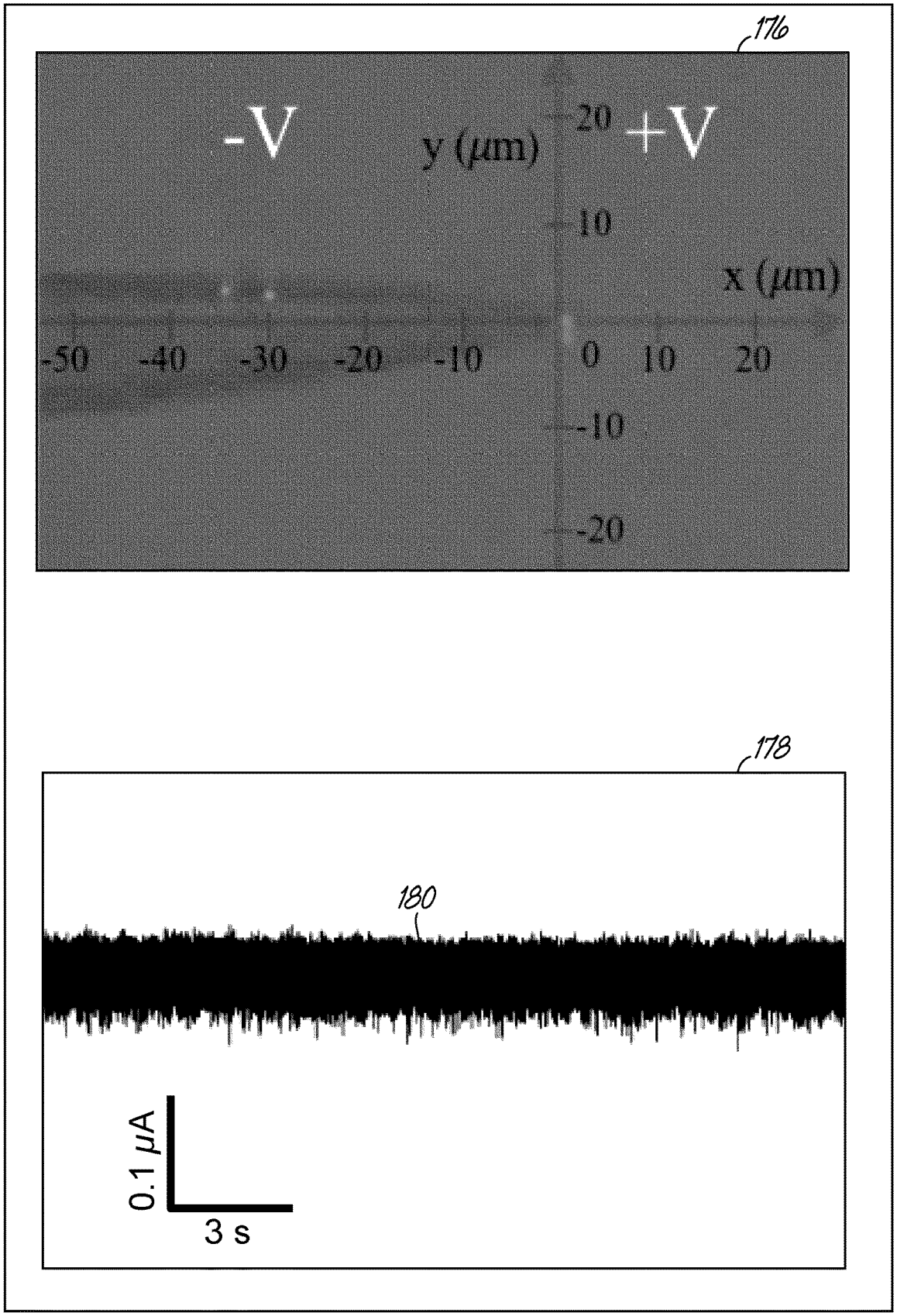
FIG. 35 includes a photographic view of the fluorescent intensity of the region proximate to the tip of FIG. 34 and a graphical view of the current passing through the opening of the tip for an electric field having a negative polarity.

FIG. 35 includes an image 176 illustrating a lack of trapping after 100 seconds of applied positive potential at the base of the nanopipette, and a graph 178 including a plot 180 of the ionic current for the above experiment repeated with a reversed voltage polarity. As can be seen by the lack of florescence proximate to the tip 10 of nanopipette 54 in image 176, no significant trapping was observed. The plot 180 also lacks any current steps, further indicating a lack of particle trapping. Results consistent with those described above were observed when a negative bias was initially applied to the electrodes 28, 30 followed by the reversal of the voltage polarity.

Figure 36:
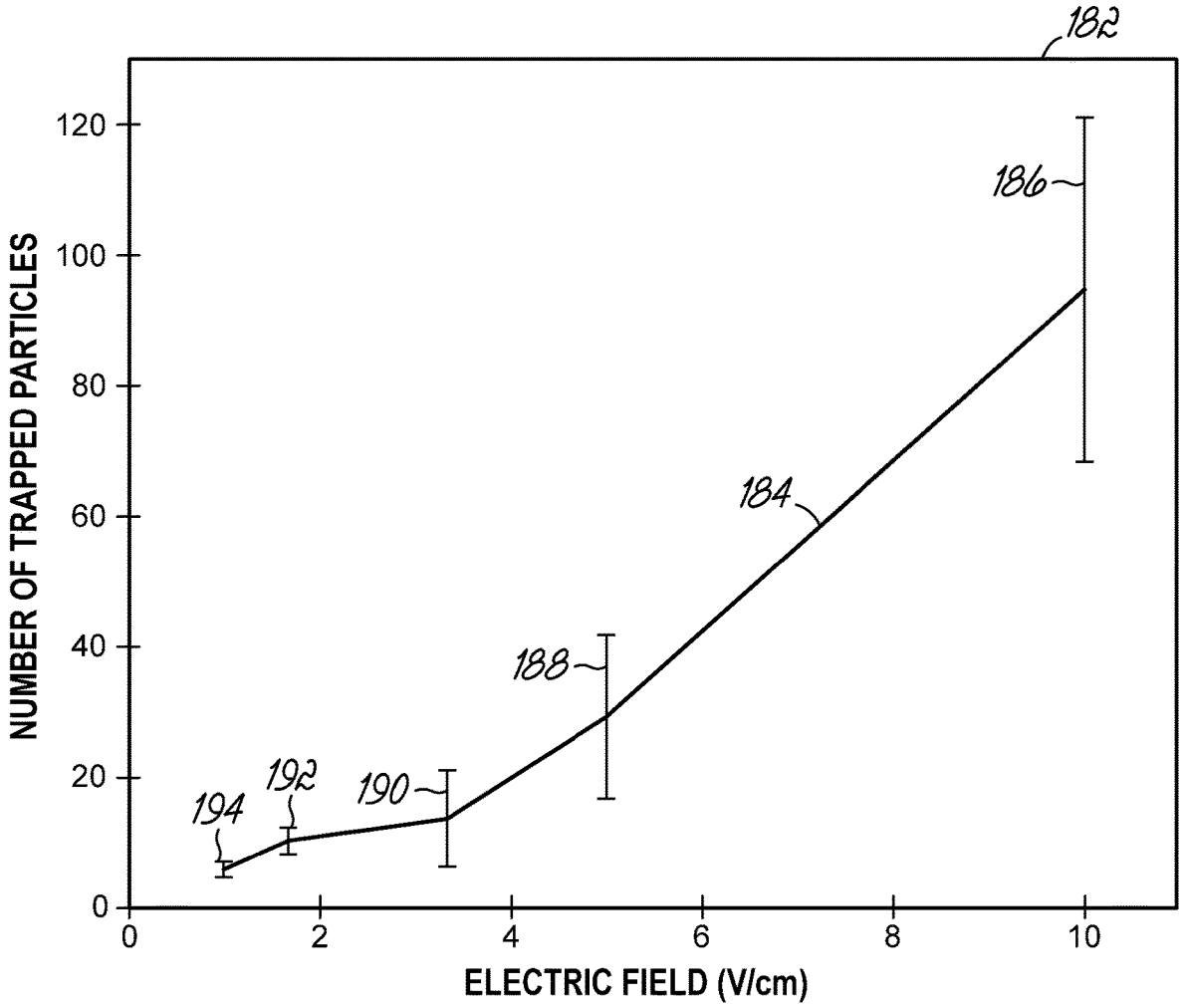
FIG. 36 is a graphical view of the number of particles trapped verses the electric field strength.
Figure 37:
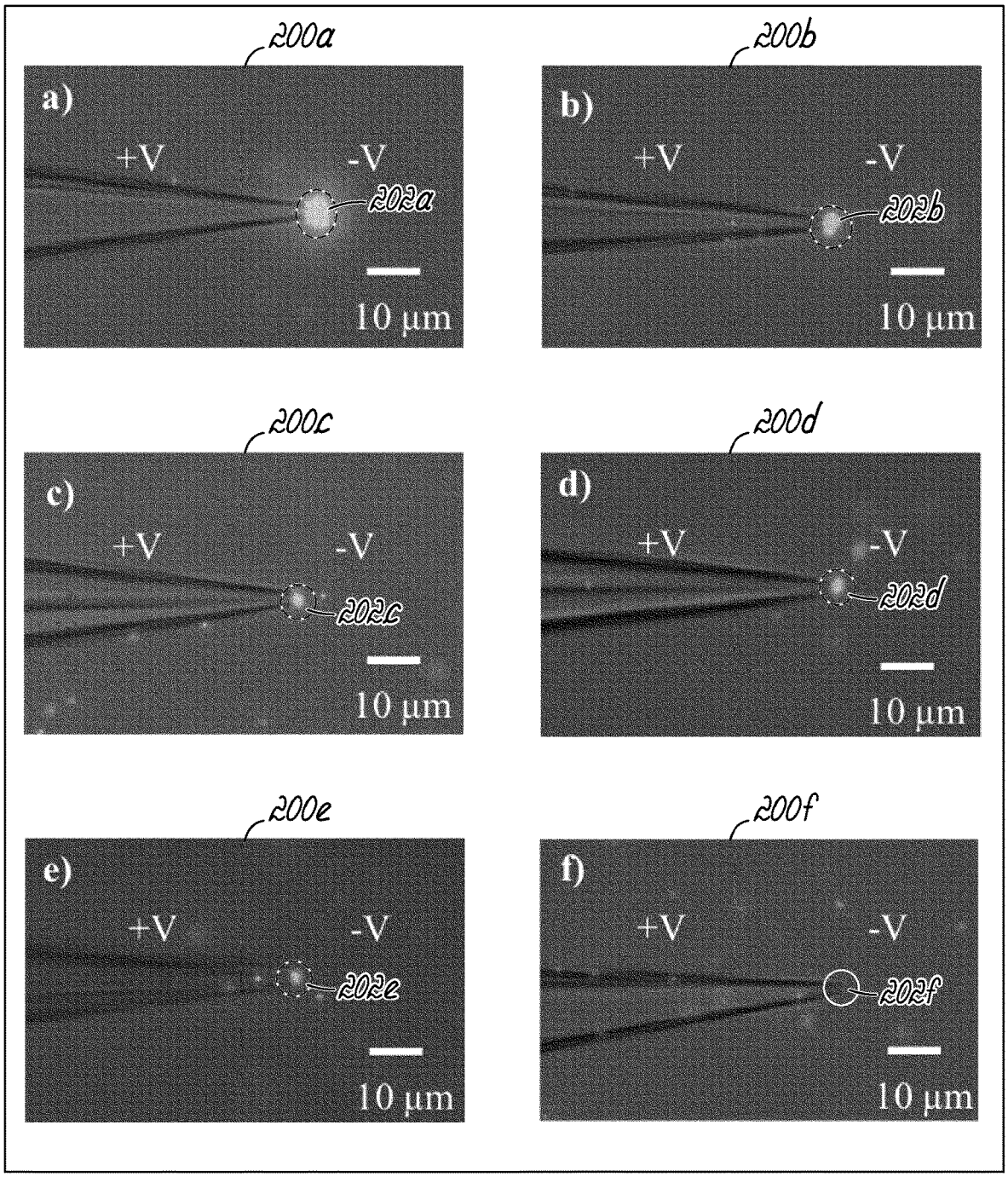
FIG. 37 includes photographic views of the fluorescent intensity proximate to the tip of the nanopipette corresponding to the graph of FIG. 36.

FIG. 36 depicts a graph 182 including a plot 184 showing the results of a set of experiments in which the magnitude of electric field was systematically reduced. FIG. 37 depicts a corresponding series of images 200*a*-200*f* including fluorescent regions 202*a*-202*f* indicative of particles being trapped proximate to the tip 10 of nanopipette 54. Results are shown for electric fields of 10.0 V/cm (error bar 186, region 202*a*), 5.00 V/cm (error bar 188, region 202*b*), 3.33 V/cm (error bar 190, region 202*c*), 1.67 V/cm (error bar 192, region 202*d*), and 1.00 V/cm (error bar 194, region 202*e*), and 0.67 V/cm (region 202*f*). These results indicate only a few particles were trapped for electric fields under 1.00 V/cm, and that more significant trapping occurred as the electric field increased above 5 V/cm. The results suggest a minimum electric field for trapping of about 1.00 V/cm under these test conditions.

The above experimental results were consistent with the simulations for electric fields of 10.0 and 5.00 V/cm. However, the experimental results deviated from the simulations at an electric field of 3.33 V/cm. As indicated by FIGS. 36 and 37, at an electric field of 3.33 V/cm, particles collected proximate to the tip 10 of nanopipette 54, and no particles were observed translocating through the opening 22 of tip 10. This result is contrary to the simulated results, which suggest that a potential well is not generated by an electric field of 3.33 V/cm. The discrepancy between the simulated and empirical results may be due to the simulation model failing to account for electrostatic repulsion between the beads and the surfaces 16, 18 of the nanopipette 54.

Figure 38:
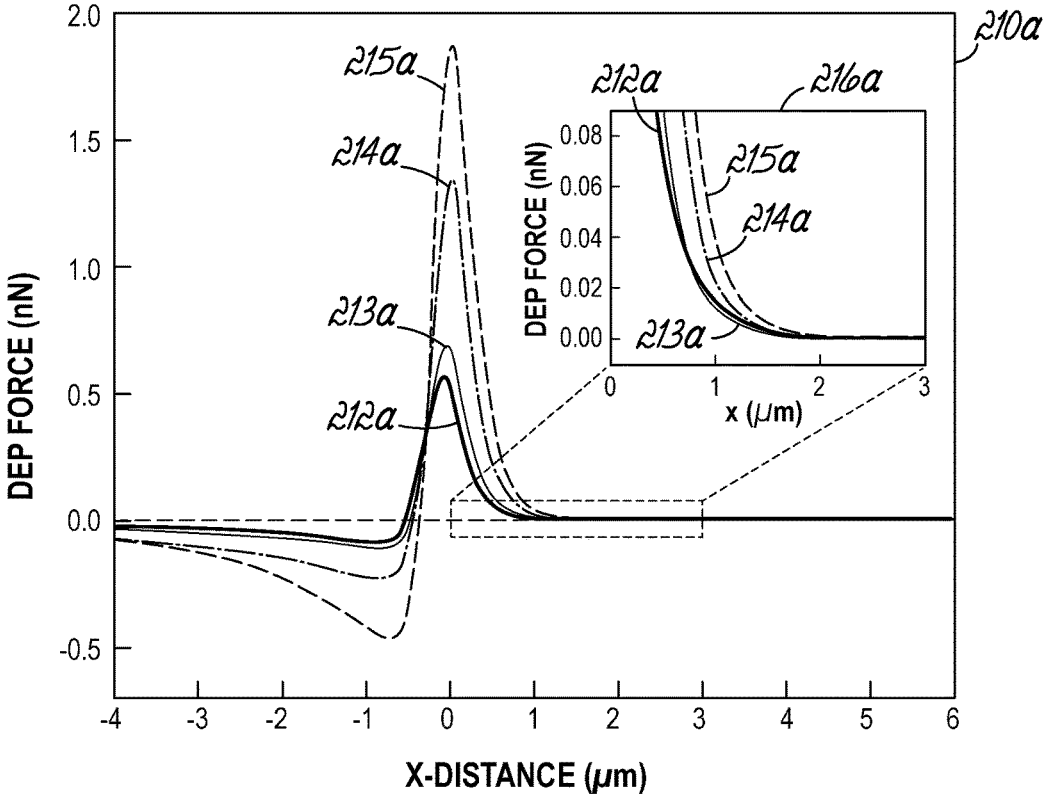
FIGS. 38-41 are graphical views of the electrokinetic forces acting on particles proximate to the tip in suspending mediums having various ionic concentrations.
Figure 39:
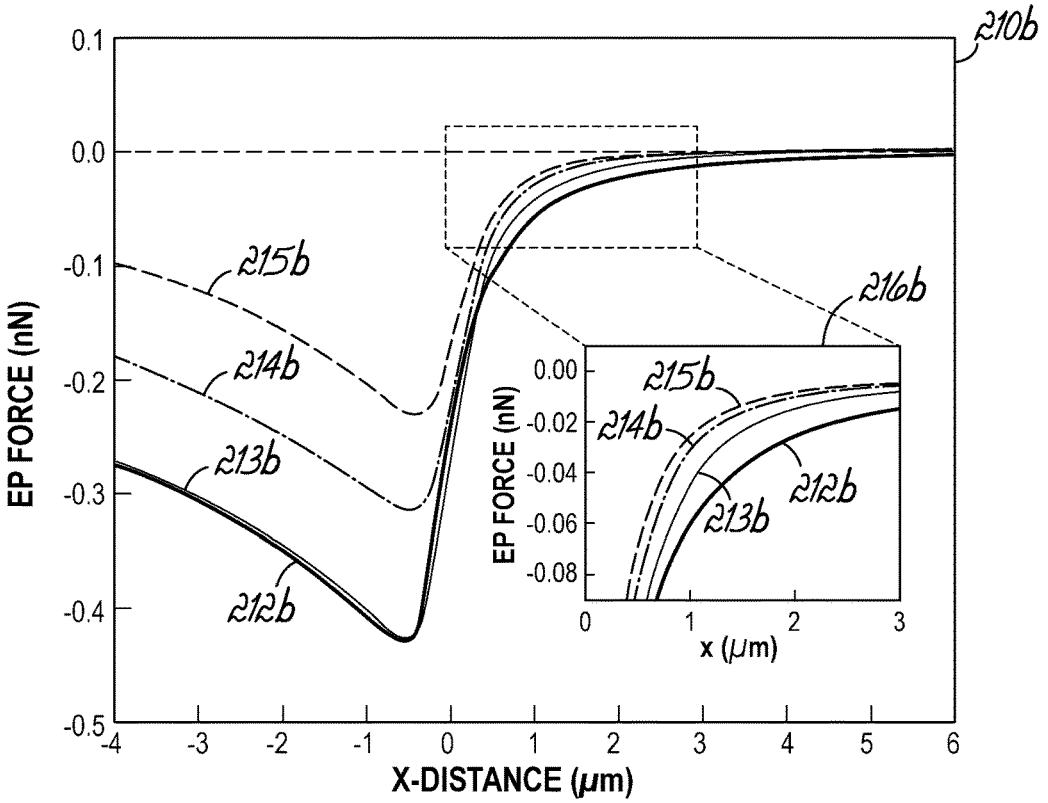
Figure 40:
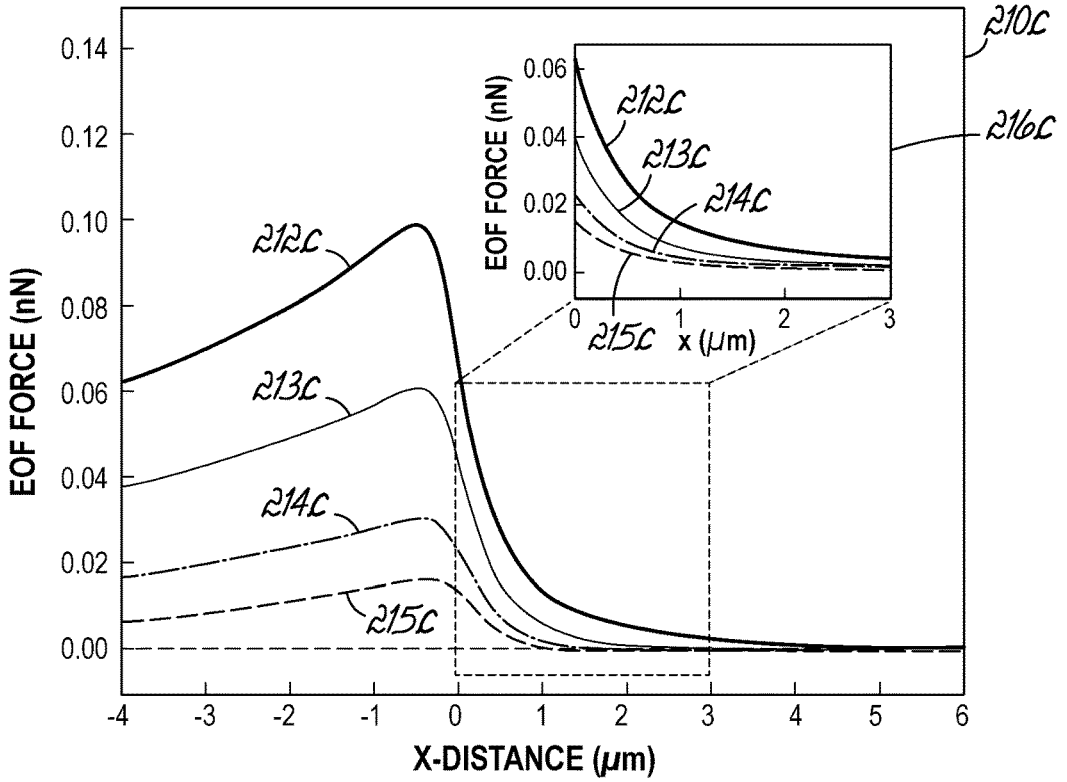
Figure 41:
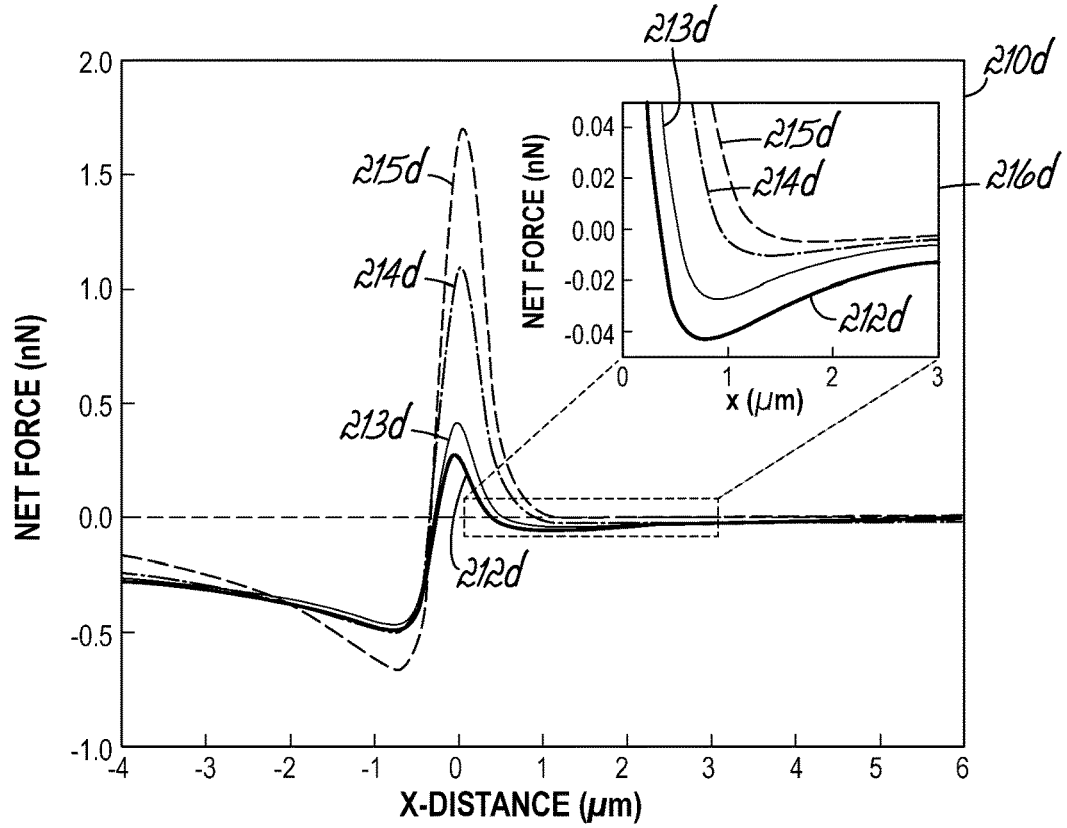
Figure 42:
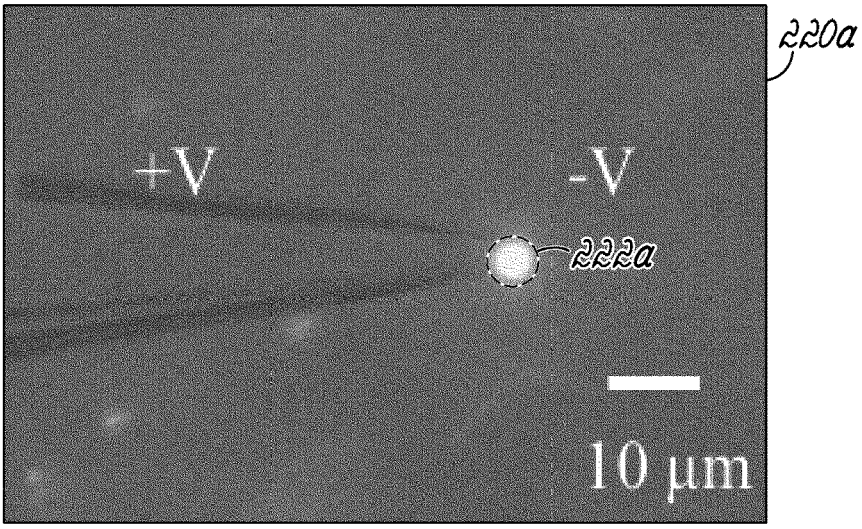
FIGS. 42-45 are photographic views of fluorescent intensity proximate to the tip of the nanopipette for the ionic concentrations of FIGS. 38-41.
Figure 43:
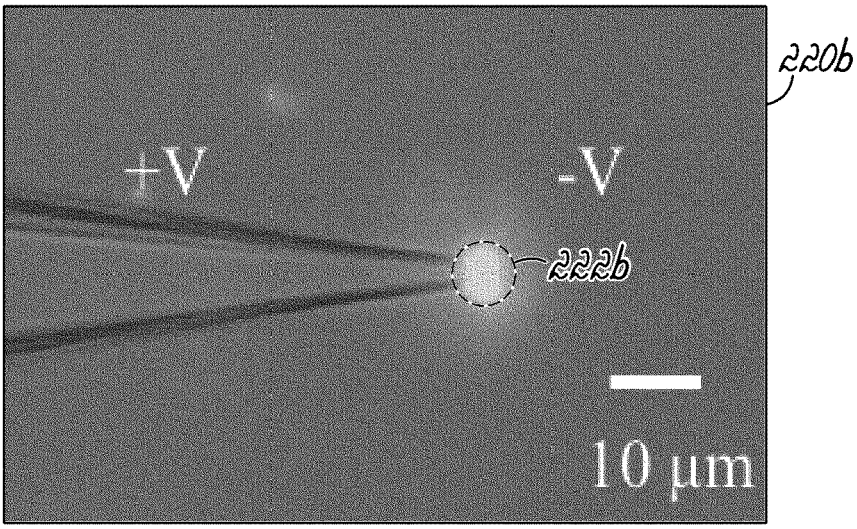
Figure 44:
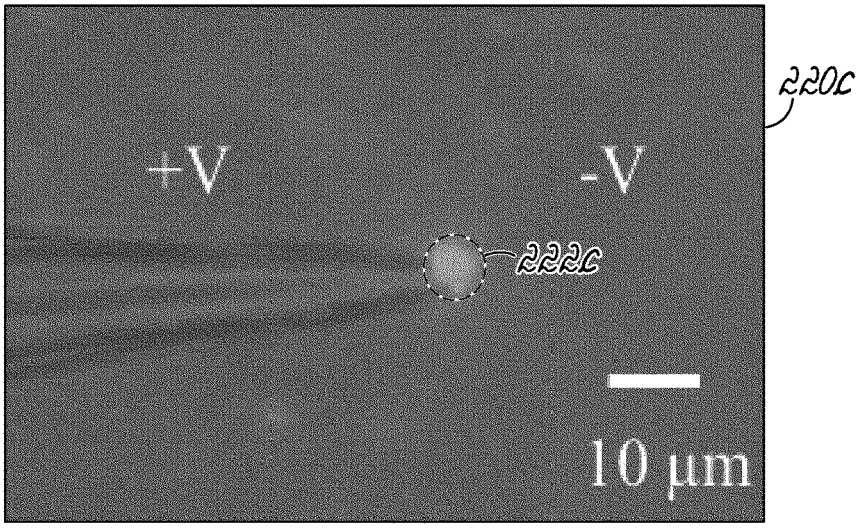
Figure 45:
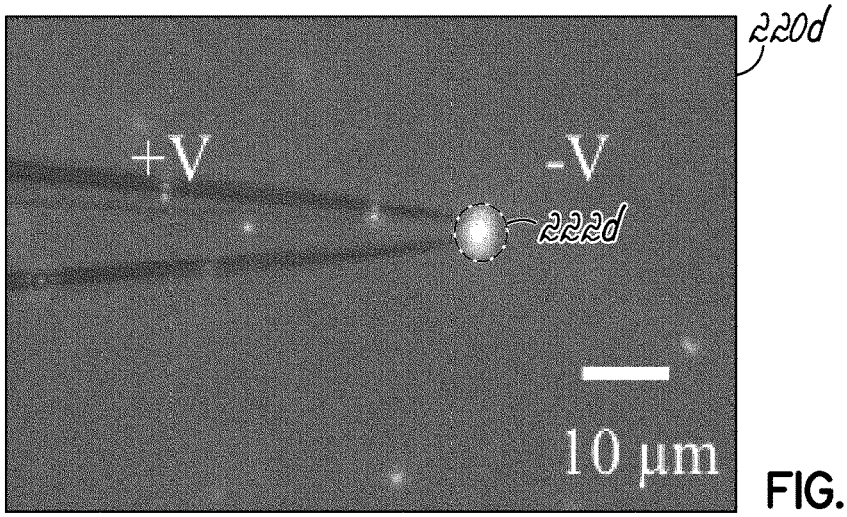

FIGS. 38-41 depict graphs 210*a*-210*d* including plots that show the effects of varying the ionic concentration of the suspending medium on the performance of the device 52. Simulation results are plotted showing the magnitude and direction of the electrokinetic forces induced on the COOH-PS beads suspended in suspending mediums having various ionic concentrations using a nanopipette with a 1000 nm opening and a positive polarity electric field E having a strength of 10.0 V/cm. Plots 212*a*-215*a* of FIG. 38 illustrate the dielectrophoretic force acting on the particles, plots 212*b*-215*b* of FIG. 39 illustrate the electrophoretic force acting on the particles, plots 212*c*-215*c* of FIG. 40 illustrate the electro-osmotic force acting on the particles, and plots 212*d*-215*d* of FIG. 41 illustrate the net force acting on the particles. Plots 212*a*-215*a* show simulated results for a suspending medium having an ionic concentration of 1 mM, plots 212*b*-215*b* show simulated results for a suspending medium having an ionic concentration of 10 mM, plots 212*c*-215*c* show simulated results for a suspending medium having an ionic concentration of 100 mM, and plots 212*d*-215*d* show simulated results for a suspending medium having an ionic concentration of 500 mM.

To better illustrate the distribution of the forces at the trapping region, each graph includes a zoomed in image 216*a*-216*d* depicting the electrokinetic forces in proximity to the opening 22 of nanopipette 54 (e.g., between 0 and 3 μm from the opening 22 along the x-axis of coordinate system 24) in the region where a potential well may be expected to form. Plots 212*a*-215*a* of FIG. 38 illustrate the dielectrophoretic force distribution along the x-axis of coordinate system 24. The direction of the induced dielectrophoretic force on the particles is generally positive to the right of the opening 22 and becomes negative at approximately 0.5 μm to left of the opening 22 for each ionic concentration. The direction of the dielectrophoretic force remains constant, but the magnitude of the dielectrophoretic force increases as the ionic condition increases. This behavior is believed to be due to the conductivity of the solution being higher than the conductivity of the particles.

Plots 212*b*-215*b* of FIG. 39 illustrate the electrophoretic force distribution along the x axis of coordinate system 24. The direction of the electrophoretic force on the particles is generally negative for each ionic concentration, with the magnitude increasing at lower ionic concentrations, but leveling off as concentrations fall below about 10 mM. The magnitude of the electrophoretic force acting on the particles is believed to be reduced as the solution's ionic strength increases due to a corresponding decrease in the Debye length at higher ionic concentrations.

Plots 212*c*-215*c* of FIG. 40 illustrate the distribution of the electro-osmotic force along the x-axis of coordinate system 24. The electro-osmotic force profile has an opposite direction but otherwise follows a similar trend in magnitude as the electrophoretic force. This behavior is believed to be due to a decrease of the Debye length close to the Silanol groups on the surfaces 15, 16 of nanopipette 54.

Plots 212*d*-215*d* of FIG. 41 illustrate the net force distribution due to the combined effect of each electrokinetic force along the x-axis of coordinate system 24. The net force increases with ionic concentration, and two zero-force crossings occur at each concentration. As the concentration is increased from 1 mM to 500 mM, the zero-force crossing to the right of the opening 22 can be seen to move progressively from about 0.4 μm to about 1.3 μm from the opening 22 of tip 10.

Figure 46:
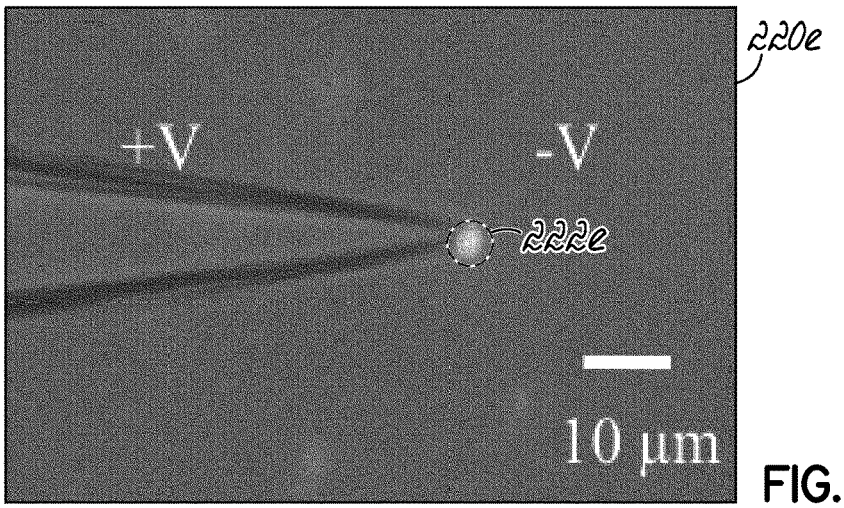
FIG. 46 is a photographic view of fluorescent intensity proximate to the tip of the nanopipette for a suspending medium comprising a 10 mM phosphate-buffered saline solution.
Figure 47:
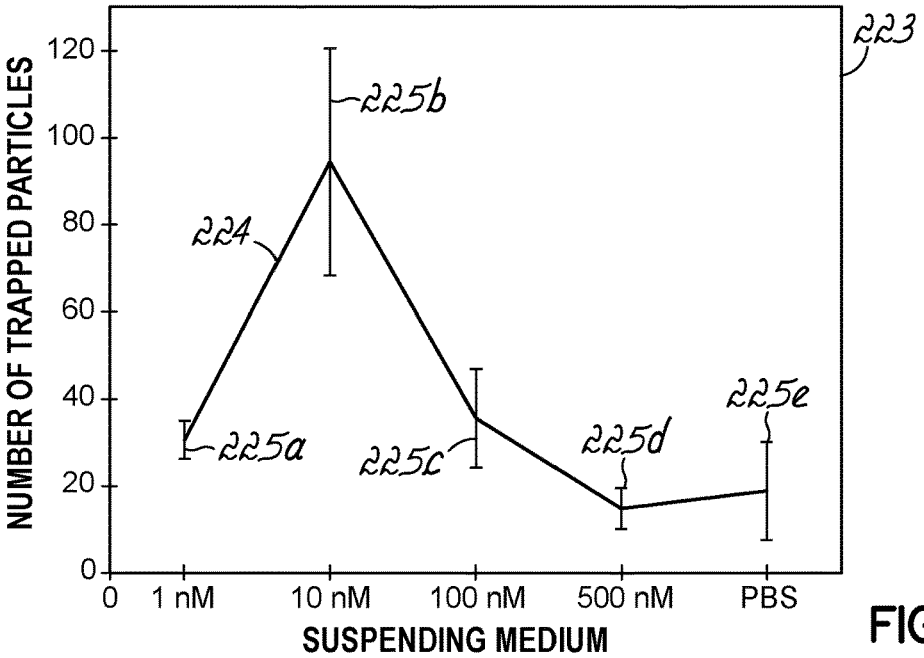
FIG. 47 is a graphical view of the number of particles captured for each of the suspending mediums of FIGS. 42-46.
Figure 48:
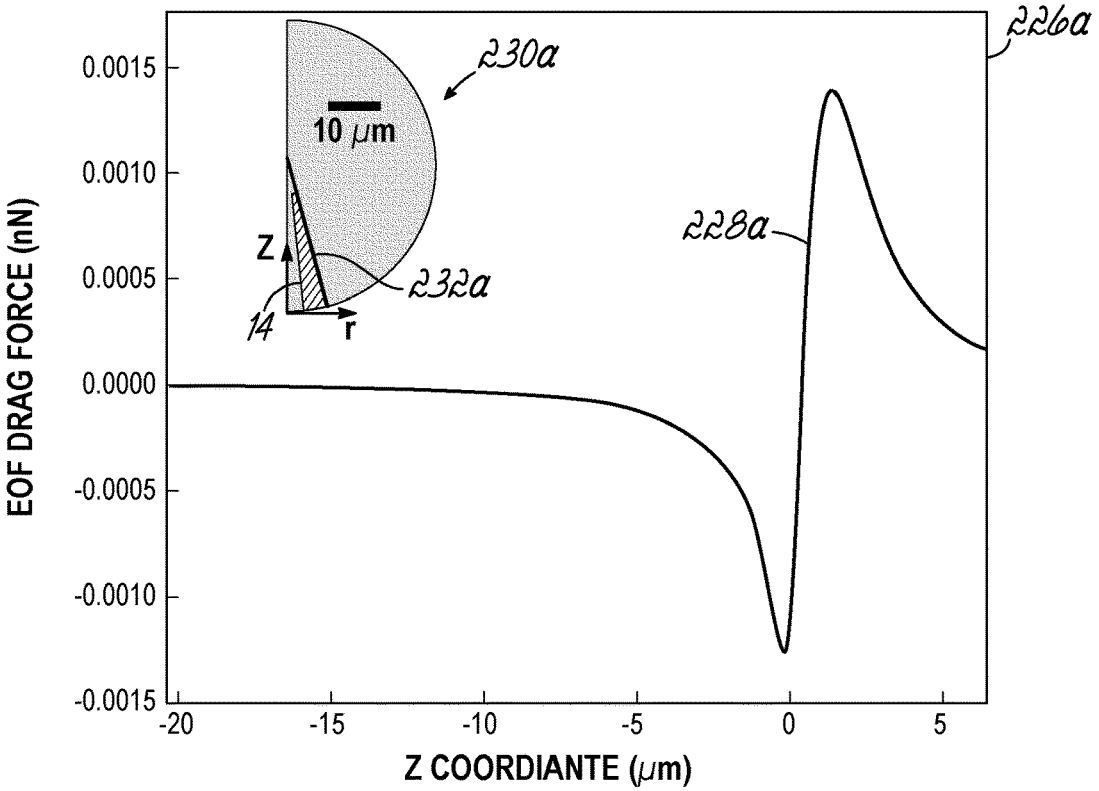
FIGS. 48-55 are graphical views of simulated electro-osmotic forces acting on particles proximate to the tip of the nanopipette with respect to the location of the particle relative to the opening of the tip.
Figure 49:
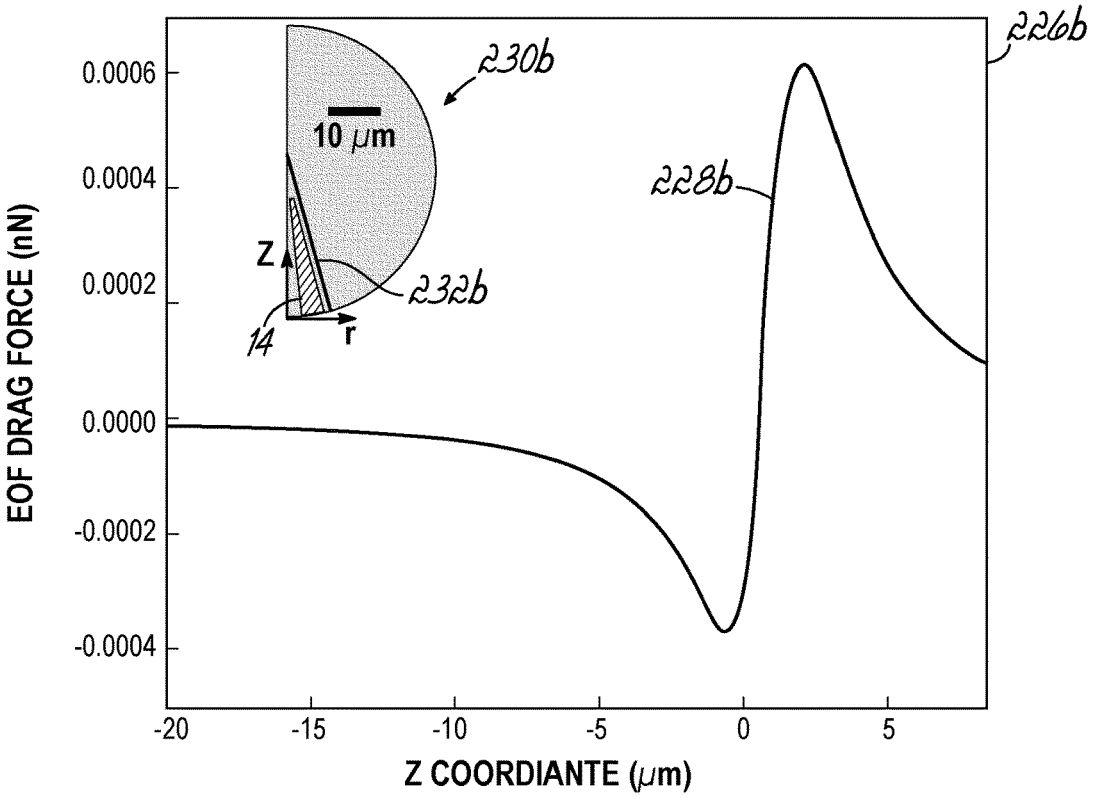
Figure 50:
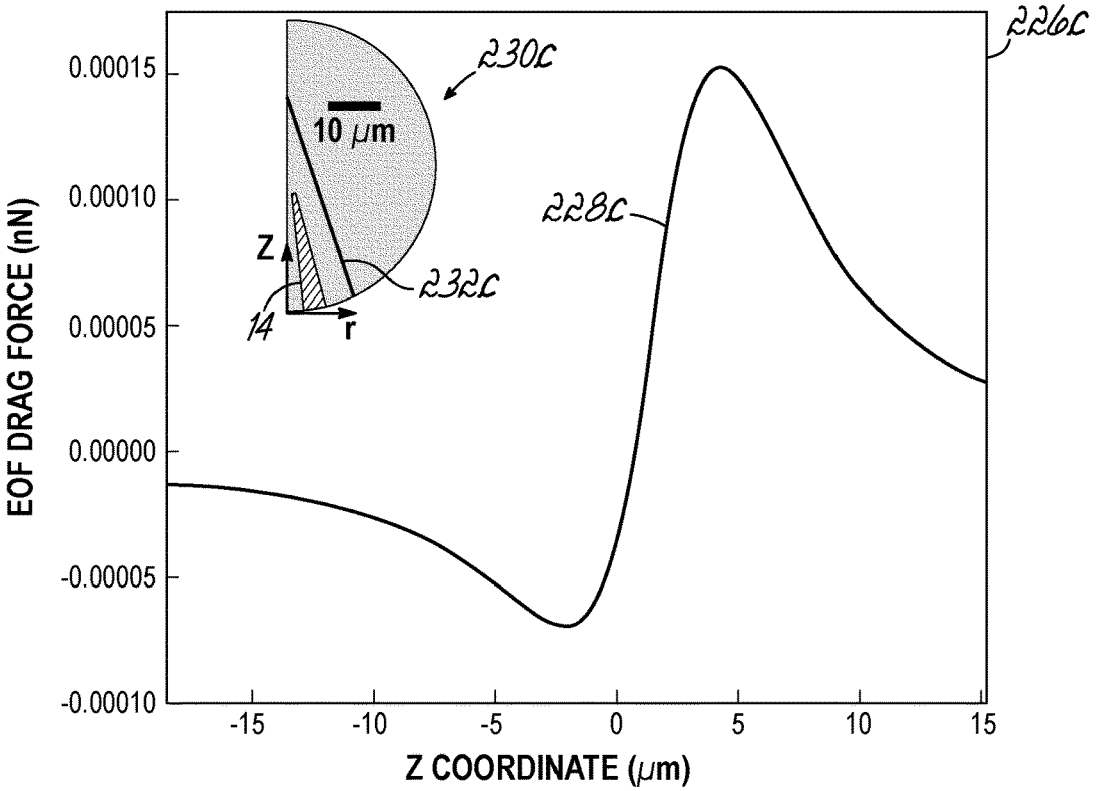
Figure 51:
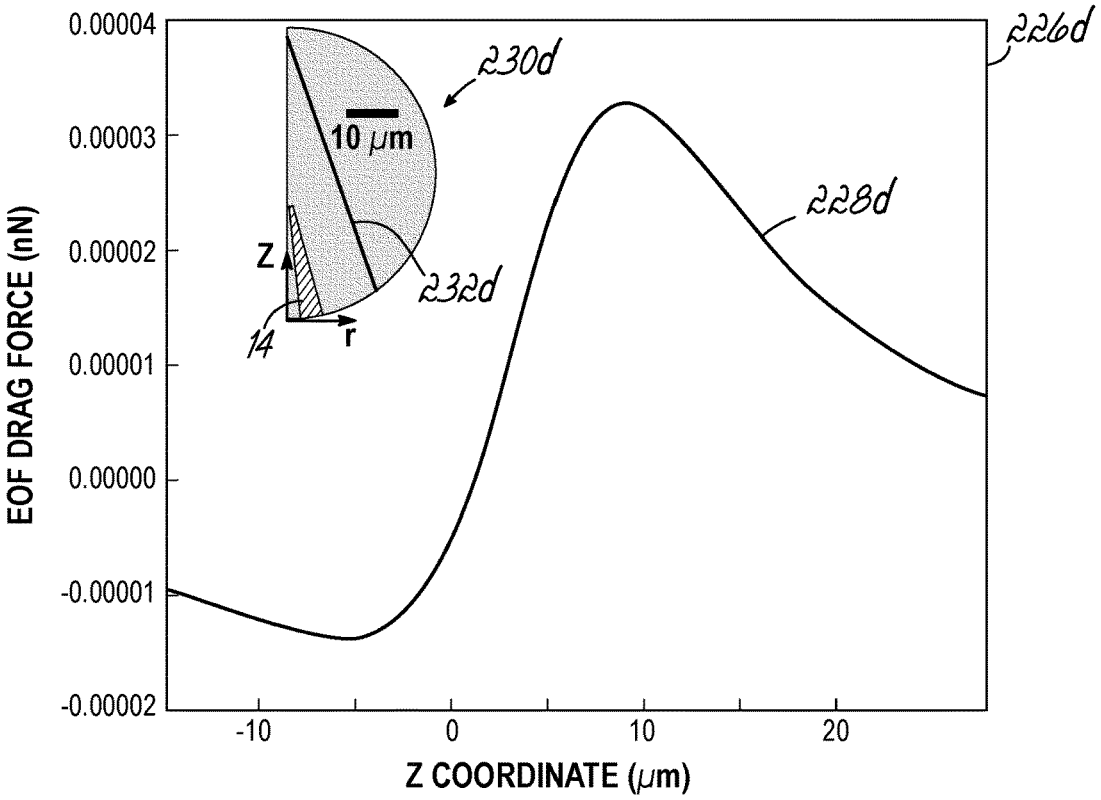
Figure 52:
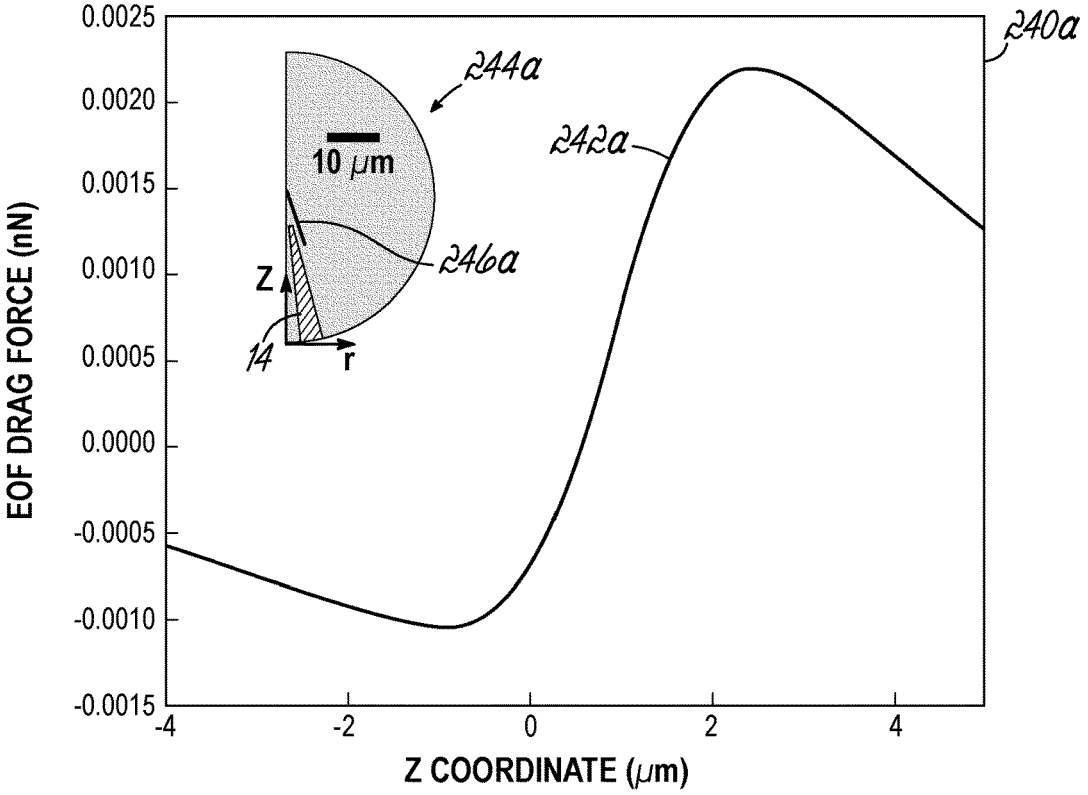
Figure 53:
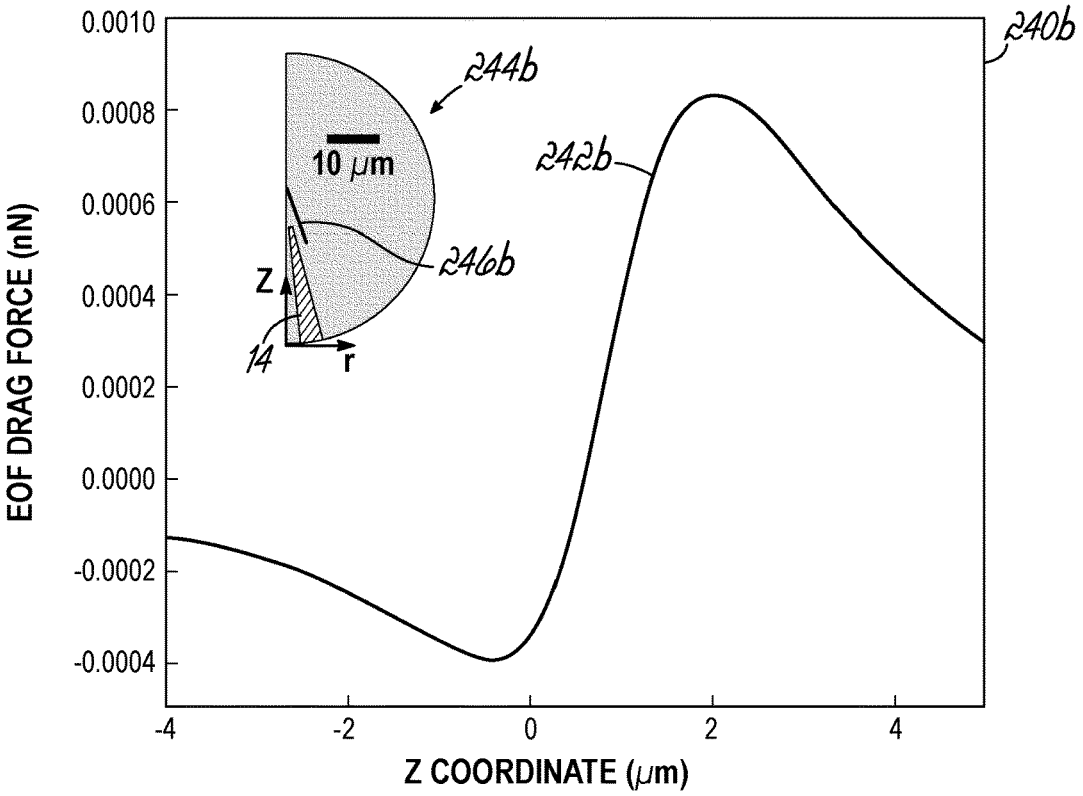
Figure 54:
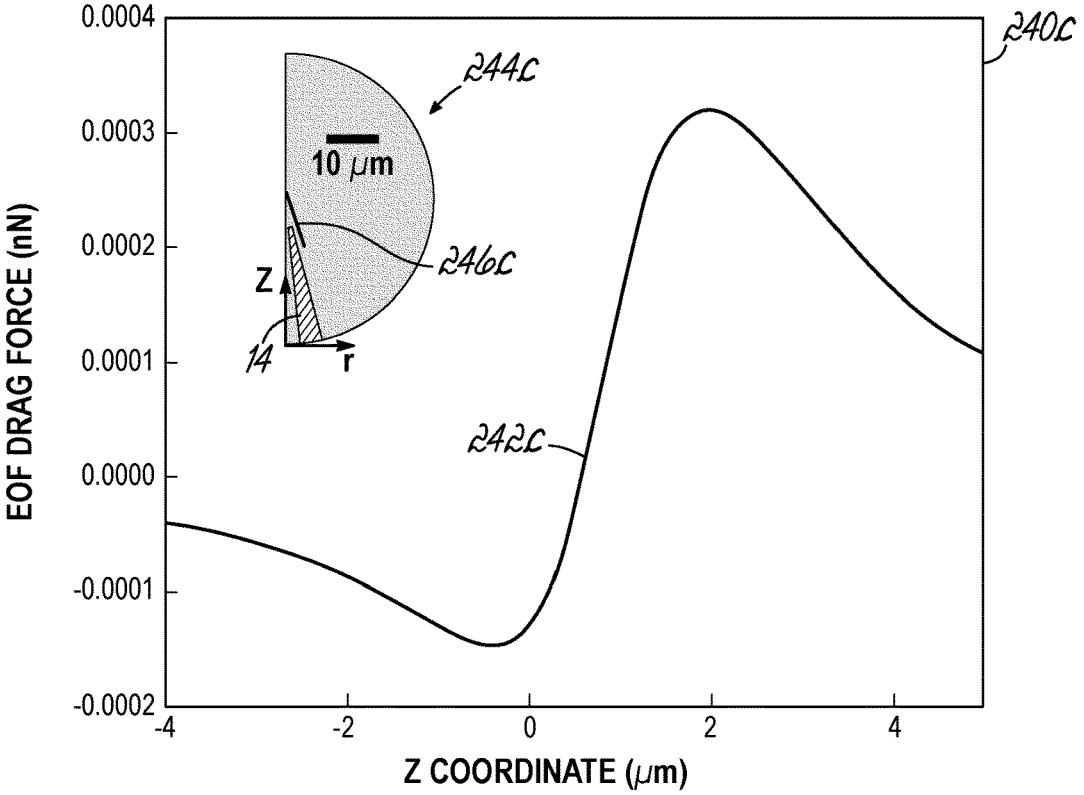
Figure 55:
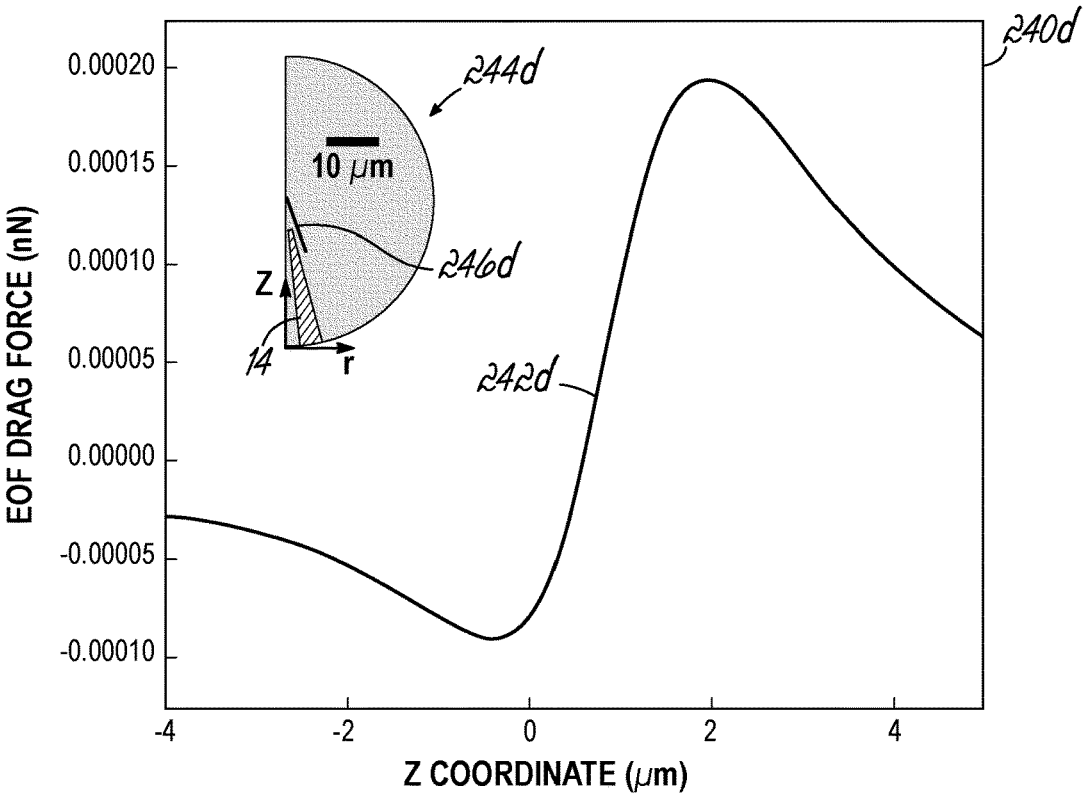

Experiments under conditions essentially the same as those used to generate the simulation results of FIGS. 38-41 were conducted and the approximate to number of trapped particles quantified 100 seconds after application of the electric signal to the electrodes 28, 30. FIGS. 42-45 depict images 220*a*-220*d* showing regions 222*a*-222*d* having fluorescent intensities corresponding to each ionic concentration, FIG. 46 depicts an image 220*e* showing a region 222*e* having a fluorescent intensity for a suspending medium comprising a 10 mM phosphate-buffered saline solution, and FIG. 47 depicts graph 223 including a plot 224 showing the corresponding number of particles captured for each set of conditions. Region 222*a* of image 220*a* and corresponding error bar 225*a* of plot 224 shows the trapping of particles in the suspending medium having an ionic concentration of 1 mM, region 222*b* of image 220*b* and corresponding error bar 225*b* of plot 224 shows the trapping of particles in the suspending medium having an ionic concentration of 10 mM, region 222*c* of image 220*c* and corresponding error bar 225*c* of plot 224 shows the trapping of particles in the suspending medium having an ionic concentration of 100 mM, region 222*d* of image 220*d* and corresponding error bar 225*d* of plot 224 shows the trapping of particles in the suspending medium having an ionic concentration of 500 mM, and region 222*e* of image 220*e* and corresponding error bar 225*e* of plot 224 shows the trapping of particles in the suspending medium comprising a 10 mM phosphate-buffered saline solution with a pH=7.

Although the simulation results show a reversed linear regression of the net electrokinetic force with respect to the solution's salt concentration, the experimental results deviated from the same trend for the 1 mM potassium chloride concentration as predicted by the simulation. It is believed that the trapping mechanism may be governed by mechanisms other than just the forces acting on the particles. For example, the initial position of the particles with respect to the nanopipette prior to entering the trapping region may affect their position at the end of the trapping interval. In regions sufficiently far from the tip 10 of nanopipette 54, the electric field and the electric field gradient may be insignificant. Thus, in these regions, the electrophoretic and dielectrophoretic forces may be too weak to impart motion to the particles.

In addition, electro-osmotic flow may exist proximate to the outer surface 18 of nanopipette 54 relatively far from the tip 10. Therefore, particles close to the outer surface 18 of nanopipette 54 may be influenced by the electro-osmotic flow and obtain an initial velocity before entering the potential well as compared to the particles in the bulk suspending medium farther from the outer surface 18. To test this theory, the electro-osmotic flow distribution along the outer surface 18 of pipette 54 was simulated at various distances.

FIGS. 48-51 depict graphs 226*a*-226*d* including plots 228*a*-228*d* of the simulated force on the particles due to electro-osmotic flow at various distances from the outer surface 18 of nanopipette 54. Simulations were performed for a 10V/cm electric field and a suspending medium comprising a 10 mM potassium chloride solution. The inset FIG. 230*a*-230*d* is a 2-D axisymmetric model of the nanopipette 54 showing a line 232*a*-232*d* along which the force due to electro-osmotic flow for the corresponding plot 228*a*-228*d* is plotted and the wall 14 of tip 10. The plots 228*a*-228*d* show a decrease in the induced electro-osmotic flow on particles located further away from the outer surface 18 of the nanopipette 54.

FIGS. 52-55 depict graphs 240*a*-240*d* including plots 242*a*-242*d* of the simulated force on the particles due to electro-osmotic flow at various distances from the outer surface 18 of nanopipette 54. Simulations were performed for a 10V/cm electric field in various suspending mediums. The inset 244*a*-244*d* is a 2-D axisymmetric model of the nanopipette 54 showing a line 246*a*-246*d* along which the force due to electro-osmotic flow for the corresponding plot 242*a*-242*d* is plotted and the wall 14 of tip 10. Graph 240*a* presents data for a simulation using a 1 mM potassium chloride suspending medium, graph 240*b* presents data for a simulation using a 10 mM potassium chloride suspending medium, graph 240*c* presents data for a simulation using a 100 mM potassium chloride suspending medium, and graph 240*d* presents data for a simulation using a 500 mM potassium chloride suspending medium. The plots 228*a*-228*d* show a decrease in the induced electro-osmotic flow on particles located further away from the outer surface 18 of the nanopipette 54.

The data presented by graphs 240*a*-240*d* also shows a reduction of the electro-osmotic flow as the ionic concentration is increased. This may indicate that particles suspended in a solution having a relatively low ionic concentration (e.g., a 1 mM potassium chloride solution) have a higher average velocity prior to entering the trapping region than particles suspended in a solution having a relatively high ionic concentration (e.g., a 100 mM potassium chloride solution). A population of particles having a relatively high average velocity may include a larger number of particles having sufficient momentum to prevent the potential well proximate the tip 10 from capturing the particle. This may lead to a smaller percentage of the total number of particles being trapped in the trapping region.

Figure 56:
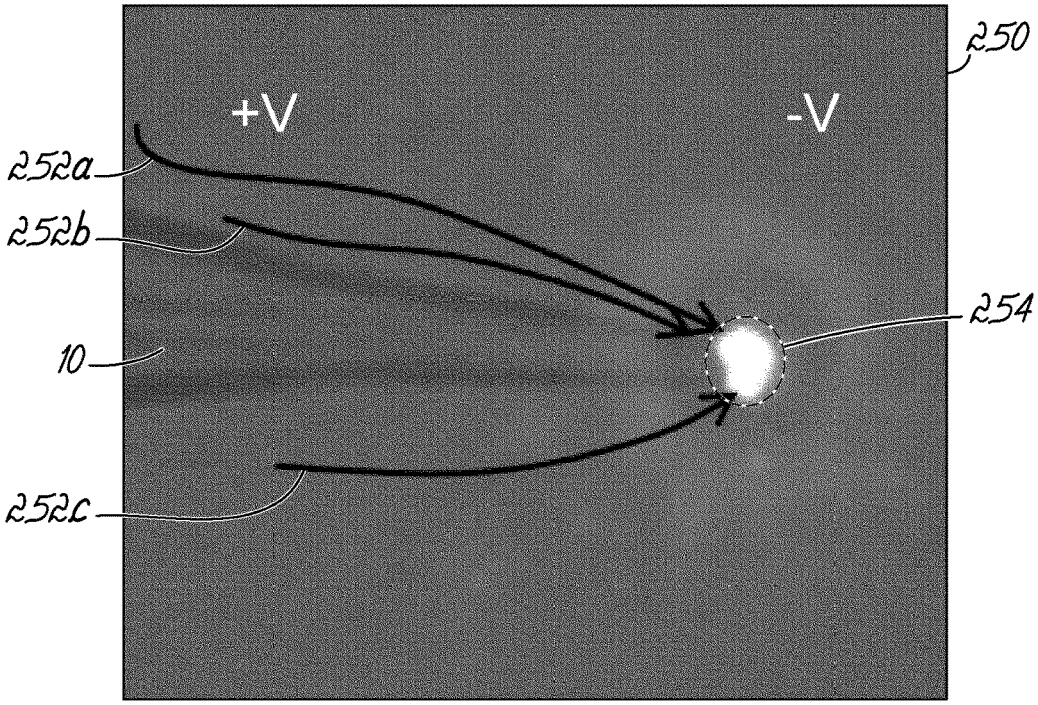
FIG. 56 is a photographic view of particles tracked from a region outside of the nanopipette to the region proximate to the opening of the tip.

To test this hypothesis, motion of the particles was tracked using images captured by the camera 78. FIG. 56 includes an image 250 depicting some exemplary trajectories 252*a*-252*c* of particles that traveled from a region outside of the nanopipette 54 to the left of the origin of coordinate system 24 to a region 254 proximate to the opening 22.

Figure 57:
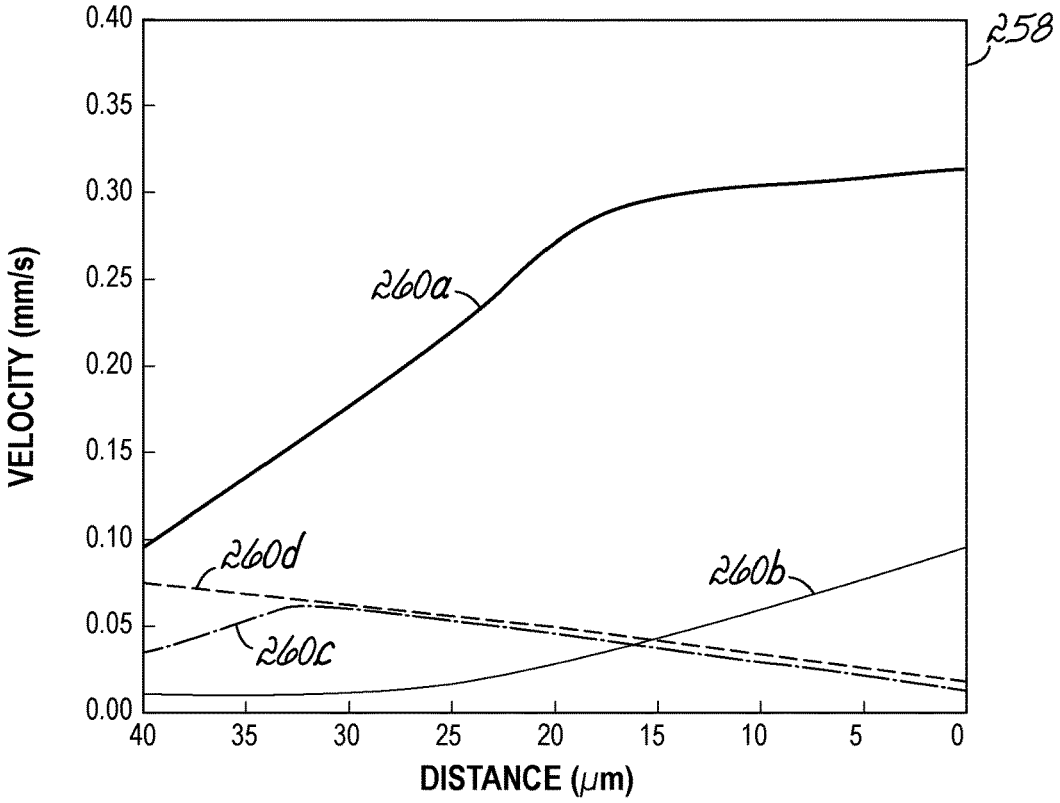
FIG. 57 is a graphical view of average velocity verses distance from the opening based on tracking data collected as shown in FIG. 56.
Figure 58:
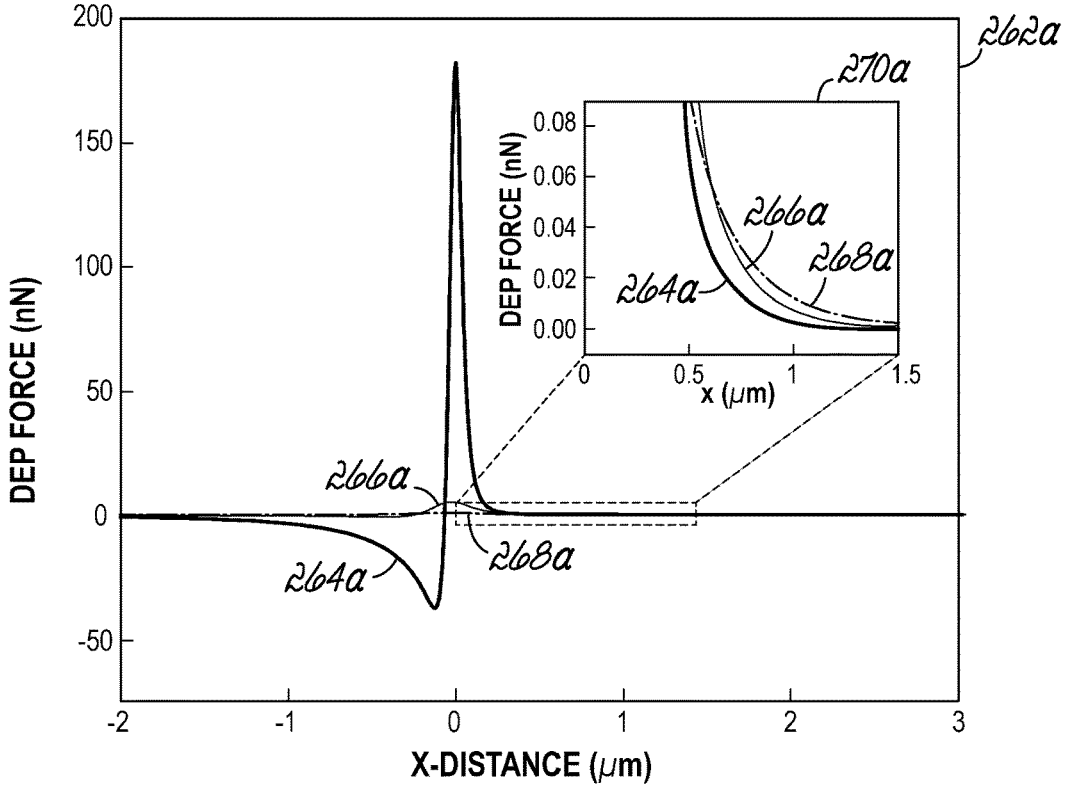
FIGS. 58-61 are graphical views showing the simulated electrokinetic forces acting on particles proximate to the tip of the nanopipette for openings having various diameters.
Figure 59:
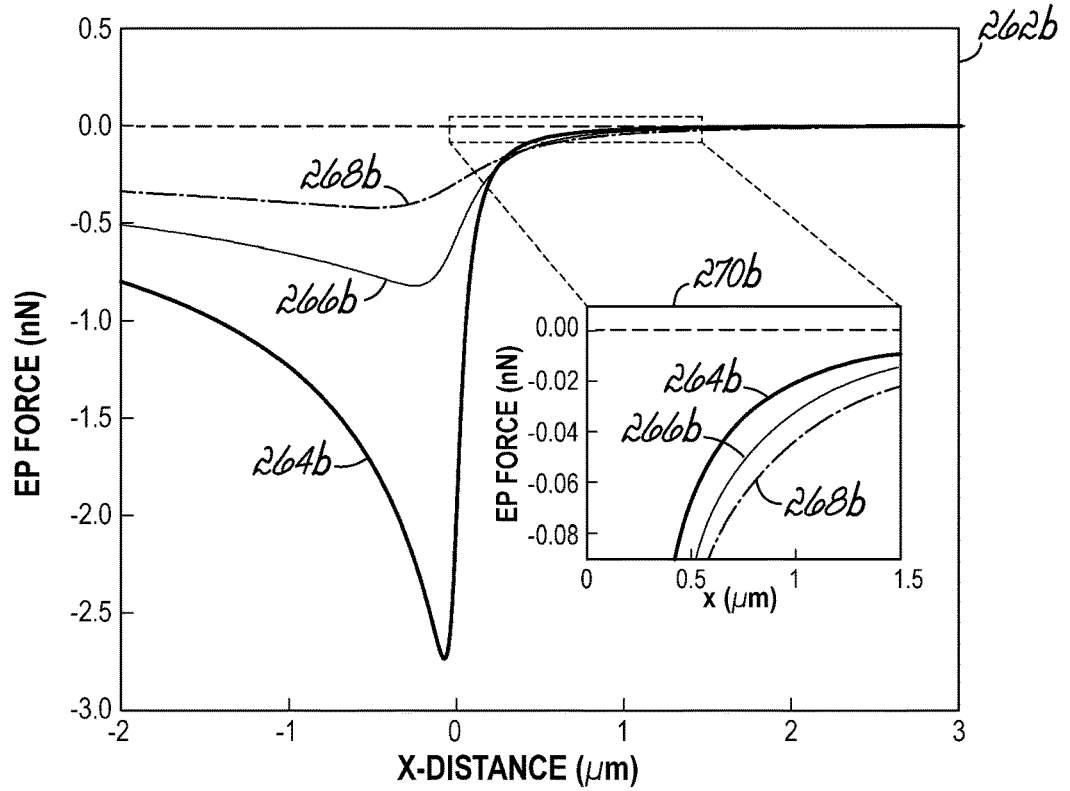
Figure 60:
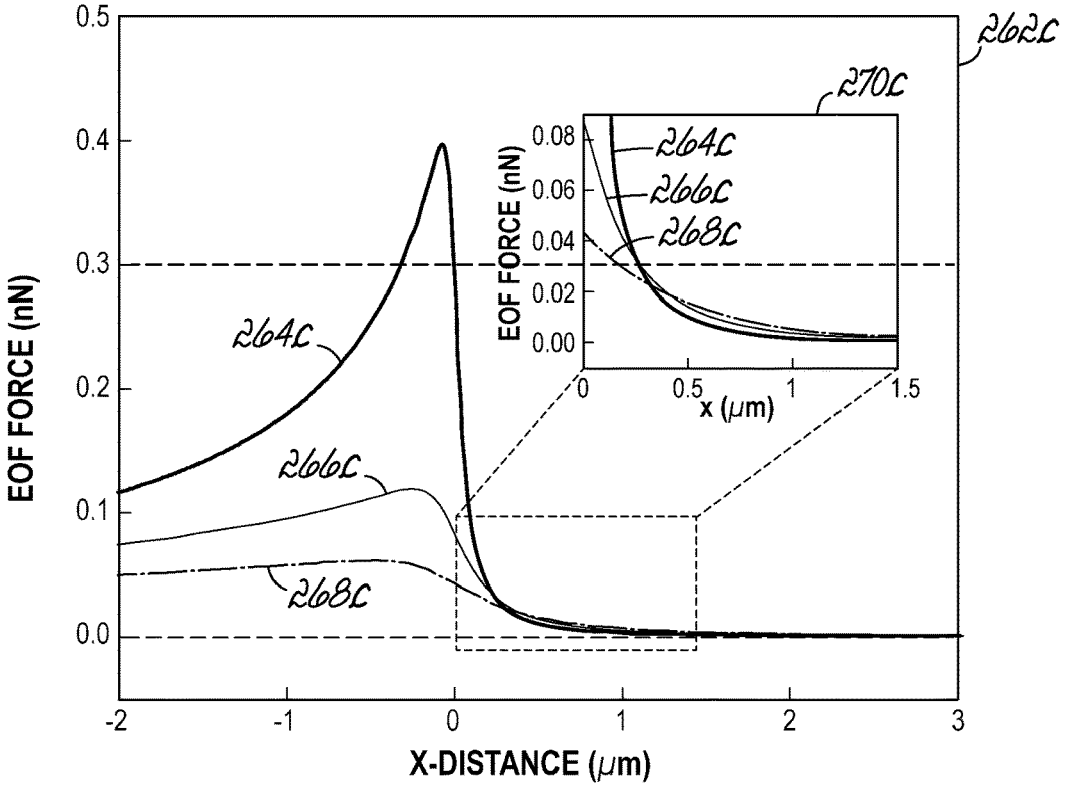
Figure 61:
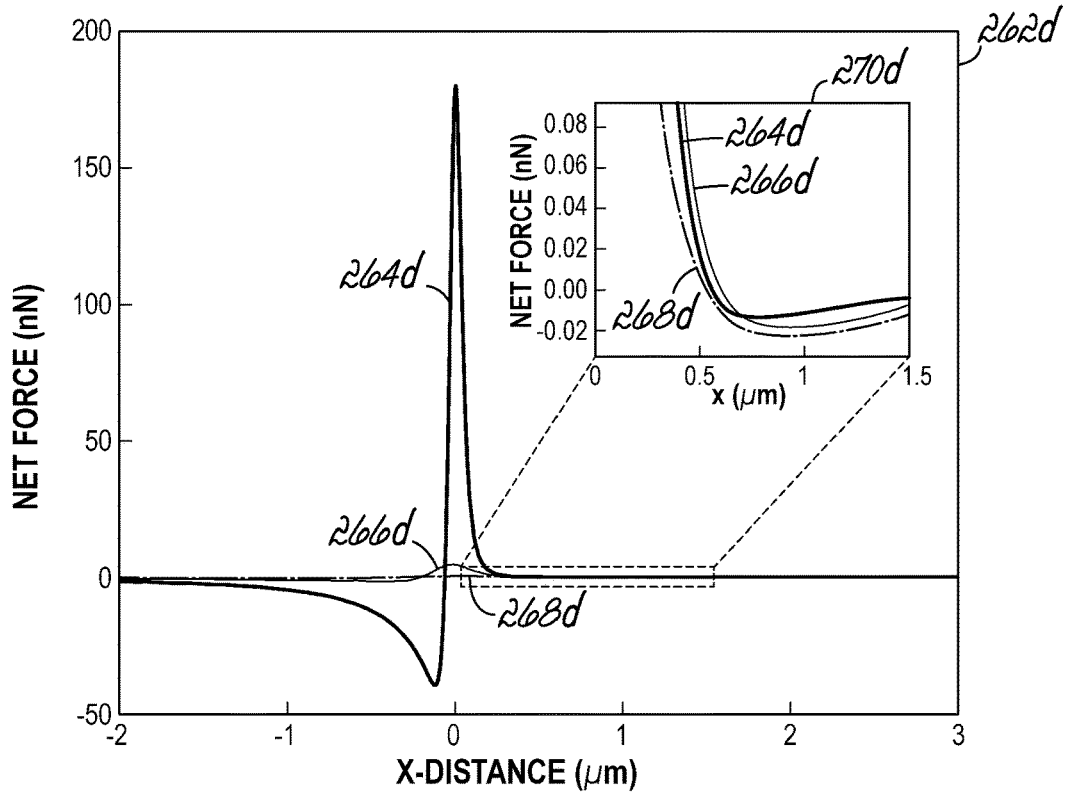

FIG. 57 depicts graph 258 including plots 260*a*-260*d* showing the average velocity of the tracked particles with respect to their distances from the origin of coordinate system 24 based on video footage of their trajectories. Results are shown for ionic concentrations of 1.0 mM (plot 260*a*), 10 mM (plot 260*b*), 100 mM (plot 260*c*), and a phosphate-buffered saline solution (plot 260*d*). The results of tracking particles depicted by graphs 260*a*-260*d* supports the hypothesis that the average particle velocity is significantly higher for particles suspended in solutions with relatively lower ionic concentrations, and that this higher velocity is due to a higher electro-osmotic flow proximate to the outer surface 18 of nanopipette 54. Also, for suspension mediums having a relatively higher ionic concentration, (e.g., a 100 mM potassium chloride solution), the velocity of the particles decreases gradually before reaching the potential well.

Average particle velocities that are too low may also cause low trapping yield. By analyzing the motion of particles suspended in a 10 mM solution of potassium chloride, the velocity of the particles was observed to be higher than in the 100 mM suspension medium and lower than in the 1 mM suspension medium. It is believed the yield using the 10 mM suspension medium may have been higher than the 1 mM and 100 mM suspension mediums because the velocity in the 10 mM suspension medium was high enough to reach the trapping region but low enough to be captured by the potential well in front of the opening 22.

FIGS. 58-61 depict graphs 262*a*-262*d* including plots 264*a*-268*c* illustrating a simulated distribution of electrokinetic forces acting on 510 nm COOH-PS beads suspended in a 10 mM potassium chloride solution with a 10 V/cm electric field E having a positive polarity. Each plot shows data for an opening 22 having a different diameter. Graph 262*a* shows the magnitude of the dielectrophoretic force for openings 22 having diameters of 150 nm (plot 264*a*), 500 nm (plot 266*a*) and 1000 nm (plot 268*a*). Graph 262*b* shows the magnitude of the electrophoretic force for openings 22 having diameters of 150 nm (plot 264*b*), 500 nm (plot 266*b*) and 1000 nm (plot 268*b*). Graph 262*c* shows the magnitude of the force due to electro-osmotic flow for openings 22 having diameters of 150 nm (plot 264*c*), 500 nm (plot 266*c*) and 1000 nm (plot 268*c*). Graph 262*d* shows the magnitude of the net force for openings 22 having diameters of 150 nm (plot 264*d*), 500 nm (plot 266*d*) and 1000 nm (plot 268*d*). Zoomed-in windows 270*a*-270*d* show the distribution of forces proximate to the opening 22 of tip 10 in the region where a potential well forms when the forces are balanced.

Graphs 262*a* and 262*b* show a reduction of dielectrophoretic and electrophoretic forces proximate to the opening 22 of tip 10 as the diameter of the opening 22 is increased. However, as best shown by zoomed-in window 270*a*, the dielectrophoretic force drops faster (i.e., has a greater slope dF/dx) outside of the nanopipette as the size of the opening 22 decreases. In addition, as best shown by graph 262*c*, the electro-osmosis flow becomes less significant at the center of the nanopipette 54 as the size of the opening 22 increases. This effect is believed to be due to an increase in the distance between the opposing inner surfaces 16 and an increase in the angle θ of the taper.

Graph 262*d* shows the net electrokinetic force acting on the particles for each of the differently sized openings 22. The zoomed-in window 270*d* shows an increase in the magnitude of the net force as the diameter of the openings 22 increased, which may lead to increased particle trapping.

Figure 62:
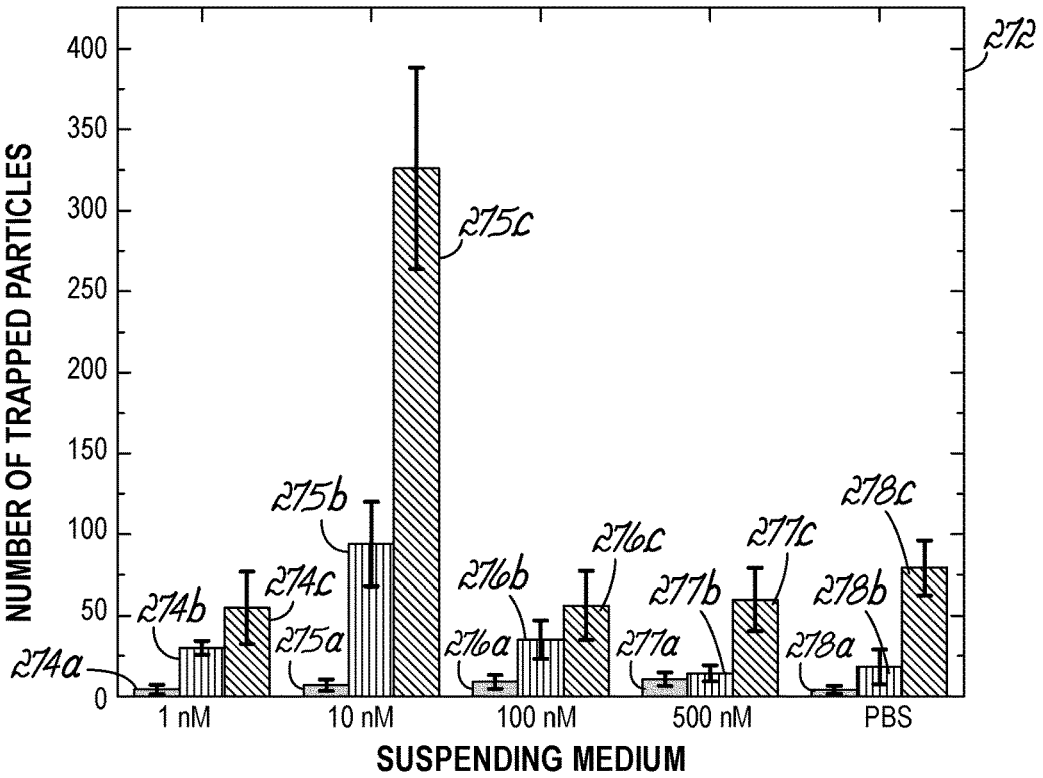
FIG. 62 is a graphical view of the number of particles trapped for various sizes of opening and types of suspending medium.
Figure 63:
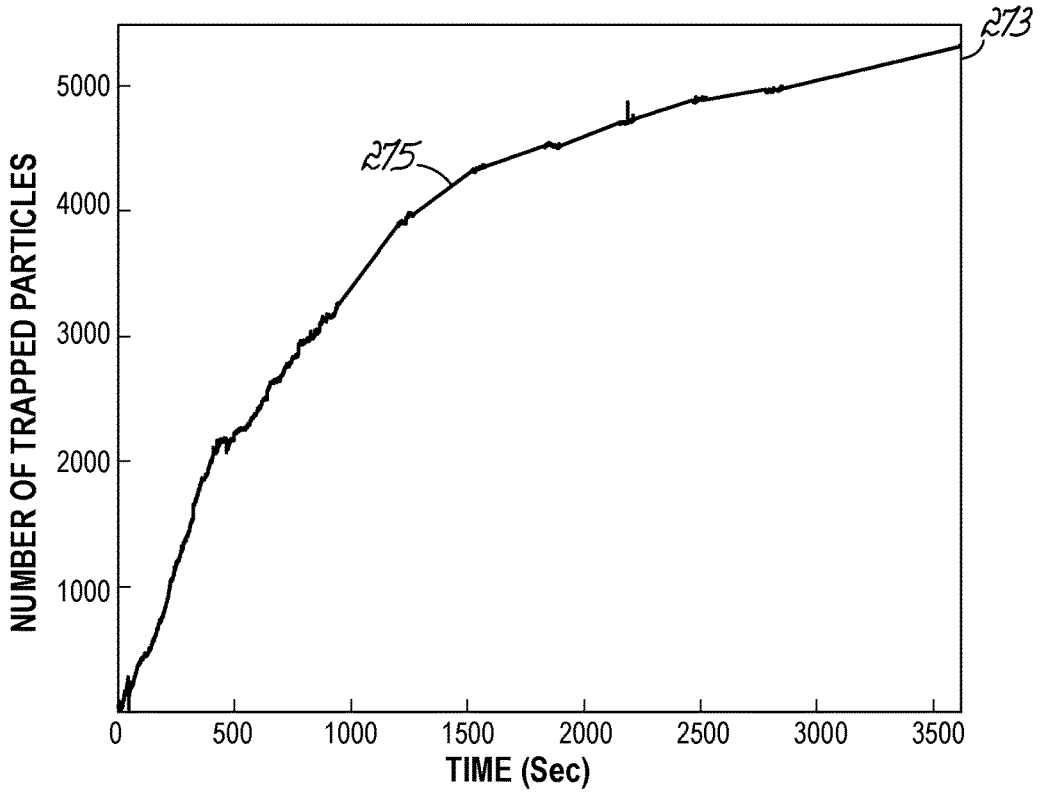
FIG. 63 is a graphical view of the number of trapped particles verses time for a 2000 nm diameter opening and a suspending medium of potassium chloride having an ionic concentration of 10 mM.
Figure 64:
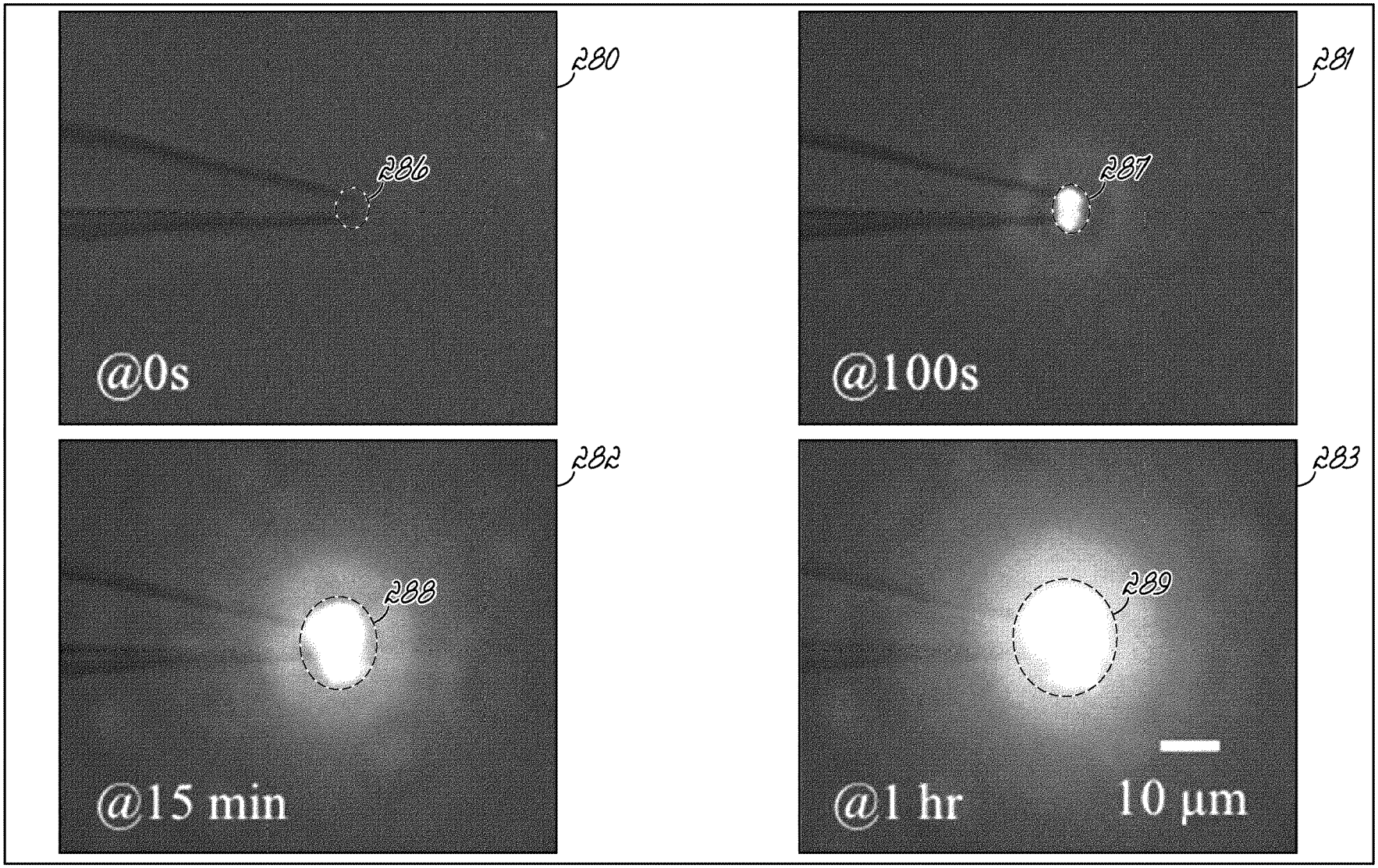
FIG. 64 includes photographic views of a fluorescent region proximate to the tip of the nanopipette corresponding to selected data points on the graph of FIG. 63.

FIGS. 62-64 present data on trapping yields obtained from empirical observations using nanopipettes 54 having openings 22 with diameters of 500 nm, 1000 nm, and 2000 nm. The experimental trapping yields are generally in agreement with the simulation results depicted in FIGS. 58-61. FIG. 62 depicts a bar graph 272 showing the number of particles trapped at the 100 second mark for different opening sizes and solutions, and FIG. 63 depicts a graph 273 including a plot 275 showing the number of trapped particles verses time for an opening having a diameter of 2000 nm in a potassium chloride solution having a pH OF 7.0 and an ionic concentration of 10 mM. FIG. 64 depicts images 280-283 showing the fluorescent intensity (and size) of regions 286-289 proximate to the tip 10 of nanopipette 54 at 0 seconds, 100 seconds, 15 minutes, and 1 hour after the application of the electric field with an opening 22 having a diameter of 2000 nm and a potassium chloride solution having an ionic concentration of 10 mM. As can be seen, the size of the fluorescent regions 286-289 continues to grow until at least the one-hour mark.

The bar graph 272 includes bars 274*a*-278*c* illustrating the simulated distribution of electrokinetic forces acting on the 510 nm COOH-PS beads suspended in solutions of potassium chloride having ionic concentrations of 1.0 mM (bars 274*a*-274*c*), 10 mM (bars 275*a*-275*c*), 100 mM (bars 276*a*-276*c*), and 500 mM (bars 277*a*-277*c*). Data was also collected for a phosphate-buffered saline solution (bars 278*a*-278*c*). For each suspending medium, data was collected using nanopipettes 54 having openings 22 with diameters of 500 nm (plots 274*a*-278*a*), 1000 nm (plots 274*b*-278*b*), and 2000 nm (bars 274*c*-278*c*) using a 10 V/cm positive polarity electric field E. The maximum number of particles was trapped using a 2000 nm opening and a solution having an ionic concentration of 10 mM.

Plot 275 illustrates the estimated number of particles trapped verses time based on the fluorescent intensity of the regions 286-289. This data indicates that approximately 5,300 particles were trapped after one hour using the 10 V/cm electric field E. By analyzing the slope of plot 275, it has been determined that the trapping growth rate slows down as particles accumulate by the tip 10 and begins to plateau after approximately 2,500 seconds.

As the particles accumulate proximate to the tip 10, the net electrokinetic force acting on the suspended particles may drop due to particles saturating the trapping region. This reduction in the electrokinetic force acting on the particles may result in reduced particle trapping and may put an upper limit on the number of particles that can be trapped. To improve the yield over that provided by a single opening 22 (which may be on the order of 0.8% of the particles in the bulk suspending medium), it is contemplated that an array of openings may be fabricated on a substrate to provide a plurality of potential wells for trapping particles in the suspending medium.

Experimental results using nanopipettes with the same size opening but different geometries indicate that characteristics of the tip 10 other than the diameter of the opening, such as the taper angle θ may also affect trapping efficiency. Table III shows impedance measurements using nanopipettes having tips 10 with taper angles θ between 6.0° and 10.2°, openings with a diameter of 500 nm, and an electric field of 10 V/cm. Table IV shows impedance measurements using nanopipettes having tips 10 with taper angles θ between 10.6° and 13.5° and openings with a diameter of 500 nm for different concentrations of solution and electric field strength. Table III shows impedance measurements using nanopipettes having tips 10 with taper angles θ between 6.0° and 10.2°, openings with a diameter of 500 nm, and an electric field of 10 V/cm.

Figure 65:
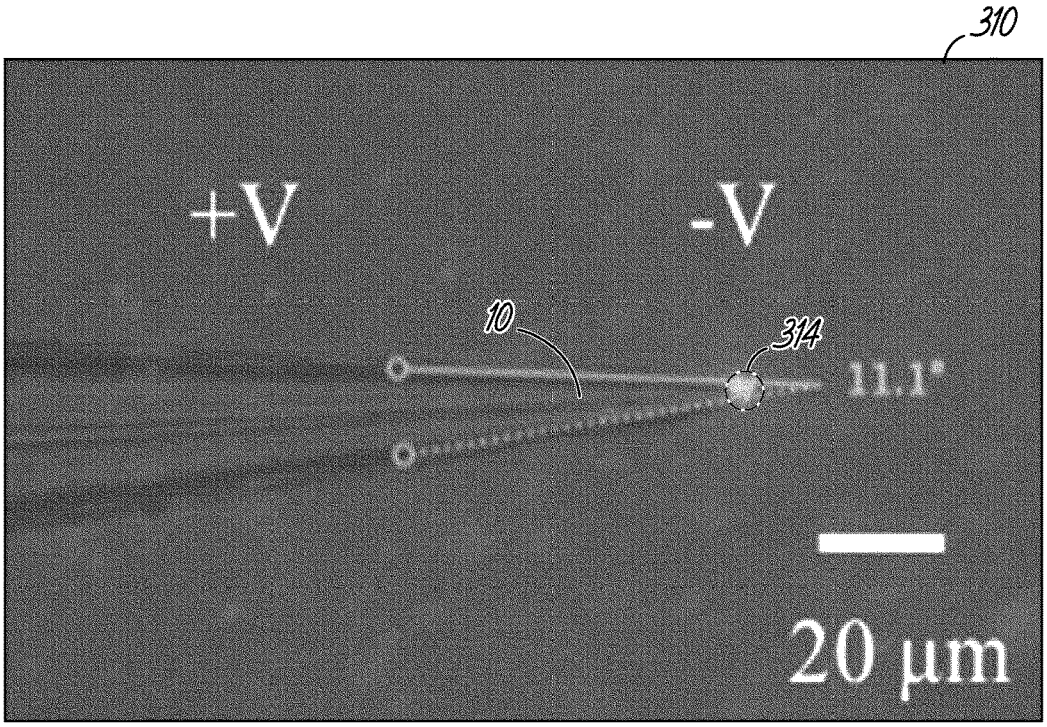
FIGS. 65 and 66 are photographic views of fluorescent regions for tips having different taper angles.
Figure 66:
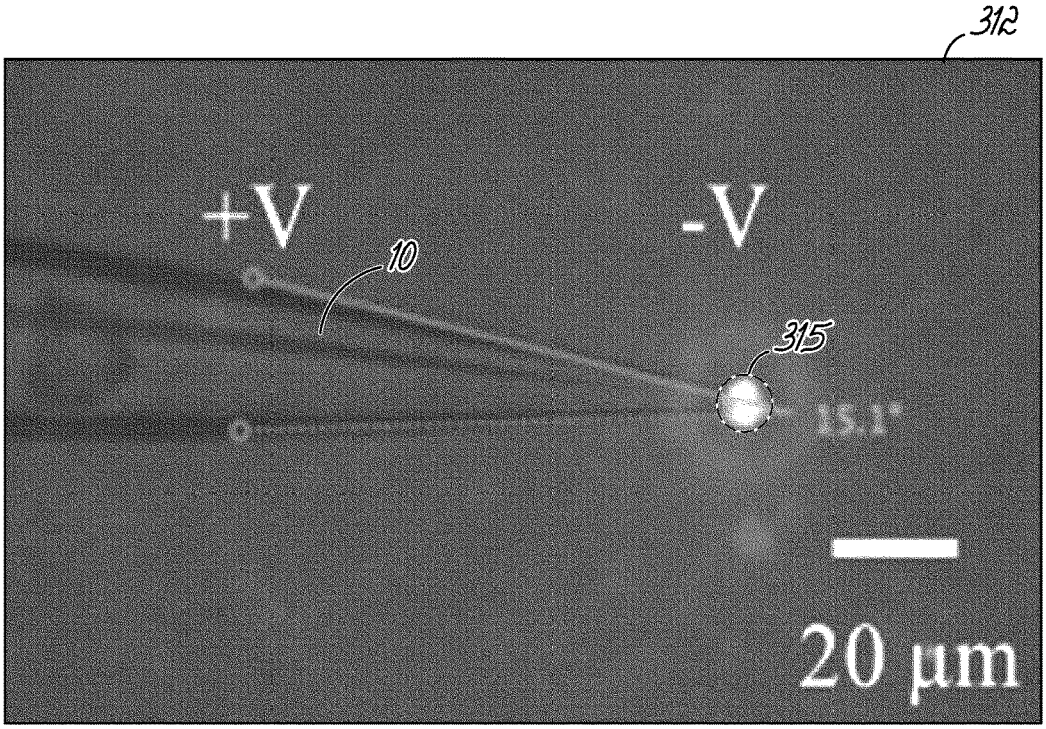

To investigate the effect of varying the taper angle θ, experiments were run using a nanopipette 54 with a tip 10 having a taper angle θ=15.1° and an opening with a diameter of 1000 nm. FIGS. 65 and 66 depict images 310, 312 showing fluorescent regions 314, 315 corresponding to taper angles of θ=11.1° and θ=15.1°, respectively. As can be seen from the relative size of fluorescent region 315 to fluorescent region 314, increasing the taper angle θ from 11.1° to 15.1° produces a significant increase in particle trapping efficiency. This effect may be due to a reduction in electro-osmotic flow at the center of the nanopipette 54, which may result in a reduction of the repelling force acting on the particles by the electro-osmotic flow as the tapered angle is increased.

TABLE III

Resistance vs Taper Angle θ for 500 nm Opening and E =10 V/cm

| Solution | Taper Angle (deg.) | $R_{open}$ (Ω) |
|---|---|---|
| 1 mM KCl | 7.0 | $811 \times 10^6$ |
| | 9.1 | $625 \times 10^6$ |
| | 7.4 | $577 \times 10^6$ |
| 10 mM KCl | 8.0 | $361 \times 10^6$ |
| | 6.6 | $500 \times 10^6$ |
| | 6.0 | $300 \times 10^6$ |

TABLE III-continued

| Resistance vs Taper Angle θ for 500 nm Opening and E =10 V/cm | | |
|---|---|---|
| Solution | Taper Angle (deg.) | $R_{open}$ (Ω) |
| 100 mM KCl | 10.2 | $33.3 \times 10^6$ |
| | 8.0 | $46.9 \times 10^6$ |
| | 7.7 | $53.6 \times 10^6$ |
| 500 mM KCl | 8.1 | $68.5 \times 10^6$ |
| | 7.5 | $10.7 \times 10^6$ |
| | 8.8 | $7.56 \times 10^6$ |
| Phosphate-Buffered | 7.0 | $21.0 \times 10^6$ |
| | 10.1 | $12.7 \times 10^6$ |
| Saline (PBS) | 7.6 | $18.9 \times 10^6$ |

TABLE IV

| Resistance vs Taper Angle θ and E-field strength for 1000 nm Opening | | | |
|---|---|---|---|
| Solution | E-field (V/cm) | Taper Angle (deg) | $R_{open}$ (Ω) |
| 1 mM KCl | 10 | 12.5 | $34.9 \times 10^6$ |
| | | 12.3 | $42.3 \times 10^6$ |
| | | 11.2 | $78.9 \times 10^6$ |
| 10 mM KCl | 10 | 13.5 | $30.3 \times 10^6$ |
| | | 12.7 | $31.3 \times 10^6$ |
| | | 12.5 | $27.8 \times 10^6$ |
| 100 mM KCl | 10 | 12.9 | $3.00 \times 10^6$ |
| | | 13.2 | $2.44 \times 10^6$ |
| | | 11.1 | $2.00 \times 10^6$ |
| 500 mM KCl | 10 | 11.4 | $0.882 \times 10^6$ |
| | | 13.5 | $0.682 \times 10^6$ |
| | | 13.5 | $0.761 \times 10^6$ |
| Phosphate-Buffered Saline | 10 | 10.6 | $2.13 \times 10^6$ |
| | | 12.2 | $2.31 \times 10^6$ |
| | | 12.0 | $4.11 \times 10^6$ |
| 10 mM KCl | 5 | 11.7 | $24.2 \times 10^6$ |
| | | 13.0 | $26.8 \times 10^6$ |
| | | 12.2 | $25.9 \times 10^6$ |
| 10 mM KCl | 3.33 | 12.3 | $28.6 \times 10^6$ |
| | | 12.3 | $22.2 \times 10^6$ |
| | | 13.2 | $20.8 \times 10^6$ |
| 10 mM KCl | 1.67 | 12.1 | $26.3 \times 10^6$ |
| | | 12.7 | $22.7 \times 10^6$ |
| | | 11.3 | $22.7 \times 10^6$ |
| 10 mM KCl | 1 | 11.9 | $25.0 \times 10^6$ |
| | | 12.4 | $30.0 \times 10^6$ |
| | | 13.1 | $14.3 \times 10^6$ |

TABLE V

| Resistance vs Taper Angle θ for 2000 nm Opening and E = 10 V/cm | | |
|---|---|---|
| Solution | Angle (°) | $R_{open}$ (Ω) |
| 1 mM KCl | 17.9 | $22.7 \times 10^6$ |
| | 21.6 | $16.0 \times 10^6$ |
| | 16.5 | $18.6 \times 10^6$ |
| 10 mM KCl | 16.3 | $8.36 \times 10^6$ |
| | 15.0 | $9.38 \times 10^6$ |
| | 17.6 | $8.29 \times 10^6$ |
| 100 mM KCl | 14.6 | $1.26 \times 10^6$ |
| | 18.5 | $1.05 \times 10^6$ |
| | 19.9 | $1.19 \times 10^6$ |
| 500 mM KCl | 18.5 | $0.236 \times 10^6$ |
| | 17.3 | $0.204 \times 10^6$ |
| | 19.6 | $0.200 \times 10^6$ |
| PBS | 17.2 | $1.05 \times 10^6$ |
| | 17.1 | $0.701 \times 10^6$ |
| | 15.2 | $0.857 \times 10^6$ |

Figure 67:
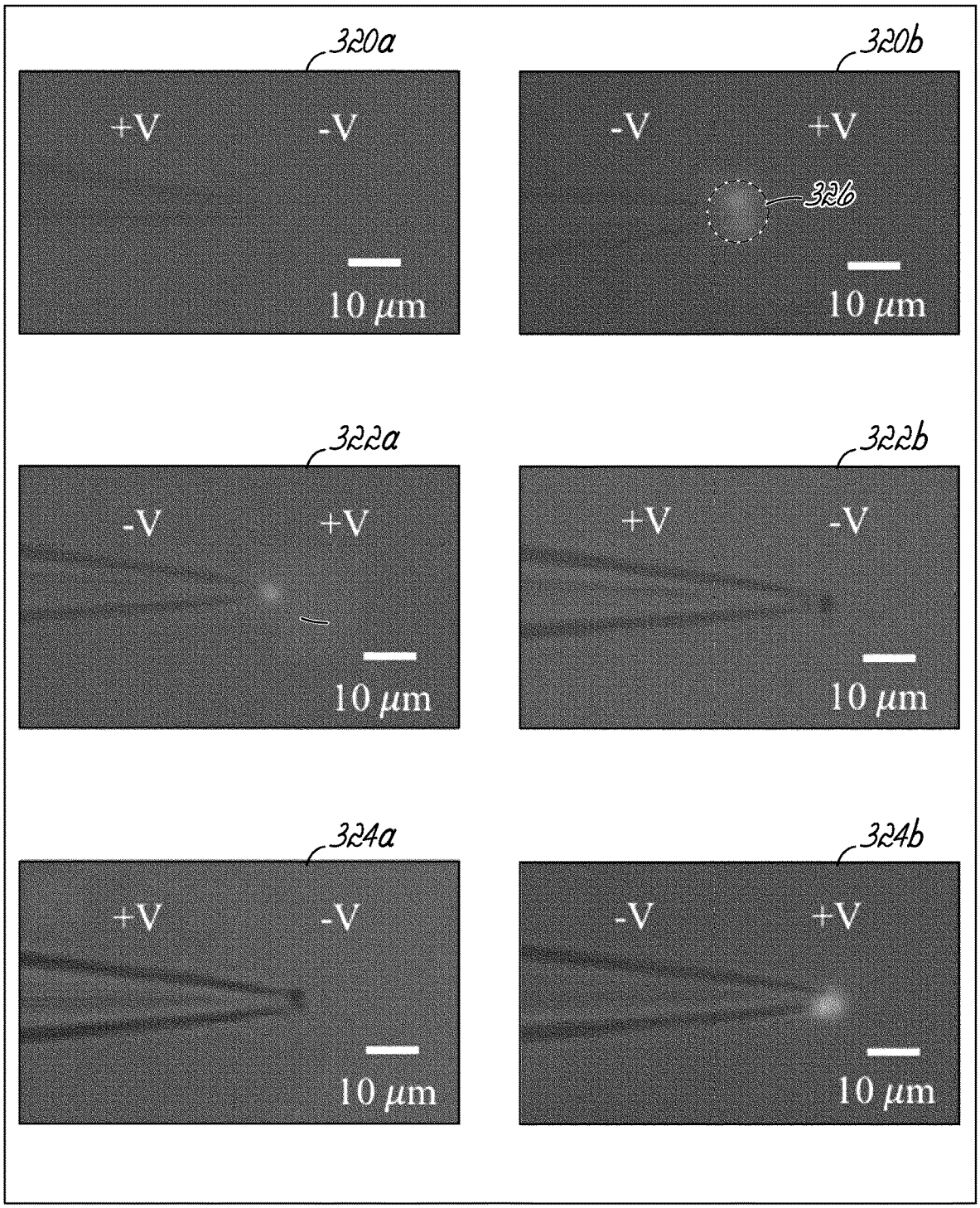
FIG. 67 includes photographic views depicting fluorescent regions proximate to the tip of the nanopipette indicative of the ability of the nanopipette to selectively capture liposomes by adjusting the electric field strength.

To demonstrate the ability of embodiments of the invention to trap extracellular vesicles, 100 nm fluorescently labeled artificial liposomes re-suspended in a phosphate-buffered saline solution were utilized as a model system. FIG. 67 includes images 320*a*-323*b* depicting results of trapping the artificial liposomes using a nanopipette 54 with a tip 10 having an opening 22 with a diameter of 1000 nm. Image sequence 320*a*-320*b* depicts trapping of liposomes after applying a positive electric field for 100 seconds (image 320*a*) and after applying a negative electric field for 100 seconds (image 320*b*). Image sequence 322*a*-322*b* depicts selective trapping of 100 nm fluorescently-tagged liposomes and 510 nm non-fluorescent COOH-PS beads after applying a positive electric field for 100 seconds (image 322*a*) and after applying a negative electric field for 100 seconds (image 322*b*). Image sequence 324*a*-324*b* depicts selective trapping of 100 nm fluorescently-tagged liposomes and 510 nm non-fluorescent COOH-PS after applying a positive electric field for 100 seconds (image 324*a*) and after applying a negative electric field for 100 seconds (image 324*b*).

Image sequence 320*a*-320*b* illustrates that no liposomes are trapped in response to applying a positive voltage across the electrodes 28, 30. However, in response to reversing the polarity of the voltage applied to the electrodes, liposomes are trapped proximate to the tip 10 as indicated by the appearance of fluorescent region 326. Since liposomes have a lower zeta potential (e.g., ~−8 mV) and relatively smaller size (100 nm) compared to the COOH-PS beads, the electrophoretic force acting on the liposomes may be much smaller than the electrophoretic force acting on the beads. The magnitude of the dielectrophoretic force induced on the liposomes is believed to become smaller due to the reduction of the size of the particles as suggested by equation 4. Thus, electro-osmosis force may be the dominant force which attracts the particles toward the opening 22.

The conductivity of a liposome membrane made of dioleoylphosphatidylcholine (DOPC) and cholesterol is believed to be less than 1 nS/m. Thus, the conductivity of the liposomes used in this study was determined to be less than $1\times10^{-2}$ μS/cm based on a dielectric multi-shell model. As a result, liposomes may be subject to a negative dielectrophilic force in the phosphate-buffered saline solution. Based on this, when a negative voltage is applied across the electrodes 28, 30, electro-osmotic force may urge the liposomes toward the trapping region while the negative dielectrophoretic and electrophoretic forces urge them away from the tip 10. This combination of forces may prevent particles from translocating through the nanopipette 54 and cause particles to be trapped proximate to the tip 10.

To determine the effect of voltage polarity on vesicles trapping, selective trapping of liposomes was achieved in a phosphate-buffered saline solution containing COOH-PS beads. Image 322*a* shows that as the negative electric field E was applied, liposomes were selectively trapped. Image 322*b* shows that as the voltage polarity was reversed, the non-fluorescent COOH-PS beads were trapped while the liposomes were released. Images 324*a* and 324*b* show that similar results are obtained as the positive bias is initially applied followed by a polarity reversal.

Figure 68:
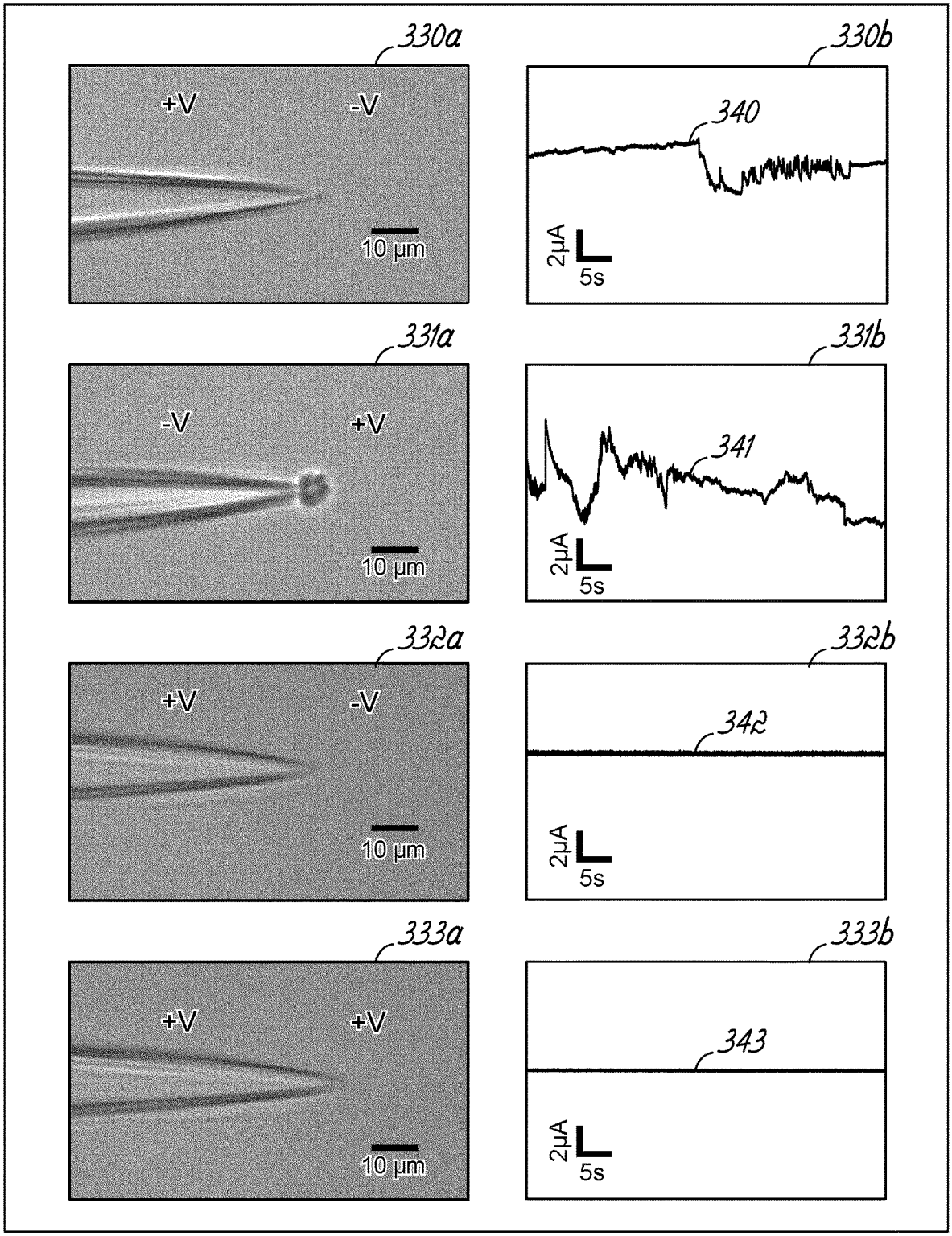
FIG. 68 includes photographic views of liposomes trapped proximate to the tip of the nanopipette and graphical views of the current passing through the opening verses time for electric fields having different polarities.

FIG. 68 depicts images 330*a*-333*a* and graphs 330*b*-333*b* that illustrate results of exosome trapping using a 10 V/cm electric field and tip with a 1000 nm diameter opening 22. Images 330*a*-333*a* show the results of trapping exosomes in a phosphate-buffered saline solution 100 seconds after applying a positive electric field E. Graphs 330*b*-333*b* include plots 340-343 showing the corresponding currents through the device verses time over a portion of the trapping interval. The depicted results were obtained by extracting exosomes from the plasma of healthy donors and reconstructing the exosomes in a phosphate-buffered saline solution.

Image 330*a* shows that only a few exosomes were trapped when a positive electric field was applied. Image 331*a* shows more significant trapping after the polarity of the electric field was reversed. Since exosomes have a similar zeta potential (e.g., ~−11 mV) and size as liposomes, they were likewise trapped by the negative polarity electric field. As shown by plots 340, 341, changes in the current were observed under both electric field polarities as the exosomes were accumulated by the tip, which provides a qualitative indication of trapping events.

Images 332*a*, 333*a* and graphs 332*b*, 333*b* show the results of control experiments under the same conditions described above using a phosphoric-buffered saline solution containing no exosomes. As can be seen from the plots 342, 343, the current across the opening 22 was generally constant over the measured interval. This may indicate a lack of false positive trapping events in the results depicted by plots 340 and 341. Exosome trapping was repeated using a polarity sequence in which the negative polarity electric field was applied first followed by the positive polarity electric field. This produced results essentially the same shown in 330*a*-331*a* and graphs 330*b*-331*b*.

Figure 69:
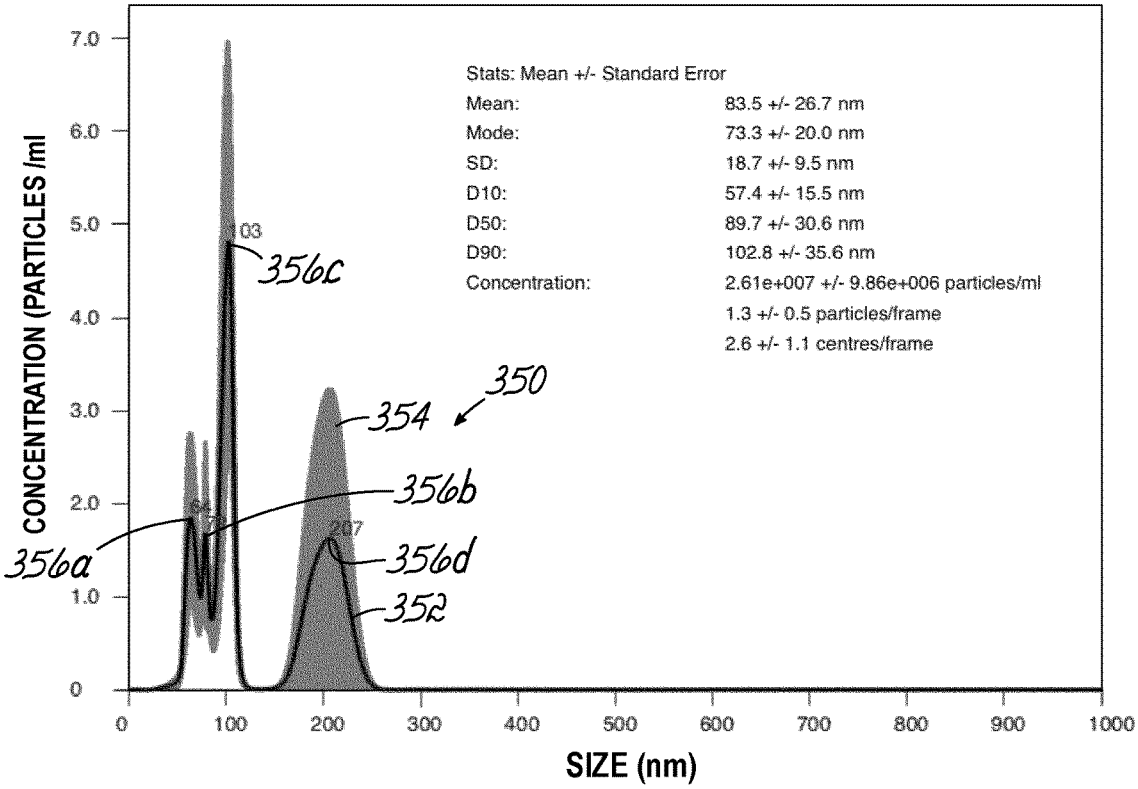
FIGS. 69 and 70 are graphical views depicting the distribution of particles in a suspending medium by the size of the particle.

FIG. 69 depicts a graph 350 including plots 352, 354 showing the concentration of exosomes in a suspending medium with respect to the size of the particle based on a Nanoparticle Tracking Analysis (NTA). Plot 352 shows a mean value of the concentration over several measurements, and plot 354 shows the standard error for the mean values of plot 352. The exosomes were resuspended in a phosphate buffered saline solution having a pH of 7.0. Particles were selectively trapped using an electric field of 10 V/cm and a nanopipette tip with an opening having a diameter of 1000 nm. The electric field was applied for 100 seconds. Plot 352 includes peaks 356*a*-356*d* indicating that prior to extraction the suspending medium included particles having diameters of 64, 79, 103, and 207 nm.

Figure 70:
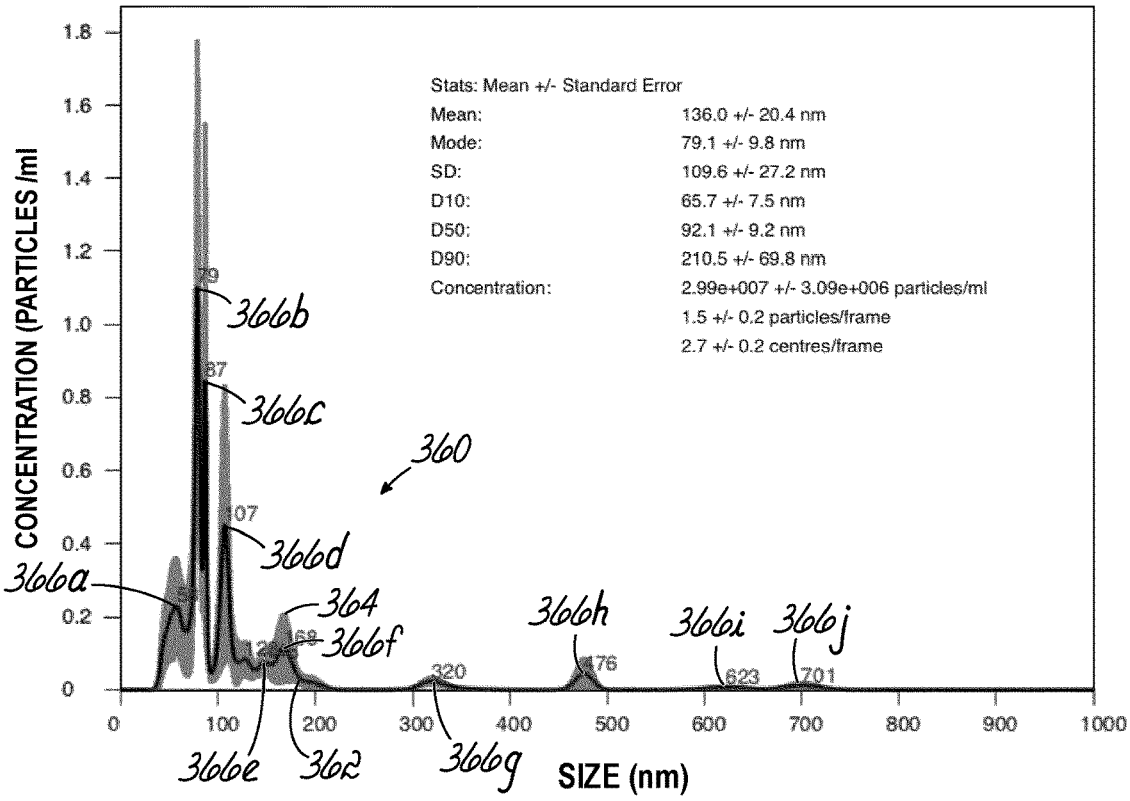

FIG. 70 depicts a graph 360 including plots 362, 364 showing the concentration of particles in the suspending medium with respect to size after selectively extracting particles having a diameter of approximately 207 nm using methods and devices in accordance with the embodiments of the invention described above. Plot 362 shows a mean value of the concentration over several measurements, and plot 364 shows the standard error for the mean values of plot 322. Plot 362 includes peaks 366*a*-366*j* indicating that the suspending medium includes particles having diameters of 58, 79, 87, 107, 126, 168, 320, 476, 623, and 701 nm. The lack of a peak at 207 nm indicates that these particles have been selectively removed from the suspending medium.

Figure 71:
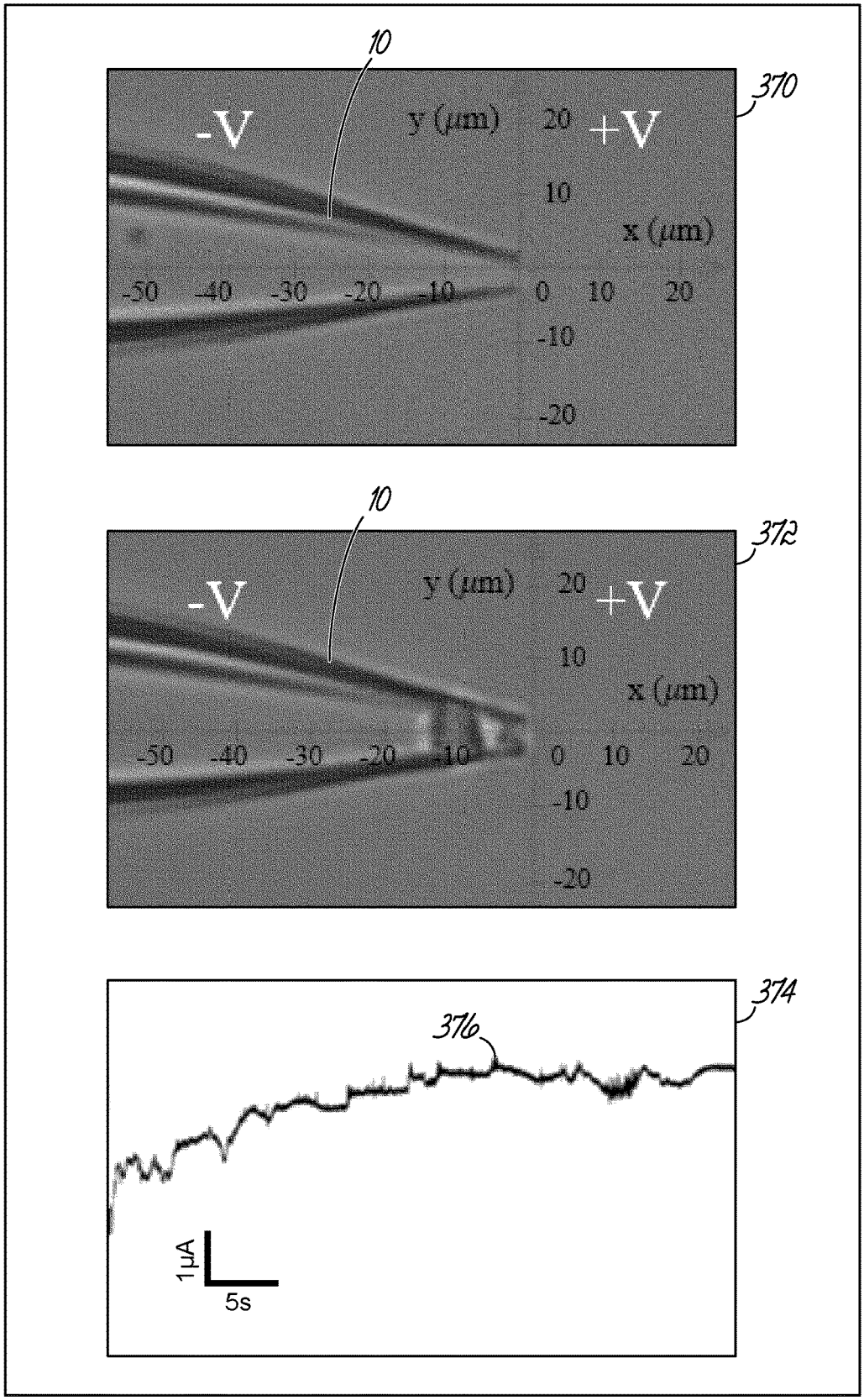
FIGS. 71 and 72 include photographic views of particles being trapped in the tip of a nanopipette and a graphical view of the bias current with respect to time.

FIG. 71 includes images 370, 372 and a graph 374 that depict trapping of nano-vesicles from a 50 μl sample of serum. Image 370 depicts the region proximate to the tip 10 at zero seconds. Image 372 depicts the region proximate to the tip 10 two minutes after application of the electric signal and shows that a globule of exosomes 375 has been trapped just inside the opening of the tip. Graph 374 includes a plot 376 of current verses time for a portion of the trapping interval showing variations consistent with particle trapping events.

Figure 72:
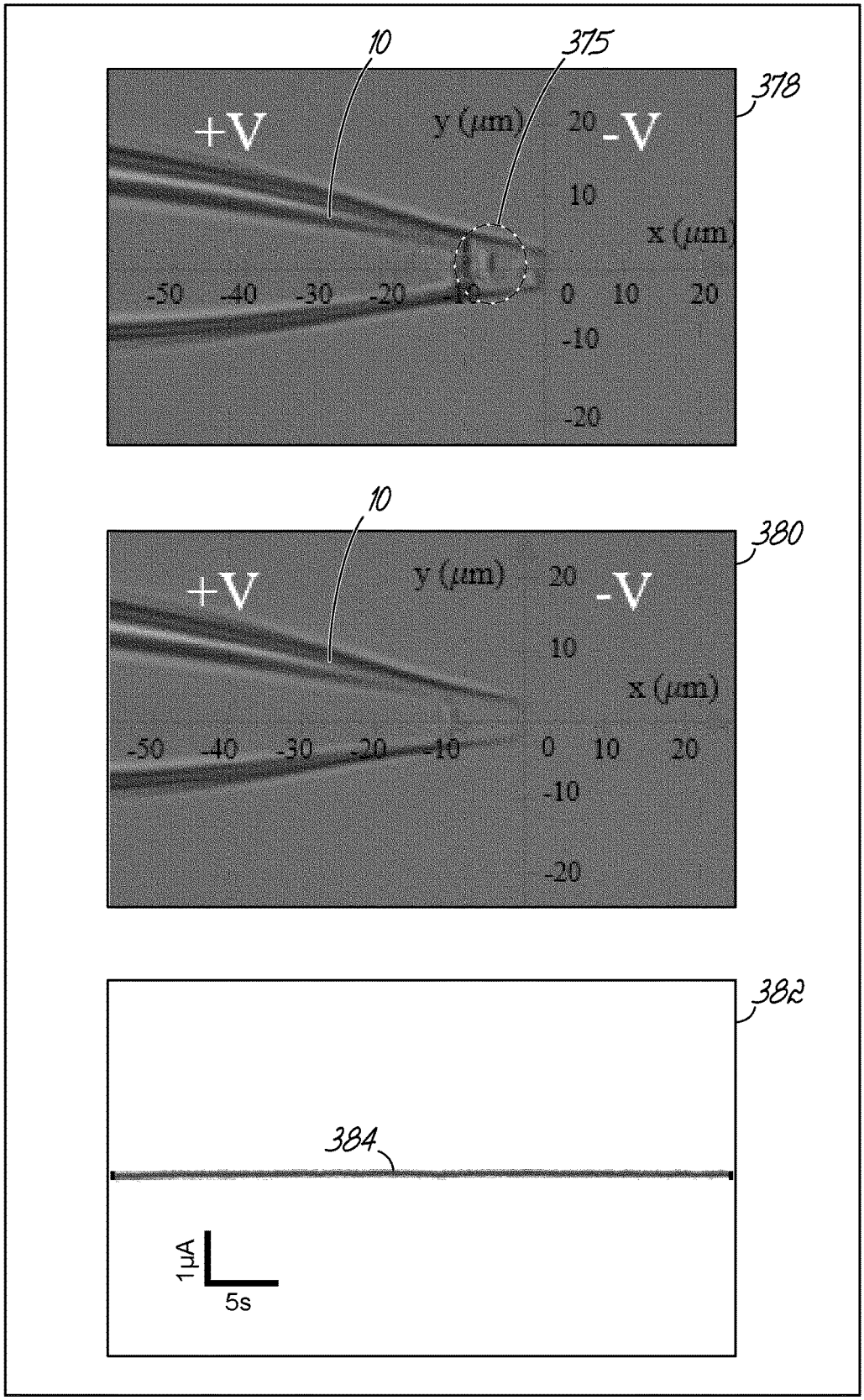
Figure 73:
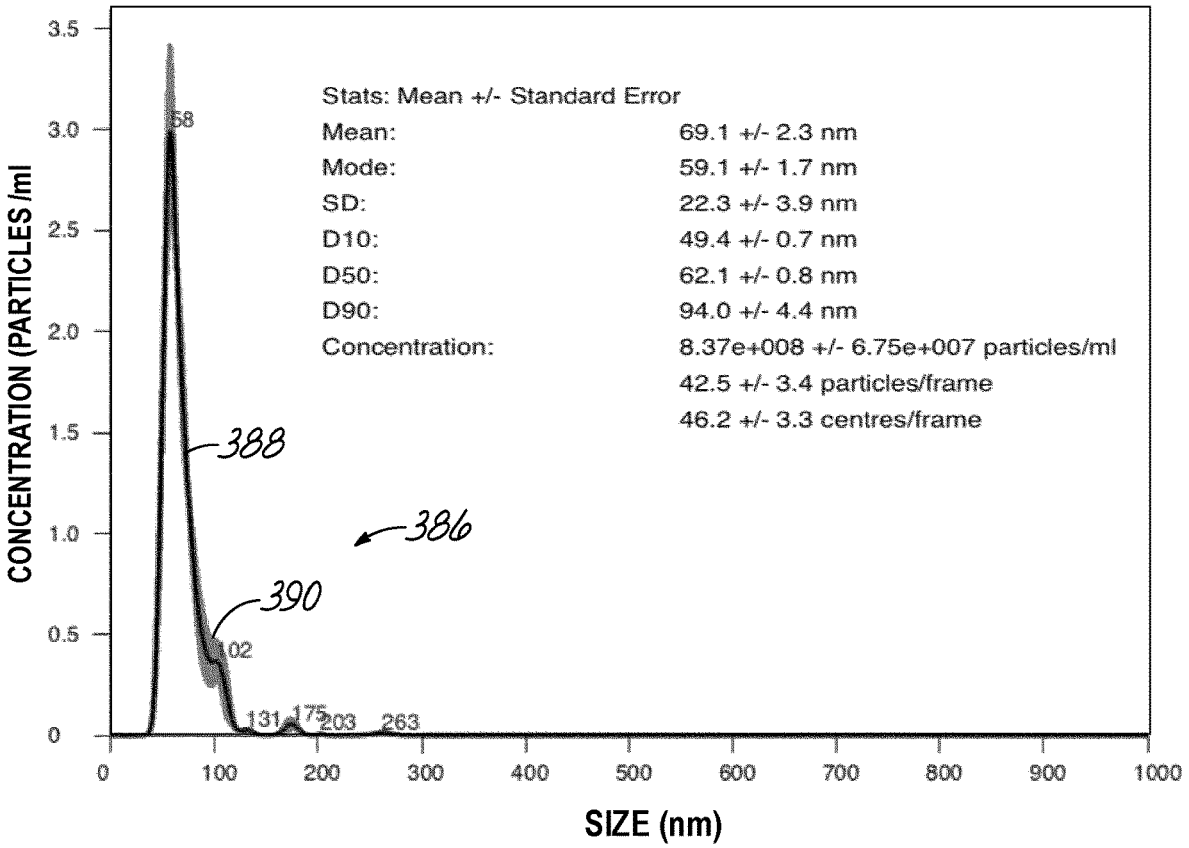
FIG. 73 is a graphical view depicting the distribution of particles in a suspending medium by the size of the particle.

FIG. 72 includes images 378, 380 and a graph 382 that depict the exchange of nano-vesicles from 50 μl phosphate buffered saline solution by reversing the polarity of the electric field. Image 378 depicts the region proximate to the tip at 0 seconds and shows the globule of exosomes 375. Image 380 depicts the region proximate to the tip 2 minutes after application of the reverse polarity electric signal and shows that the globule of exosomes 375 has been expelled into the collection medium. Graph 382 includes a plot 384 of current verses time for a portion of the signal application interval that is consistent with a lack of trapping events. FIG. 73 depicts a graph 386 including plots 388, 390 characterizing the vesicles extracted by the process described with respect to FIGS. 71 and 72. Plot 388 shows a mean value of the particle concentration verses particle size over several measurements, and plot 390 shows the standard error for the mean values of plot 388.

The process of extraction depicted by FIGS. 69-73, including pretreatment of the sample, typically takes less than 90 minutes. In comparison, extraction of exosomes from serum or other body fluids using state of the art conventional methods normally takes over four hours. As shown by image 372, under certain conditions, exosomes may enter the nanopipette through the opening 22 and be trapped inside the nanopipette. In this case, the exosomes may be released into a sample collection medium by exchanging the bulk suspending medium with the sample collection medium and changing the polarity of the bias voltage as described with respect to FIG. 72. The exchange of the bulk suspending medium may be accomplished by replacing the bulk suspending medium with a phosphate buffered saline solution in the collection chamber, or by moving the tip to a receptacle containing the sample collection medium, for example.

Exosomes have been shown to collect inside the nanopipette when they are extracted from a serum sample. However, the exosomes typically collect outside the tip when they are extracted from saliva. Thus, the location of the potential well may be dependent on the media in which the exosomes are suspended. An additional advantage of the above described extraction methods is that it enables extraction from small sample volumes. For example, the experimental results described with respect to FIGS. 69-73 involved the extraction of exosomes from 50 μl samples.

Figure 74:
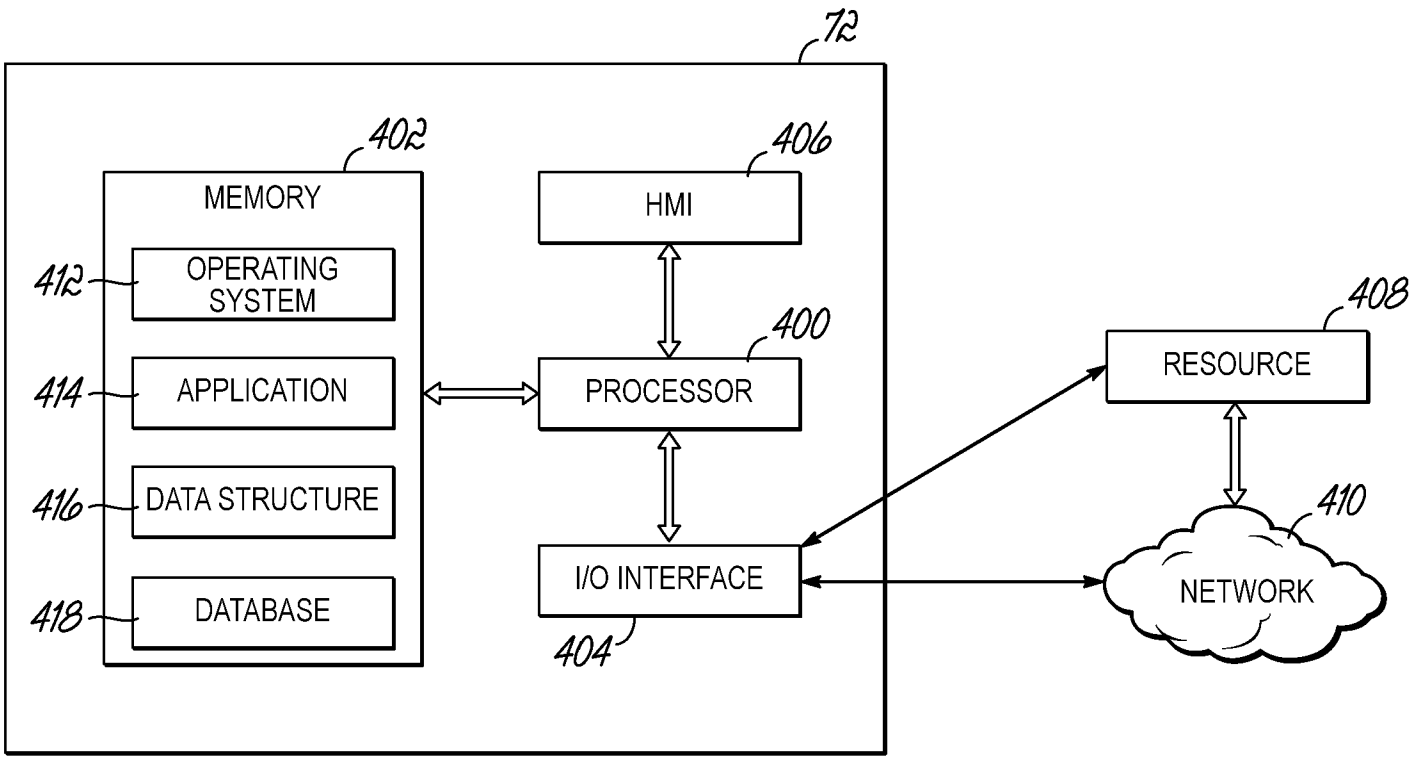
FIG. 74 is a diagrammatic view of an exemplary computer that may be used with the device of FIG. 5.

Referring now to FIG. 74, the computer 72 may include a processor 400, a memory 402, an input/output (I/O) interface 404, and a Human Machine Interface (HMI) 406. The computer 72 may also be operatively coupled to one or more external resources 408 via the I/O interface 404 and/or a network 410. External resources may include, but are not limited to, servers, databases, mass storage devices, peripheral devices, cloud-based network services, or any other resource that may be used by the computer 72.

The processor 400 may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on operational instructions that are stored in memory 402. Memory 402 may include a single memory device or a plurality of memory devices including, but not limited to, read-only memory (ROM), random access memory (RAM), volatile memory, non-volatile memory, static random access memory (SRAM), dynamic random access memory (DRAM), flash memory, cache memory, and/or data storage devices such as a hard drive, optical drive, tape drive, volatile or non-volatile solid state device, or any other device capable of storing data.

The processor 400 may operate under the control of an operating system 412 that resides in memory 402. The operating system 412 may manage computer resources so that computer program code embodied as one or more computer software applications, such as an application 414 residing in memory 402, may have instructions executed by the processor 400. The processor 400 may also execute the application 414 directly, in which case the operating system 412 may be omitted. The one or more computer software applications may include a running instance of an application comprising a server, which may accept requests from, and provide replies to, one or more corresponding client applications. One or more data structures 416 may also reside in memory 402, and may be used by the processor 400, operating system 412, and/or application 414 to store or manipulate data.

The I/O interface 404 may provide a machine interface that operatively couples the processor 400 to other devices and systems, such as the external resource 408 or network 410. The application 414 may thereby work cooperatively with the external resource 408 or network 410 by communicating via the I/O interface 404 to provide the various features, functions, applications, processes, and/or modules comprising embodiments of the invention. The application 414 may also have program code that is executed by one or more external resources 408, or otherwise rely on functions or signals provided by other system or network components external to the computer 72. Indeed, given the nearly endless hardware and software configurations possible, it should be understood that embodiments of the invention may include applications that are located externally to the computer 72, distributed among multiple computers or other external resources 408, or provided by computing resources (hardware and software) that are provided as a service over the network 410, such as a cloud computing service.

The HMI 406 may be operatively coupled to the processor 400 of computer 72 to enable a user to interact directly with the computer 72. The HMI 406 may include video or alphanumeric displays, a touch screen, a speaker, and any other suitable audio and visual indicators capable of providing data to the user. The HMI 406 may also include input devices and controls such as an alphanumeric keyboard, touch screen, a pointing device, keypads, pushbuttons, control knobs, microphones, etc., capable of accepting commands or input from the user and transmitting the entered input to the processor 400.

A database 418 may reside in memory 402 and may be used to collect and organize data used by the various devices, systems, and modules described herein. The database 418 may include data and supporting data structures that store and organize the data. The database 418 may be arranged with any database organization or structure including, but not limited to, a relational database, a hierarchical database, a network database, an object-oriented database, or combinations thereof.

A database management system in the form of a computer software application executing as instructions on the processor 400 may be used to access data stored in records of the database 418 in response to a query, where the query may be dynamically determined and executed by the operating system 412, other applications 414, or one or more modules. Although embodiments of the invention may be described herein using relational, hierarchical, network, object-oriented, or other database terminology in specific instances, it should be understood that embodiments of the invention may use any suitable database management model, and are not limited to any particular type of database.

In general, the routines executed to implement the embodiments of the invention, whether implemented as part of an operating system or a specific application, component, program, object, module or sequence of instructions, or a subset thereof, may be referred to herein as "computer program code," or simply "program code." Program code typically comprises computer-readable instructions that are resident at various times in various memory and storage devices in a computer and that, when read and executed by one or more processors in a computer, cause that computer to perform the operations necessary to execute operations and/or elements embodying the various aspects of the embodiments of the invention. Computer-readable program instructions for carrying out operations of the embodiments of the invention may be, for example, assembly language or either source code or object code written in any combination of one or more programming languages.

Various program code described herein may be identified based upon the application within which it is implemented in specific embodiments of the invention. However, it should be appreciated that any particular program nomenclature which follows is used merely for convenience, and thus the invention should not be limited to use solely in any specific application identified and/or implied by such nomenclature. Furthermore, given the generally endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the embodiments of the invention are not limited to the specific organization and allocation of program functionality described herein.

The program code embodied in any of the applications/modules described herein is capable of being individually or collectively distributed as a computer program product in a variety of different forms. In particular, the program code may be distributed using a computer-readable storage medium having computer-readable program instructions thereon for causing a processor to carry out aspects of the embodiments of the invention.

Computer-readable storage media, which is inherently non-transitory, may include volatile and non-volatile, and removable and non-removable tangible media implemented in any method or technology for storage of data, such as computer-readable instructions, data structures, program modules, or other data. Computer-readable storage media may further include RAM, ROM, erasable programmable read-only memory (EPROM), electrically erasable programmable read-only memory (EEPROM), flash memory or other solid-state memory technology, portable compact disc read-only memory (CD-ROM), or other optical storage, magnetic cassettes, magnetic tape, magnetic disk storage or other magnetic storage devices, or any other medium that can be used to store the desired data and which can be read by a computer. A computer-readable storage medium should not be construed as transitory signals per se (e.g., radio waves or other propagating electromagnetic waves, electromagnetic waves propagating through a transmission media such as a waveguide, or electrical signals transmitted through a wire). Computer-readable program instructions may be downloaded to a computer, another type of programmable data processing apparatus, or another device from a computer-readable storage medium or to an external computer or external storage device via a network.

Computer-readable program instructions stored in a computer-readable medium may be used to direct a computer, other types of programmable data processing apparatuses, or other devices to function in a particular manner, such that the instructions stored in the computer-readable medium produce an article of manufacture including instructions that implement the functions, acts, and/or operations specified in the flow-charts, sequence diagrams, and/or block diagrams. The computer program instructions may be provided to one or more processors of a general-purpose computer, a special purpose computer, or other programmable data processing apparatus to produce a machine, such that the instructions, which execute via the one or more processors, cause a series of computations to be performed to implement the functions, acts, and/or operations specified in the flow-charts, sequence diagrams, and/or block diagrams.

In certain alternative embodiments, the functions, acts, and/or operations specified in the flow-charts, sequence diagrams, and/or block diagrams may be re-ordered, processed serially, and/or processed concurrently consistent with embodiments of the invention. Moreover, any of the flow-charts, sequence diagrams, and/or block diagrams may include more or fewer blocks than those illustrated consistent with embodiments of the invention.

The terminology used herein is for the purpose of describing particular embodiments only and is not intended to be limiting of the embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, actions, steps, operations, elements, and/or components, but do not preclude the presence or addition of one or more other features, integers, actions, steps, operations, elements, components, and/or groups thereof. Furthermore, to the extent that the terms "includes", "having", "has", "with", "comprised of", or variants thereof are used in either the detailed description or the claims, such terms are intended to be inclusive in a manner similar to the term "comprising".

While all the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A method of manipulating particles in a suspending medium, the method comprising:

immersing a first end of a nanopipette in a back-fill medium, the first end including an inlet;

immersing a second end of the nanopipette in the suspending medium, the second end including a tip;

applying a reference signal to the suspending medium; and applying a bias signal to the back-fill medium, the reference signal and the bias signal defining an electrical signal having a characteristic that produces an electrophoretic force, a dielectrophoretic force, and an electroosmotic force which are balanced to define a net-zero force region that generates a potential well which traps particles proximate to the tip of the nanopipette.

2. The method of claim 1 further comprising:

in response to the particles accumulating at the tip of the nanopipette, moving the tip to a collection medium; and changing the characteristic of the electrical signal to release the particles from the potential well and into the collection medium.

3. The method of claim 1 wherein changing the characteristic of the electrical signal includes reversing a polarity of the electrical signal.

4. The method of claim 1 wherein the suspending medium comprises an aqueous solution including a salt, and the characteristic of the electrical signal is determined based at least in part on a molar concentration of the salt in the aqueous solution.

5. The method of claim 1 wherein the particles include first particles and second particles different from the first particles, and the characteristic of the electrical signal is selected so that the potential well selectively traps the first particles.

6. The method of claim 1 wherein the tip of the nanopipette has one or more characteristics, and the characteristic of the electrical signal depends at least in part on the one or more characteristics of the nanopipette.

7. The method of claim 6 wherein the one or more characteristics of the nanopipette includes one or more of a diameter of an opening in the tip, a taper, or a permittivity of a material from which the nanopipette is formed.

8. The method of claim 1, wherein the characteristic of the electrical signal depends at least in part on one or more of a viscosity, a permittivity, and a conductivity of the suspending medium.

9. The method of claim 1, wherein the characteristic of the electrical signal includes one or more of a voltage, a current, or a polarity of the electrical signal.

10. The method of claim 1, further comprising:

capturing one or more images of a region proximate to the tip of the nanopipette; and determining a number of particles that have been trapped in the potential well based on the one or more images.

11. The method of claim 1, wherein the particles include at least one of liposomes, exosomes, small extracellular vesicles, or carboxylate polystyrene beads.

12. A method of manipulating particles in a suspending medium, the method comprising:

immersing a first end of a nanopipette in a back-fill medium, the first end including an inlet;

immersing a second end of the nanopipette in the suspending medium, the second end including a tip;

applying a reference signal to the suspending medium; and applying a bias signal to the back-fill medium, the reference signal and the bias signal defining an electrical signal having a characteristic that produces an electrophoretic force, a dielectrophoretic force, and an electroosmotic force which are balanced to define a net-zero force region that generates a potential well which traps particles proximate to the tip of the nanopipette, wherein the characteristic of the electrical signal depends at least in part on one or more of a size, a charge, a permittivity, and a conductivity of the particles.

13. A method of manipulating particles in a suspending medium, the method comprising:

immersing a first end of a nanopipette in a back-fill medium, the first end including an inlet;

immersing a second end of the nanopipette in the suspending medium, the second end including a tip;

applying a reference signal to the suspending medium;

applying a bias signal to the back-fill medium, the reference signal and the bias signal defining an electrical signal having a characteristic that generates a potential well which traps particles proximate to the tip of the nanopipette;

measuring a current of the electrical signal; and determining a number of particles that have been trapped in the potential well based on the current.

14. A device for manipulating particles in a suspending medium, the device comprising:

a first chamber configured to receive a back-fill medium;

a second chamber configured to receive the suspending medium;

a nanopipette including a first end located in the first chamber and a second end located in the second chamber, the first end including an inlet and the second end including a tip;

a first electrode located in the first chamber;

a second electrode located in the second chamber;

a signal source including a first terminal electrically coupled to the first electrode and a second terminal electrically coupled to the second electrode, the signal source configured to output a reference signal on the first terminal and a bias signal on the second terminal, the reference signal and the bias signal defining an electrical signal having a characteristic that generates a potential well that traps the particles proximate to the tip of the nanopipette;

one or more processors; and a memory coupled to the one or more processors and including program code that, when executed by the one or more processors, causes the apparatus to:

in response to the particles accumulating at the tip of the nanopipette, move the tip to a collection medium; and change the characteristic of the electrical signal to release the particles from the potential well and into the collection medium.

15. The device of claim 14 wherein changing the characteristic of the electrical signal includes reversing a polarity of the electrical signal.

16. A device for manipulating particles in a suspending medium, the device comprising:

a first chamber configured to receive a back-fill medium;

a second chamber configured to receive the suspending medium;

a nanopipette including a first end located in the first chamber and a second end located in the second chamber, the first end including an inlet and the second end including a tip;

a first electrode located in the first chamber;

a second electrode located in the second chamber; and a signal source including a first terminal electrically coupled to the first electrode and a second terminal electrically coupled to the second electrode, the signal source configured to output a reference signal on the first terminal and a bias signal on the second terminal, the reference signal and the bias signal defining an electrical signal having a characteristic that produces an electrophoretic force, a dielectrophoretic force, and an electro-osmotic force which are balanced to define a net-zero force region that generates a potential well that traps the particles proximate to the tip of the nanopipette.

17. The device of claim 16, wherein the tip of the nanopipette has one or more characteristics, and the characteristic of the electrical signal depends at least in part on the one or more characteristics of the nanopipette.

18. The device of claim 16, wherein the particles have one or more characteristics, and the characteristic of the electrical signal depends at least in part on the one or more characteristics of the particles.

19. The device of claim 16, wherein the suspending medium has one or more characteristics, and the characteristic of the electrical signal depends at least in part on the one or more characteristics of the suspending medium.

20. The device of claim 16, wherein the particles include first particles and second particles different from the first particles, and the characteristic of the electrical signal is selected so that the potential well selectively traps the first particles.

* * * * *